US011946218B1

(12) United States Patent
Jaycox et al.

(10) Patent No.: US 11,946,218 B1
(45) Date of Patent: Apr. 2, 2024

(54) SYSTEM AND METHOD FOR ROBOTICS-ASSISTED FOUNDATION INSTALLATION

(71) Applicant: SITU-Places, Inc., Santa Cruz, CA (US)

(72) Inventors: Stephen W. Jaycox, Natick, MA (US); Quentin Topping, Santa Cruz, CA (US); Michael Goldin, Novato, CA (US); Johnny Lee, Redmond, WA (US)

(73) Assignee: SITU-Places Inc., Santa Cruz, CA (US)

( * ) Notice: Subject to any disclaimer, the term of this patent is extended or adjusted under 35 U.S.C. 154(b) by 0 days.

(21) Appl. No.: 18/306,953

(22) Filed: Apr. 25, 2023

Related U.S. Application Data

(63) Continuation-in-part of application No. 18/049,964, filed on Oct. 26, 2022.

(51) Int. Cl.
*E02D 7/14* (2006.01)
*E02D 13/04* (2006.01)

(52) U.S. Cl.
CPC ..... *E02D 7/14* (2013.01); *E02D 13/04* (2013.01); *E02D 2600/10* (2013.01)

(58) Field of Classification Search
CPC ..... E02D 7/14; E02D 13/04; E02D 2600/10
USPC ..... 405/230
See application file for complete search history.

(56) References Cited

U.S. PATENT DOCUMENTS 5,722,798 A * 3/1998 Gregory ..... E04G 23/065 254/133 R
6,550,199 B2 * 4/2003 Phillips ..... E04B 1/34352 52/741.11
2012/0207550 A1 * 8/2012 Aksel ..... E21B 19/002 405/224.4
2017/0067220 A1 * 3/2017 Grover ..... E02D 13/04
2018/0230707 A1 * 8/2018 Parker ..... E02D 27/32

FOREIGN PATENT DOCUMENTS

KR 10-2039443 * 11/2019
WO WO 99/28572 * 6/1999

OTHER PUBLICATIONS

JP 5-25826 (Year: 1993).*
JP 10-30230 (Year: 1998).*
JP 2011-202450 (Year: 2011).*

* cited by examiner

*Primary Examiner* — Sunil Singh
(74) *Attorney, Agent, or Firm* — Dergosits & Noah LLP

(57) ABSTRACT

A robotics-assisted foundation installation system is provided in which data reporting the X, Y, and Z positions of foundation column tops are sent from a total surveying station to a grid control system. The grid control system receives the data and associates specific data with specific columns in an array—the "grid." The grid control system compares the actual positions of the columns in the grid to target positions that were determined based on the requirements of the structure to be supported. After determining differences between the actual positions and the target positions, the grid control system sends instructions to column positioning tools associated with the individual columns. Actuators in a column positioning tool are directed by the grid control system to adjust the position of the associated column. Once the live streamed data confirms that each column is in the proper position, the columns are fixed in place.

17 Claims, 32 Drawing Sheets

SYSTEM AND METHOD FOR ROBOTICS-ASSISTED FOUNDATION INSTALLATION

CROSS-REFERENCE TO RELATED CASES

This application is a continuation-in-part of U.S. patent application Ser. No. 18/049,964, entitled "System And Method For Robotics-Assisted Foundation Installation," filed Oct. 26, 2022, which claims priority to U.S. Provisional Patent Application No. 63/272,055, entitled "System And Method For Robotics-Assisted Foundation Installation," filed on Oct. 26, 2021, which are hereby incorporated by reference.

TECHNICAL FIELD

The claimed subject matter relates generally to the field of construction and more specifically to the installation of in-ground foundation and structure-supporting column assemblies that require precision placement of column(s).

BACKGROUND

The construction industry's prevailing means and methods shape the offerings developers are able to bring to market. These optimize construction under a specific set of conditions and inform site requirements that in turn produce built responses that become industry standards. These standards are familiar, accepted, de-risked and even cost effective—to the extent that the types of building sites that these means and methods prefer are available for development. In many trade areas, however, there is a scarcity of industry-preferred buildable sites. This scarcity drives up costs of land and labor, but the increased costs do not yield any added quality, precision, or durability in the built outcome. One possible solution to the decoupling of quality and cost that results is to develop new strategies to build cost effectively on what the industry standard would characterize as "difficult" build sites. If one is able to build cost effectively on sites for which the prevailing means and methods would be too expensive, then one could exploit discounted land costs to deliver built outcomes of a higher quality, while producing real estate assets that reasonably map to market comps.

A common problem in construction is the difficulty and high cost of achieving a precise foundation column grid layout on sites with topography or access obstacles or other challenges. The problem is the ability to mediate between acceptable construction tolerances at the bottom of columns, where the foundation supports meet the earth, and the target machine precision tolerances that are required at the tops of columns in order to receive offsite manufactured (factory-built) components. The sensitivity of the alignment of the top of a column is driven by the need to achieve precision bolt hole alignment to meet the predetermined geometry of components produced offsite, so that the composite assembly faithfully satisfies its structural engineering requirements, and multi-module builds do not encounter spatial overlap (interferences) or gaps in the column grid. The taller the foundation column is, or the more variety in offset heights there are (due to rolling topography below), the greater the risk of failing to achieve the required top of column machine tolerance. Having a system that is able to precisely and consistently position tops of columns to receive pre-manufactured structures, frames, or elements would unlock an entirely new inventory of sites for cost-effective development—turning a scarcity of easily buildable sites into a surplus.

There is a need for a new building strategy that leverages the advances in pre-fabricated, offsite building techniques and combines these with a technology-accelerated installation strategy to make it faster, easier, and less expensive to precisely install offsite fabricated buildings on difficult build sites. Thus, it would be desirable for a system and method that facilitates the leveling of foundation columns.

BRIEF SUMMARY

In an embodiment, live-streamed data inputs reporting the X, Y, and Z positions of column tops are sent from a total surveying station as a data package to a grid control system and may include: a computing device with memory; software; a wireless communications device for the input and output of data, e.g., Wi-Fi, or optionally input and output ports for data transmission by hardwire; a power supply; and is weather sealed and suitable for outdoor use. The grid control system receives the live streamed data and associates specific data with specific columns in an array—the "grid." The grid control system compares the actual positions of the columns in the grid, to target positions based on the requirements of the structure to be supported. After determining differences between the actual positions and the target positions, the grid control system then sends instructions to column positioning tools associated with the individual columns. Each column positioning tool has actuators that are directed by the grid control system to adjust the position of the associated column. Once the live streamed data confirms that each column is in the proper position, the columns are fixed in place.

In this embodiment, in addition to directing an individual tool to move an individual column a certain distance, a benefit of the system is that it is able to communicate with multiple columns in the array and perform a "global optimization" of the column array set. This global optimization may include instructing some or all of the columns to move as an ensemble an equal distance. Such an instruction may be the result of the grid control system determining that a single column is prevented from reaching its target position, e.g., by the target position being beyond the range within which the column may be moved by the column's tool. As a result of that determination regarding the single column, the grid control system may instruct some or all of the other columns to move as an ensemble to new target grid positions that have been recalculated by the grid control system to alleviate the out-of-range issue caused by the single column.

BRIEF DESCRIPTION OF THE DRAWINGS

The embodiments are illustrated by way of example and not limitation in the figures of the accompanying drawings, in which like references indicate similar elements, and in which.

DETAILED DESCRIPTION

Embodiments describe a robotics-assisted foundation installation system that uses communication between electronic surveying and geolocation products to determine column top locations, specify a foundation column top grid, direct column tops to specified locations, and maintain the column tops at the specified locations while the columns are fixed in position. After being fixed in place, the grid of column tops has the precision of alignment needed to install a prefabricated structure, frame or infrastructure element.

A target for embodiments of a robotics-assisted foundation setting solution is the serial installation of occupiable structures. Consider the precedent technique of site-based serial production as exemplified by the construction of tract homes by merchant builders/developers on easy build sites in which the idea of the assembly line is inverted—with a specialized labor force moving from site to site rather than the produced good itself moving through the serial stages of an assembly line. For example, when vertical construction begins in typical tract home building, the ditch digging crew starts and completes their work on site "A" before moving to site "B" where their labor reproduces the same, or similar, outcome. In their place, a rebar setting team moves on to site "A," to be followed by the concrete pour crew, and so on in a flow of crews across the total subdivision development tract.

Embodiments of a robotics-assisted foundation setting solution facilitate a similar ability to serially produce structures—but also facilitate production on difficult build sites—such as ones with steep topography, remote or island geography, having numerous obstacles or uninterruptible watersheds, or even being situated partially or completely over water.

Figure 1:
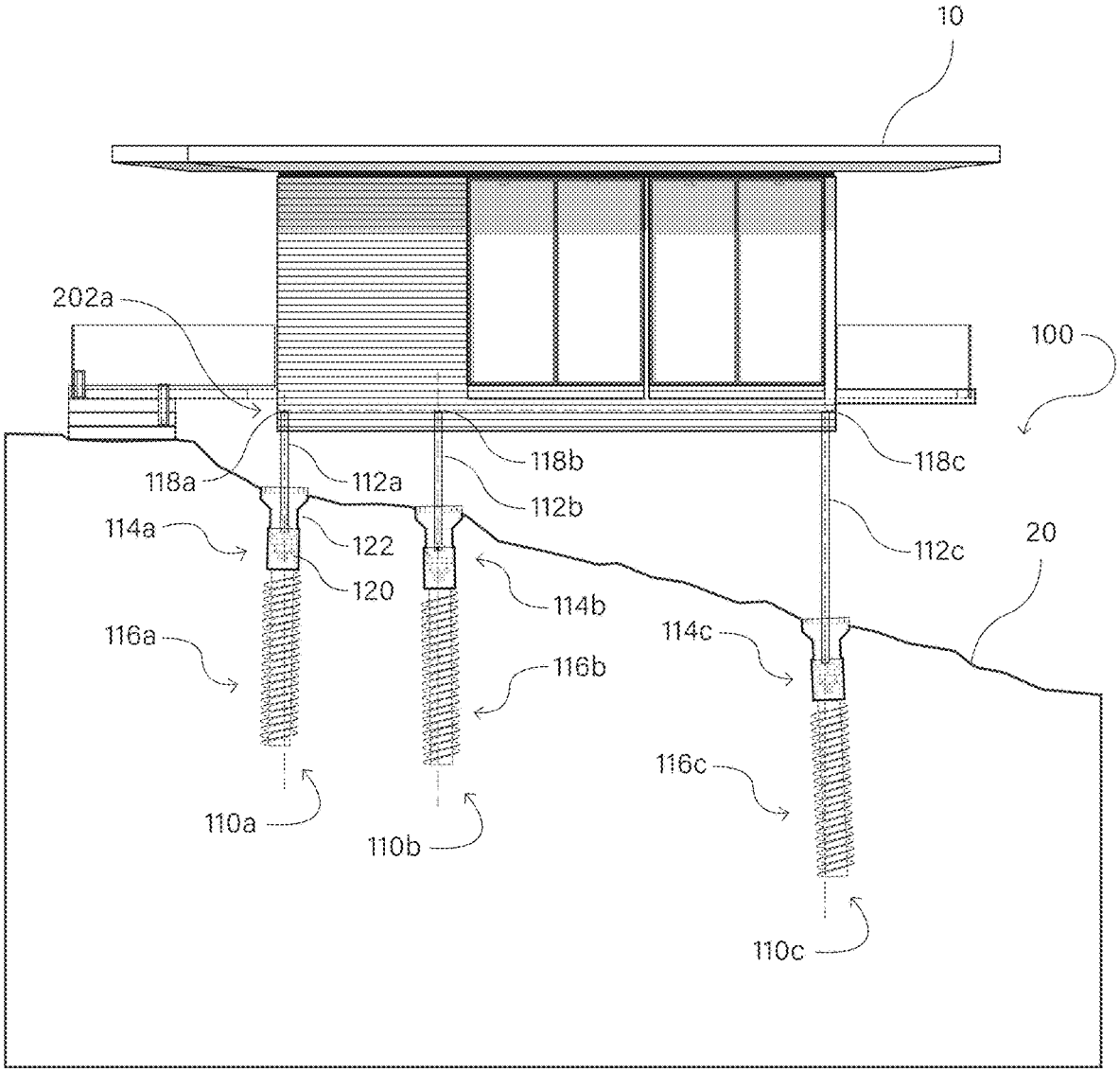
FIG. 1 is a diagram illustrating a cross-sectional view of aspects of an embodiment of a robotics-assisted foundation installation system.

FIG. 1 is a diagram illustrating a cross-sectional view of aspects of an embodiment of a robotics-assisted foundation installation system 100. FIG. 1 illustrates an intended outcome for a structure 10 on a hypothetically difficult site 20 and supported by foundation columns 110*a* . . . 110*c*. System 100 is used to bring structural column tops 118*a* . . . 118*c* into a precise formation, indicated by a plane 202*a*, in preparation for the addition of structure 10.

In this discussion, reference numbers with an additional letter designation (e.g., 110*a*) represent a specific instance of the generic element (e.g., 110). Thus, discussion directed to the generic element (e.g., 110) should be understood to apply equally to each specific instance (e.g., 110*a* . . . 110*c*).

Foundation column 110 includes an in-ground foundation 116. Atop in-ground foundation 116, a coupler 114 is attached. Coupler 114 includes two sections, a coupling base 120 and an upper coupler 122. An upper telescoping column 112 is received within upper coupler 122. In-ground foundation 116 is a helical pier (or helical pile), one of many known types of in-ground foundations, and in embodiments coupling base 120 may be adapted to interface with other types of in-ground foundations. In-ground foundation 116 and coupler 114 are fixed with respect to each other at site 20 before the addition of upper column 112.

System 100 may employ foundation column 110 in the following general manner. With in-ground foundation 116 and coupler 114 in place, a column positioning tool, such as column positioning tool 310 (FIG. 4), 402 (FIG. 15), or 502 (FIG. 16), is attached to upper coupler 122 and upper column 112 is inserted into the positioning tool. System 100 then determines a target position for column top 118 and directs the positioning tool to move column 112 with respect to upper coupler 122 until column 118 is within a predetermined tolerance of the target position. This may take a number of re-measurements and re-positionings. Upon determining that column top 118 is within the tolerance from the target position, column 112 is fixed in place with respect to upper coupler 122. In some embodiments, this is accomplished by pouring grout into upper coupler 122 and allowing it to harden. While the grout is hardening, the positioning tool remains in place and the location of column top 118 may be remeasured and reposited by system 100 until the grout hardens to the point that repositioning is no longer possible. After the grout hardens, the positioning tool may be removed for later re-use. System 100 may do this for many columns 110 at the same time, which is discussed in more detail with regard to, e.g., FIG. 3—FIG. 5.

Figure 2:
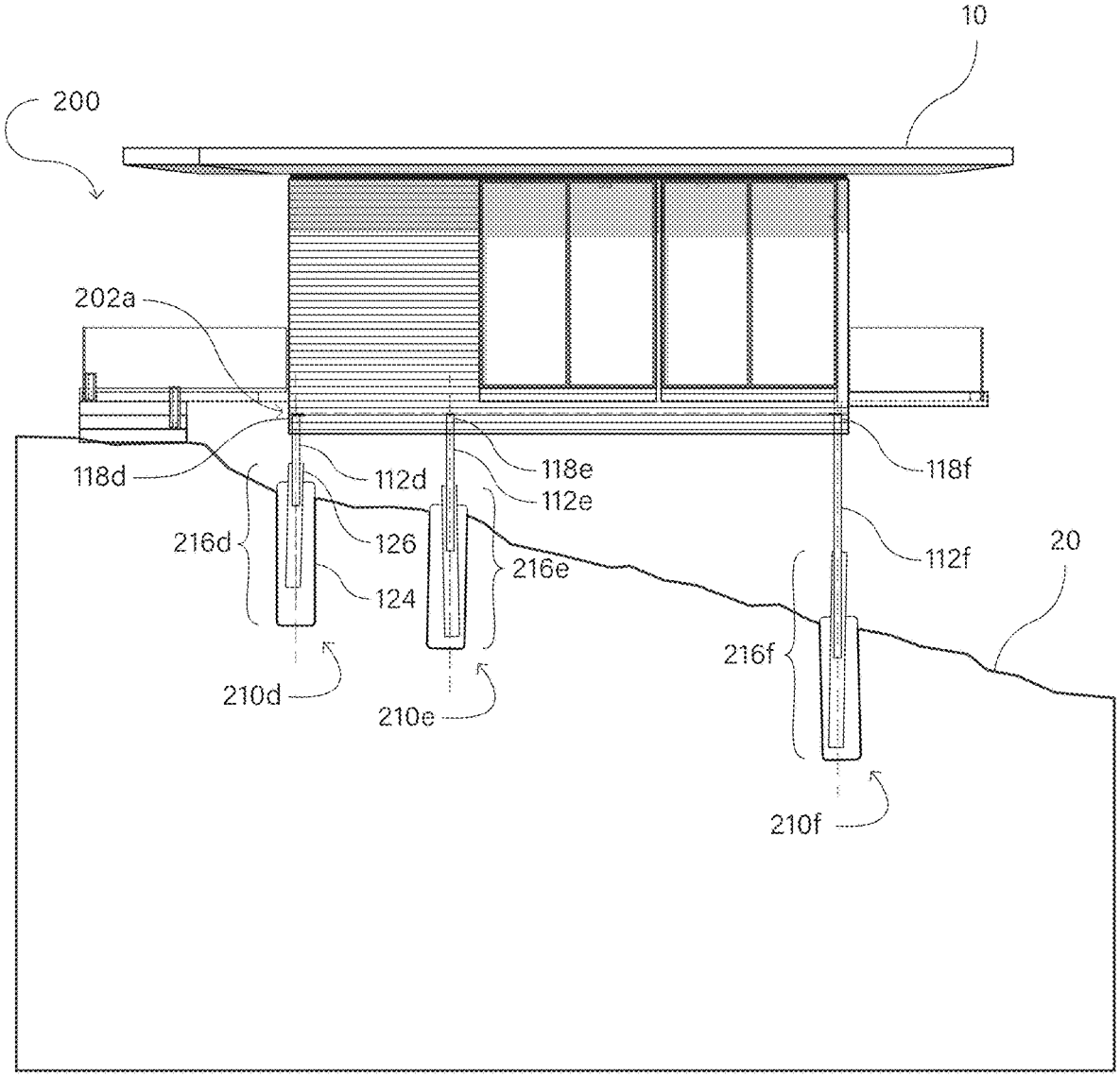
FIG. 2 is a diagram illustrating a cross-sectional view of aspects of an embodiment of a robotics-assisted foundation installation system.

FIG. 2 is a diagram illustrating a cross-sectional view of aspects of an embodiment of a robotics-assisted foundation installation system 200. FIG. 2 illustrates an intended outcome for a structure 10 on a hypothetically difficult site 20 and supported by an embodiment of foundation columns 210*d* . . . 210*f*. As with system 100, system 200 is used to bring structural column tops 118*d* . . . 118*f* into a precise formation, indicated by plane 202*a*, in preparation for the addition of structure 10. In this embodiment, foundation column 210 includes an in-ground foundation 216, including a lower in-ground foundation 124 and a lower telescoping column 126. Upper telescoping column 112 is received within lower column 126. In-ground foundation 124 is of pre-cast concrete, another of many known types of in-ground foundations. Thus, lower column 126 may be adapted to interface with other types of in-ground foundations. In-ground foundation 124 and lower column 126 are fixed with respect to each other at site 20 before the addition of upper column 112.

System 200 may employ foundation column 210 in the following general manner. With in-ground foundation 124 and lower column 126 in place, a column positioning tool, such as column positioning tool 310 (FIG. 4), 402 (FIG. 15), or 502 (FIG. 16), is attached to upper coupler 122 and upper column 112 is inserted into the positioning tool. System 200 then determines a target position for column top 118 and directs the positioning tool to move column 112 with respect to lower column 126 until column 118 is within a predetermined tolerance of the target position. This may take a number of re-measurements and re-positionings. Upon determining that column top 118 is within the tolerance from the target position, column 112 is fixed in place with respect to lower column 126. In some embodiments, this is accomplished by pouring grout into lower column 126 and allowing it to harden. While the grout is hardening, the positioning tool remains in place and the location of column top 118 may be remeasured and reposited by system 200 until the grout hardens to the point that repositioning is no longer possible. After the grout hardens, the positioning tool may be removed for later re-use. As with system 100, system 200 may do this for many columns 210 at the same time.

In FIG. 1 and FIG. 2, systems 100, 200 may accommodate a variety of possible sites by using a telescoping arrangement between upper telescoping column 112 and coupler 114 or lower telescoping column 126. The 2-piece "telescoping" steel column interface (labeled column 112 and coupler 114 in FIG. 2) connects the in-ground foundation (either concrete or helical piers installed at reasonable construction tolerances relative to variance from true grid) to the receiving plates upon which a pre-fabricated structure, frame or element may rest (at machine tolerance, highly precise to true grid). It is this telescoping feature that allows great flexibility in setting up a grid array of foundation piers over dramatically uneven terrain and opens the possibility for a robotics-assisted solution for serial installation.

Both coupler 114 and lower telescoping column 126 connect to in-ground foundation elements (e.g., helical piers or pre-cast concrete) that may be installed at reasonable construction tolerances, which are more lax than the tolerances required at column tips 118, which require machine tolerances that are highly precise to true grid. The telescoping feature of systems 100, 200 allows great flexibility in setting up a grid array of foundation piers over dramatically uneven terrain and opens the possibility for a robotics-assisted solution for serial installation.

Figure 3:
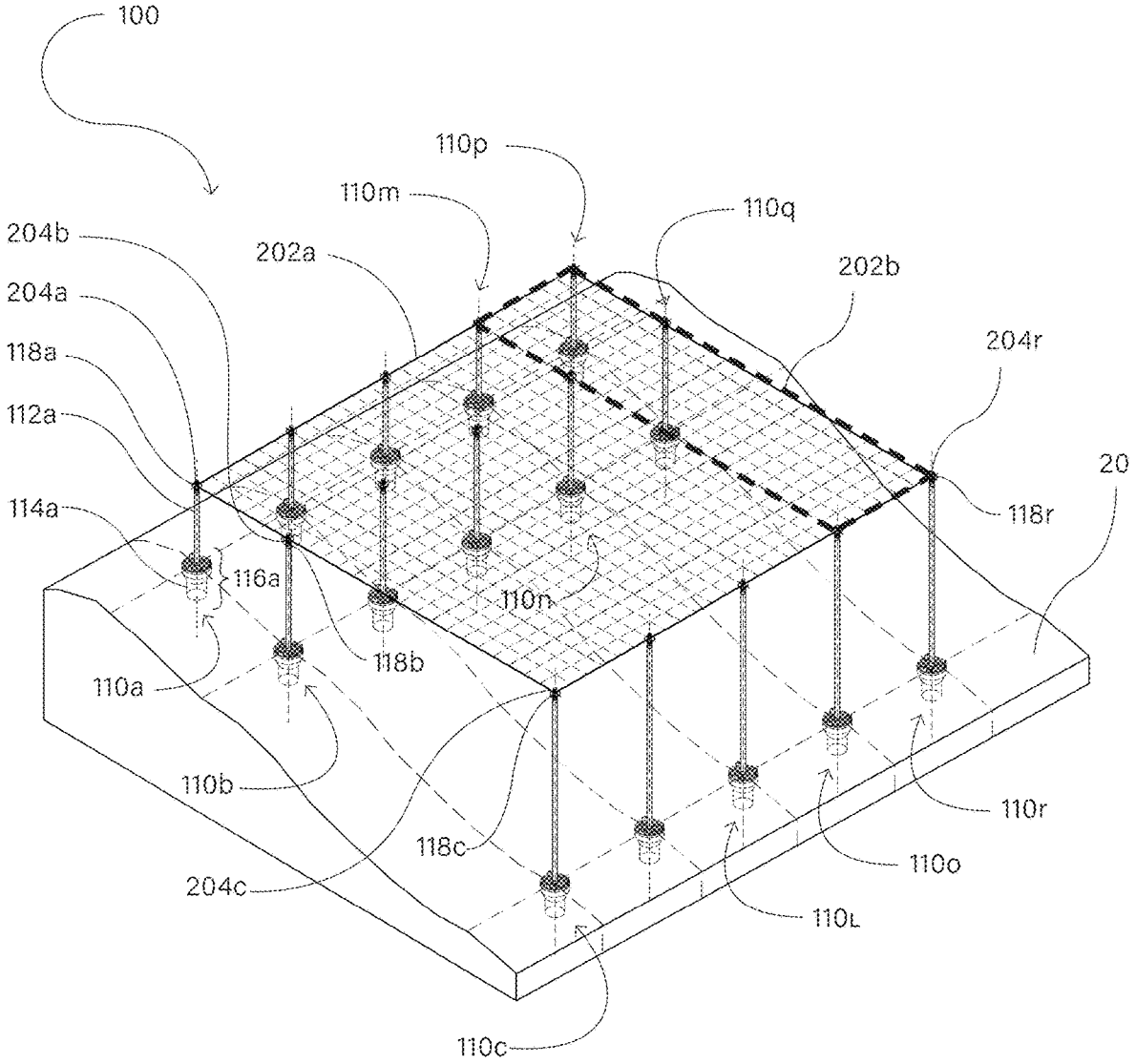
FIG. 3 is a perspective view illustrating aspects of an embodiment of a robotics-assisted foundation installation system.

FIG. 3 is a perspective view illustrating aspects of an embodiment of a robotics-assisted foundation installation system 100. In FIG. 3, each foundation column 110 is provided with a geolocation device 204 atop column tip 118. In embodiments, geolocation device 204 may include a reflector, or a GPS position indicator. In FIG. 3, plane 202*a* represents a height that each column tip 118*a* . . . 118*r* must achieve, within a tolerance. A plane 202*b* illustrates that, in embodiments, systems 100, 200 may have different target locations for different sets of column tips. Thus, plane 202*a* may be at a first height and be the target height for column tips 118*a* . . . 1181 and plane 202*b* may be at a different height and be the target height for column tips 118*m* . . . 118*r*.

Figure 4:
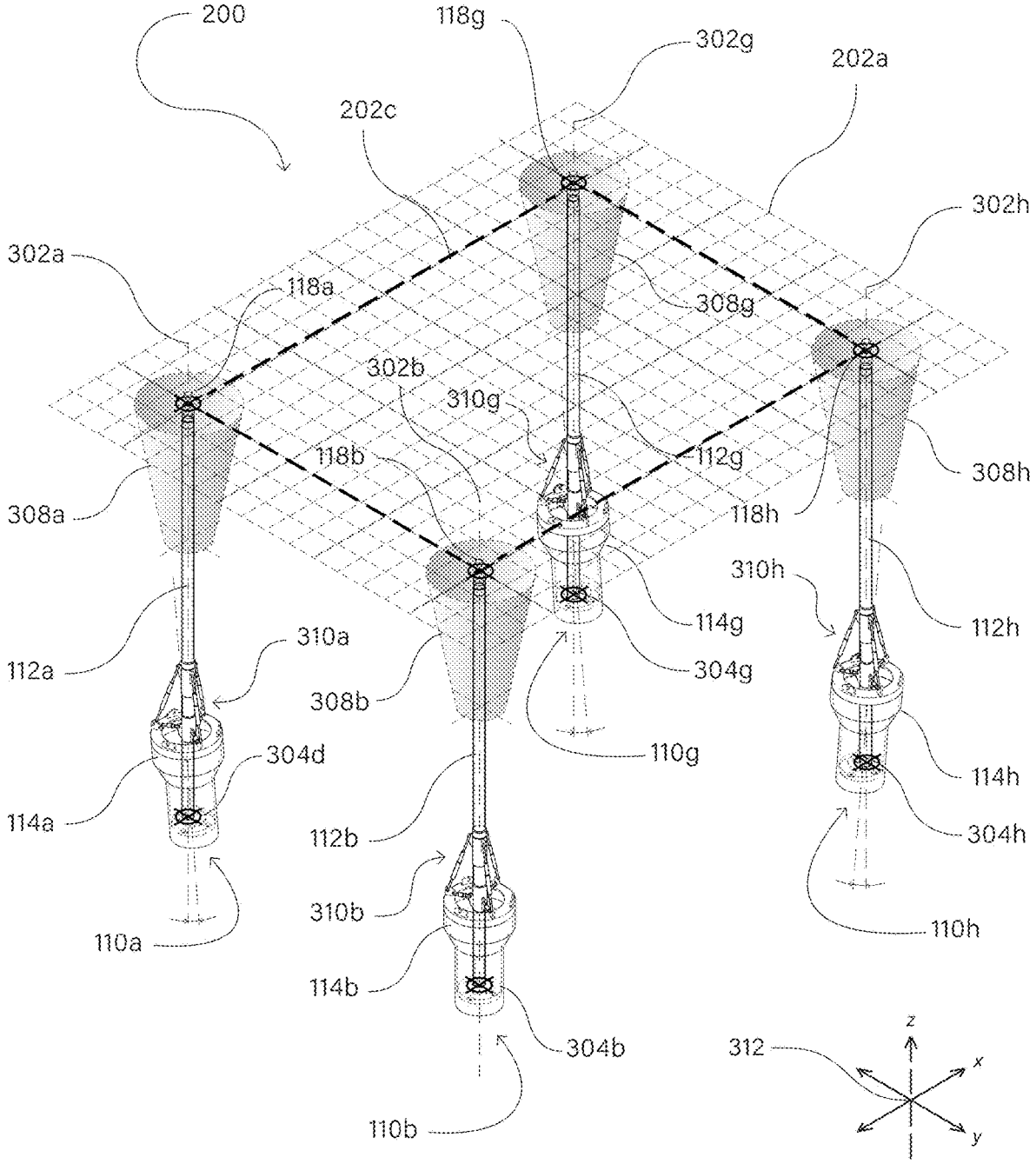
FIG. 4 is a perspective view illustrating aspects of the embodiment of a robotics-assisted foundation installation system of FIG. 3.

FIG. 4 is a perspective view illustrating aspects of the embodiment of the robotics-assisted foundation installation of system 100 of FIG. 3. In FIG. 4, couplers 114 are shown in various states of misalignment. For example, coupler 114*a* is shown tilted slightly to the left. The angle below coupler 114*a* indicates a misalignment from the vertical axis of upper column 112*a*. Similarly, couplers 114*g* and 114*h* show a misalignment. Coupler 110*b*, on the other hand, represents an ideal installation. FIG. 4 illustrates that some embodiments may be used to correct for both a misalignment of an in-ground foundation and a deviation of an in-ground foundation from a specified installation height. This capability is provided by a column positioning tool 310 in combination with coupler 114. Column positioning tool 310, with reference to specific tool 310*b*, has actuators with the capability to move upper column 112 in five degrees of freedom: translation in X, Y, and Z directions 312 with the X, Y plane being parallel to plane 202*a*; and rotation about the X and Y axes.

With this capability, column 112 may be tilted about the X and Y axes, and its base may be translated in the X, Y, and Z directions within coupler 114, resulting in upper column 112 having a range of tilt orientations indicated by range cone 308. For example, upper column 112*b* has a range cone

308*b* indicating that column tip 118*b* may be placed anywhere in the intersection of range cone 308*b* and plane 202*a*. The range cone 308 is not defined with respect to a specific center bottom point of coupler 114. Instead, the ability to translate the bottom of upper column 112 in the X, Y, and Z directions within coupler 114 increases the potential angles of rotation about the X and Y axes and expands range cone 308. A lower target point 304 indicates the desired intersection of the axis of upper column 112 with the bottom of coupler 114 after column 112 has been moved to align with a target alignment axis 302. For example, target point 304*a* is not bottom dead center of coupler 114*a*. Target point 304*a* indicates the alignment axis of upper column 112*a* after column 112*a* has been aligned with target alignment 302*a*. In this alignment, column 112 may be translated by positioning tool 310*a* along the Z axis to bring column tip 118*a* with a tolerance distance from plane 202*a*. Similarly, couplers 114*g* and 114*h* are misaligned, which results in target points 304*g* and 304*h* being off center. The positioning of target points 304 will be discussed with reference to FIG. 11A-FIG.

Thus, if the target location for a column tip 118 is within the associated range cone 308, and within a Z-axis range 306 of potential motion of the associated positioning tool 310, then the positioning tool 310 may be commanded by system 100 to adjust the position of upper column 112 until column tip 118 is properly located on plane 202*a*.

A plane 202*c* indicates a portion of plane 202*a*. The grid pattern is indicative of the problem solved by embodiments, which is to cause each column tip 118 to move to a target position on the grid of plane 202*c*. The first issue is that initial positions of tips 118 must be determined before the height of plane 202*a* can be determined. Then a range cone 308 and a Z-axis range 306 is determined for each foundation column 110. Then plane 202*c* is computed so that the target X, Y, and Z locations for each column tip 118 fall within the range 308 and Z-axis range 306 for that column tip.

Figure 5:
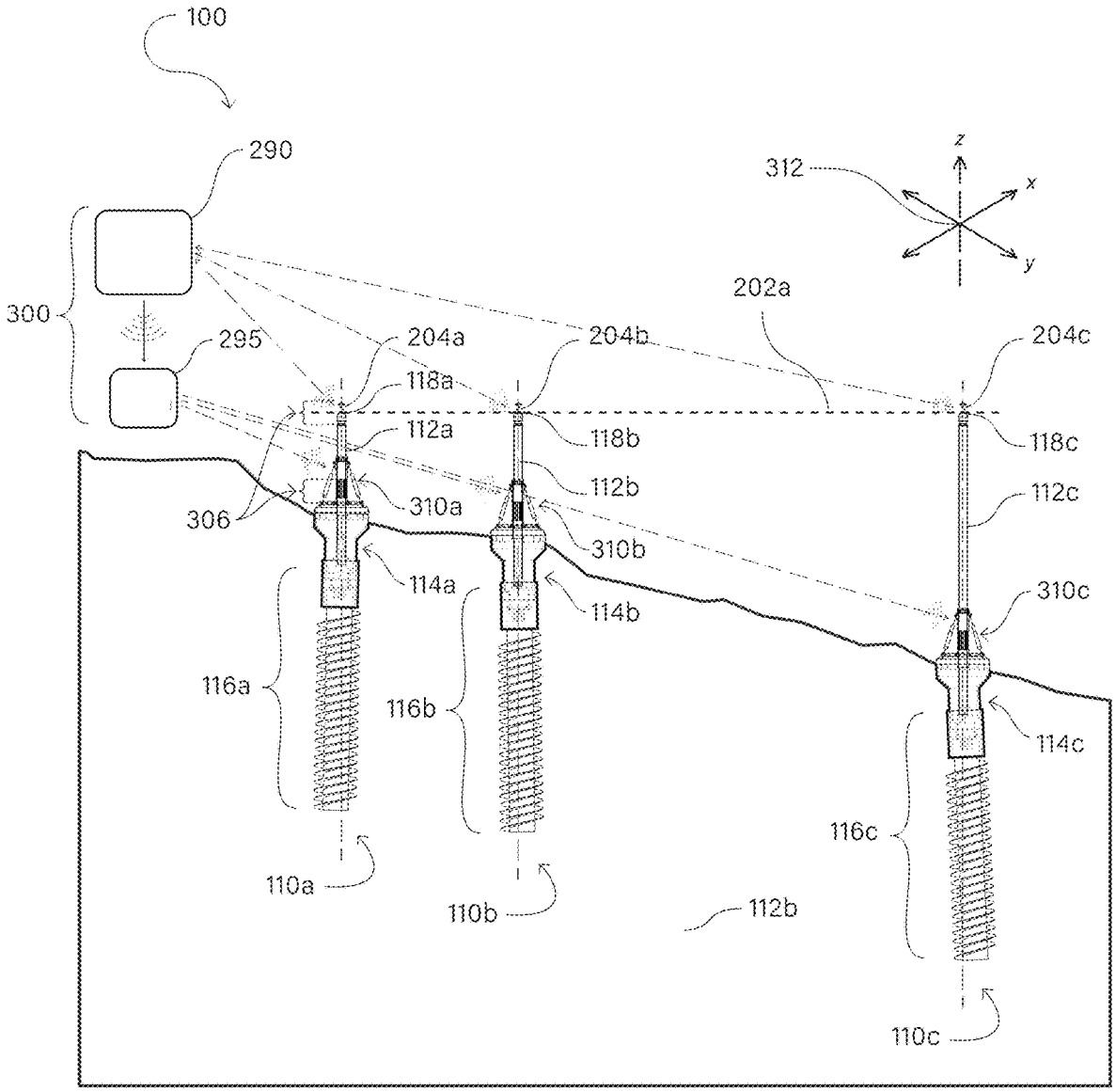
FIG. 5 is a diagram illustrating a cross-sectional view of aspects of the embodiment of a robotics-assisted foundation installation system of FIG. 3.

FIG. 5 is a diagram illustrating a cross-sectional view of aspects of the embodiment of the robotics-assisted foundation installation system 100 of FIG. 3. In FIG. 5, system 100 is shown to include a grid-solving system 300 which solves for the grid, e.g., plane 202*a*, 202*b*, 202*c*, and directs column positioning tools 310 to move column tips 118 to the target position. Grid-solving system 300, includes a location determining system 290 in communication with a grid control system 295 using protocols such as those discussed with reference to FIG. 23 and FIG. 24. Location determining system 290 determines the positions of column tips 118 using geolocation devices 204. Location determining system 290 provides that initial position information to grid control system 295, which is also in communication with and capable of controlling column positioning tools 310. Grid control system 295, with information regarding the range cone 308 and Z-axis range 306 for each foundation column 110, solves for the grid for plane 202*a*. Grid control system 295 then directs each column positioning tool 310 to move as required to position tips 118 at the target locations on the grid. In this instance, "solving for the grid" begins with grid control system 295 receiving a given target spacing grid (e.g., the grid arrangement needed to support structure 10) and the target common (or tiered) z level. In some installations, errors in the installation of the in-ground foundations may cause system 295 to have to solve for a best fit solution to the installation based on actual constraints, such as some column 112 bottoms not being able to be on grid because they contact the interior wall of upper coupler 122 before reaching the target location. Thus, system 295 may have to adjust the target positions of all the other columns to account for the constraint placed on the grid by one column. In such cases, a subroutine in the software of computer system 295 reviews the column angles after the grid is solved for, determines the most eccentric column, and determines the effect on the other columns of minimizing the eccentricity by distributing the offset across the remaining columns. If the effect of distributing the offset is acceptable, then the grid is solved for by distributing the offset of the most eccentric column across all the other columns of the system.

In some embodiments, location determining system 290 includes a total surveying system and geolocation devices 204 are reflectors used by the total surveying system to determine the location of the associated column tip 118. Such computer-controlled surveying systems are used by the construction industry and such systems may be used to provide the location data used by computer system 295. Generally, a total surveying station is an electronic, optical instrument that is used in surveying and building construction and combines an electronic theodolite with electronic distance measurement (EDM). The technology allows for the measurement of both vertical and horizontal angles and the distance from the instrument to a particular point. Traditionally a manual instrument, robotics have revolutionized the tool, making it more efficient than ever. Examples of total surveying systems include the Leica iCON iCB70 Manual Construction Total Station.

In some embodiments, inputs reporting on the X, Y, Z positions column tips 118, or the bottoms of columns 112, or both, are streamed from a total surveying station to an embodiment of control system 295. Control system 295 receives the live streamed data and associates it with a specific column—whether that be a single standalone column or multiple columns in an array. After solving for the grid, control system 295 can send instructions to any of the columns to adjust its position.

A benefit of a control system is that it is able to communicate with multiple columns in an array is the potential for "global optimization" of the array set, or rather an "action instruction" that is relational among all of the columns 110 in the array. The instruction may be that all, or some, of the columns must move as an ensemble an equal distance; or in the case in which one column has reached a limit of tolerance (such as meeting an edge constraint), then the set, in part or whole, can be instructed to move an equal distance to alleviate the collision conflict affecting the column that has reached its limit.

In such a control system, there is no inherent limit to the number of columns that may be managed. However, the number may be limited in a particular build iteration by the practical range of contemporary wireless communication and/or the processing power of the computer selected for use at the time of the build.

Figure 6:
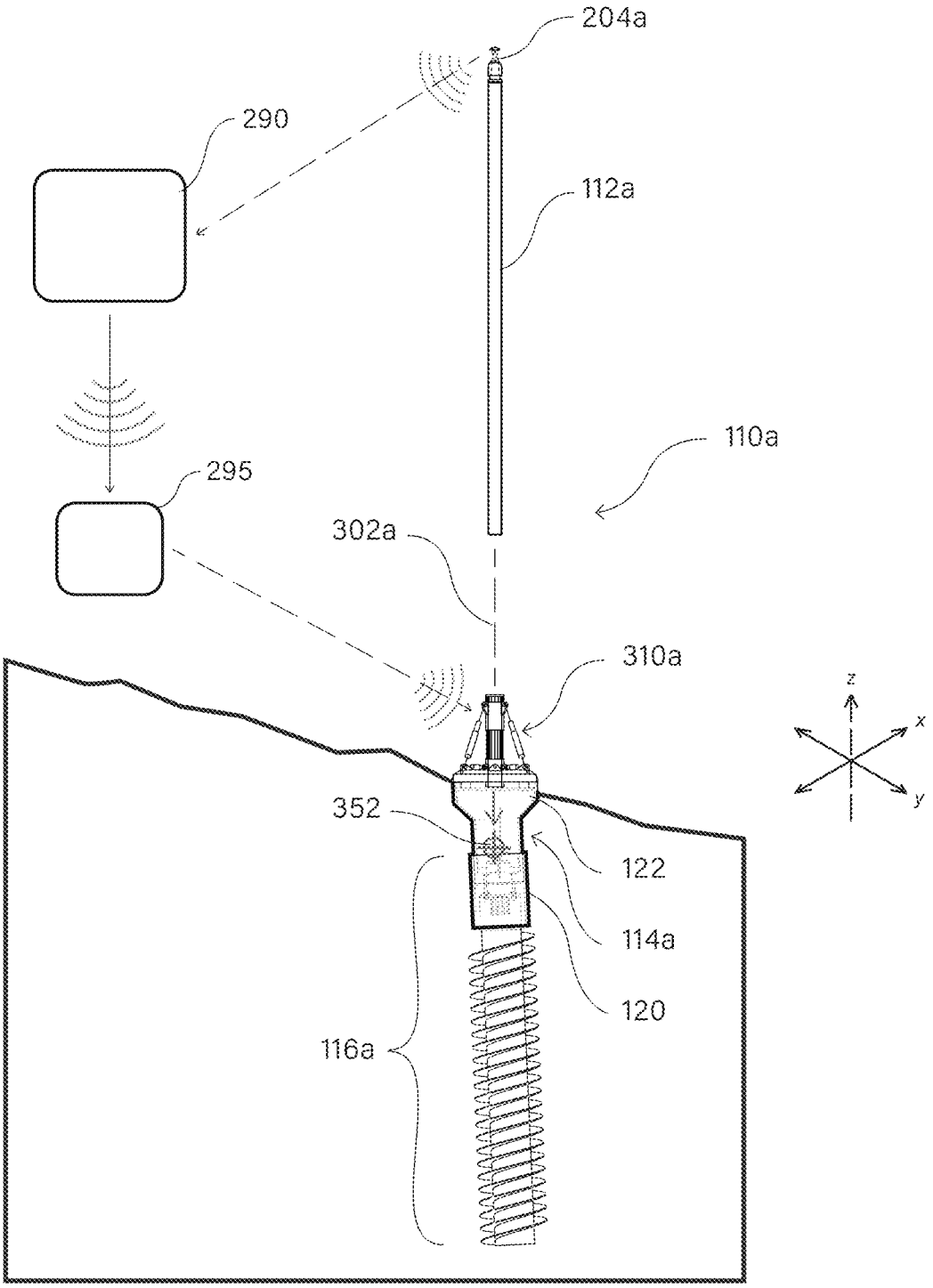
FIG. 6 is a diagram illustrating a cross-sectional view of aspects of the embodiment of a robotics-assisted foundation installation system of FIG. 3.

FIG. 6 is a diagram illustrating a cross-sectional view of aspects of the embodiment of the robotics-assisted foundation installation system 100 of FIG. 3. In FIG. 6, column positioning tool 310*a* is shown after being attached to coupler 114*a*, atop upper coupler 122. In FIG. 6, target point 304*a* indicates the position of the lower end of upper column 112*a* that results in upper column 112*a* having the desired vertical alignment. Target point 304*a* is determined before upper column 112*a* is inserted into positioning tool 310*a*. FIG. 6 also further illustrates that location determining system 290 determines the position of column tip 118*a* using geolocation device 204*a*. In an embodiment, device 204*a* is a reflector and location determining system 290 determines the location of column tip 118*a*, but in other embodiments device 204*a* may be a GPS device that provides the location of column tip 118*a* to location determining system 290, or that provides the location of column tip 118*a* directly to grid control system 295. In some embodiments, grid control system 295 communicates with Location determining system 290 and directs station 290 to re-determine the locations of column tips 118.

With this information regarding embodiments of the system, various aspects of embodiments may be discussed in more detail.

In an embodiment, a precision robotic positioner such as positioning tool 310 contemplates serial production. Therefore the robotic element, its fastening, locking and unfastening capabilities must be developed to be re-usable. Since the equipment will be deployed in a construction setting, the equipment should be robust and made of replaceable parts so that damaged elements may be swapped for new ones so that lifecycle investment in the equipment is justified.

Positioning tool 310 is a robotic device that is capable of locating both column tip 118, and the bottom of upper column 112 through a software interface and is capable of holding this desired position through the subsequent steps of grout pour and curing to realize a structure-bearing connection that unifies upper column 112 with in-ground foundation 116 and coupler 114. This is achieved through the use of positioning tool 310 within a broader integrated system (FIG. 5) which includes live-stream point surveying data from total surveying system 290, the interpretation of this live stream data by grid control system 295, the physical positioning response to this data of actual location relative to target location facilitated by column positioning tool 310 operating from a mediating coupler 114, including a coupling base 120 that is mechanically secured in-ground foundation 116. In-ground foundation 116 is one of several in-ground foundation variants installed largely by conventional means. Insofar as it is possible to precisely locate a column tip 118 and the associated bottom of column 112 in three-dimensional space, it is possible, through software, to control the positions of a broad array of columns, in unison, to realize a precision point-load column bed geometry (the grid of planes 202*a*, 202*b*, 202*c*) upon which to install, with precise bolt-hole alignment, off-site produced architectural elements that yield composite buildings of a variety of sizes, such as structure 10, and ground offsets, such as planes 202*a*, 202*b*, 202*c*, which are not necessarily limited to a single Z plane grid.

Figure 7:
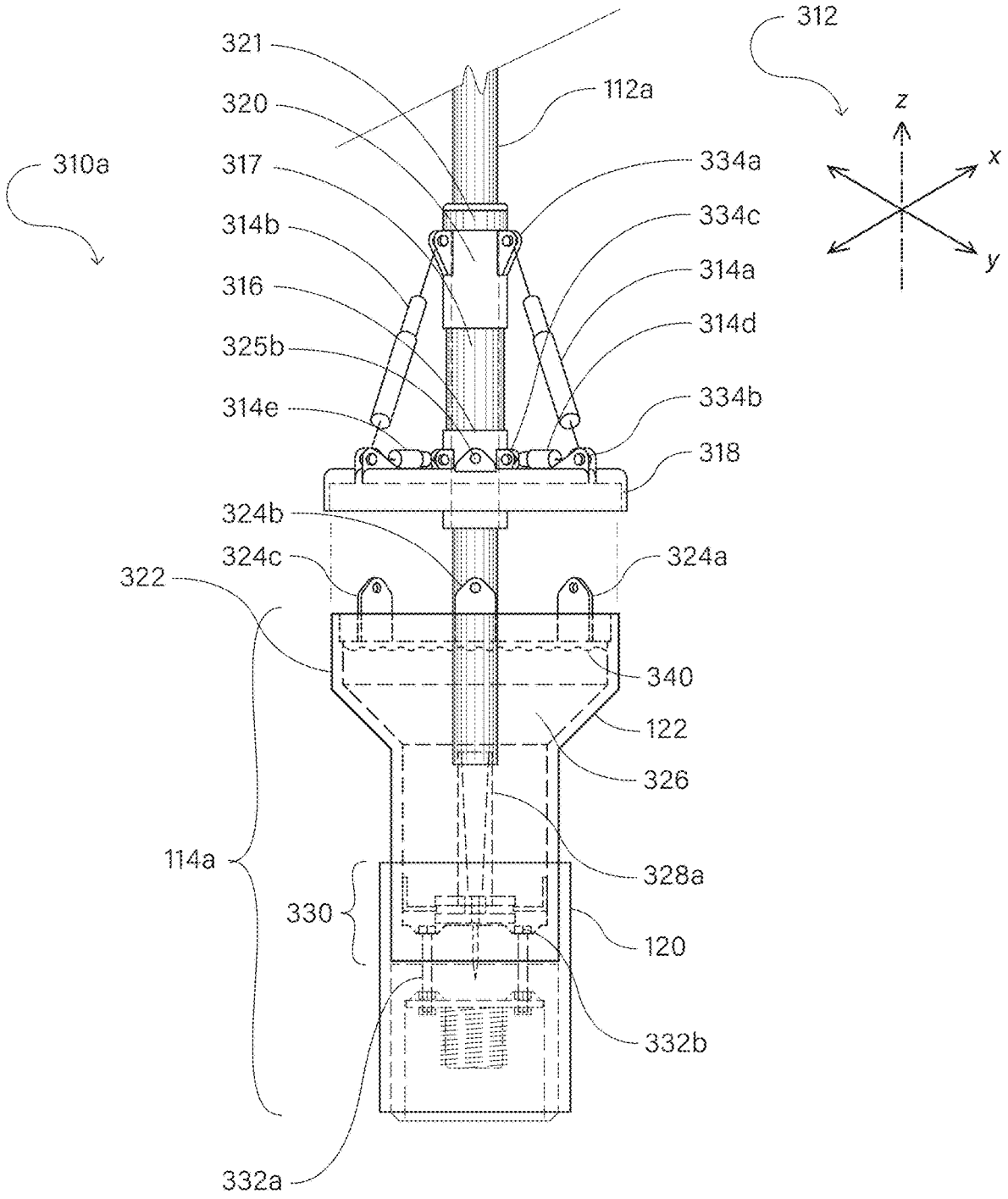
FIG. 7 is a diagram illustrating a cross-sectional view of aspects of the embodiment of a robotics-assisted foundation installation system of FIG. 3.

FIG. 7 is a diagram illustrating a cross-sectional view of aspects of the embodiment of a robotics-assisted foundation installation system 100 of FIG. 3. In FIG. 7, column positioning tool 310 is shown to includes actuators 314*a* . . . 314*c*, which connect between a column sleeve 320 and a tool ring base 318 at pivoting connection points 334. Column 112 passes through a column grip sleeve 321 and into and through a protective sleeve 317. Column grip sleeve 321 holds the column by compressive force so that the extension or retraction of actuators 314*a* . . . 314*c* is imputed to column 112. Movement of column 112 caused by the extension and retraction of actuators 314*a* . . . 314*c* is what causes upper column 112 to telescope with respect to coupler 114. During such telescoping movement, protective sleeve 317 travels freely in the vertical direction within a column sleeve 316. With column 112 held protected within the interior of sleeve 317 and separate from sleeve 316, actuators 314 may alter the Z axis position of the column 112 without friction between column 112 and any part of column positioning tool 310. Column sleeve 316 may be translated in the X, Y plane 312 by the extension or retractions of actuators 314*d* . . . 314*f*, which connect between tool ring base 318 and column sleeve 316 at pivoting connection points. An alignment tab 325 may be connected to a corresponding alignment tab 324 of upper coupler 122, when column alignment tool 310 is connected to coupler 114.

Coupler 114 includes upper coupler 122 and coupling base 120. Alignment tabs 324 are spaced about an upper coupler diameter 322, which is received within tool ring base 318. Upper coupler 122 is essentially hollow, defining a receptacle 326. A limiting range pin 328 is received within upper column 112 as column 112 is lowered through column positioning tool 310, which happens after tool 310 is attached to coupler 114.

A section 330 of upper coupler 122 is received within coupling base 120, with upper coupler 122 and coupling base 120 being connected using fasteners 332. Coupling base 120, and specifically the part of coupling base 120 below section 330, may be adapted to attach to different types of in-ground foundations. Thus, the use of different lower couplers, which are relatively simple devices, allows the use of the same upper coupler 122 and the same column positioning tool 310 without having to adapt upper coupler 122 or tool 310 to a different in-ground foundation. Thus coupler 114, by way of modifications to coupling base 120, may be adapted to attach to foundations, such as: pier and beam; helical piles (shown in FIG. 1); auger-cast piles; fiberglass composite pilings; precast concrete (shown in FIG. 2 and FIG. 12); pin pilings; and load-bearing retaining walls.

Thus, in embodiments, coupler 114 provides a purpose-designed grout receptacle 326 to achieve a structurally meaningful overlap (in vertical cross-section) of a precisely located upper column 112 within receptacle 326 such that a grout pour into receptacle 326 can structurally bind the precisely located upper column 112 to an in-ground foundation system 116. Coupler 114 is a system element that mediates between structure-supporting upper column 112 and in-ground foundation 116 below via coupling base 120. Coupler 114 is designed in such a way as to anticipate the mechanical attachment of column positioning tool 310, allowing for a grout pour 338 that does not interfere with positioning tool 310's performance and subsequently allows for the release and recovery of the same for future reuse once the grout has cured and the telescoping connection has been structurally perfected. Coupler 114 may be installed either entirely below finished grade, partially-below finished grade, or entirely above finished grade depending on the optimal scenario in which a structural connection may be perfected relative to site slope 20.

Figure 8:
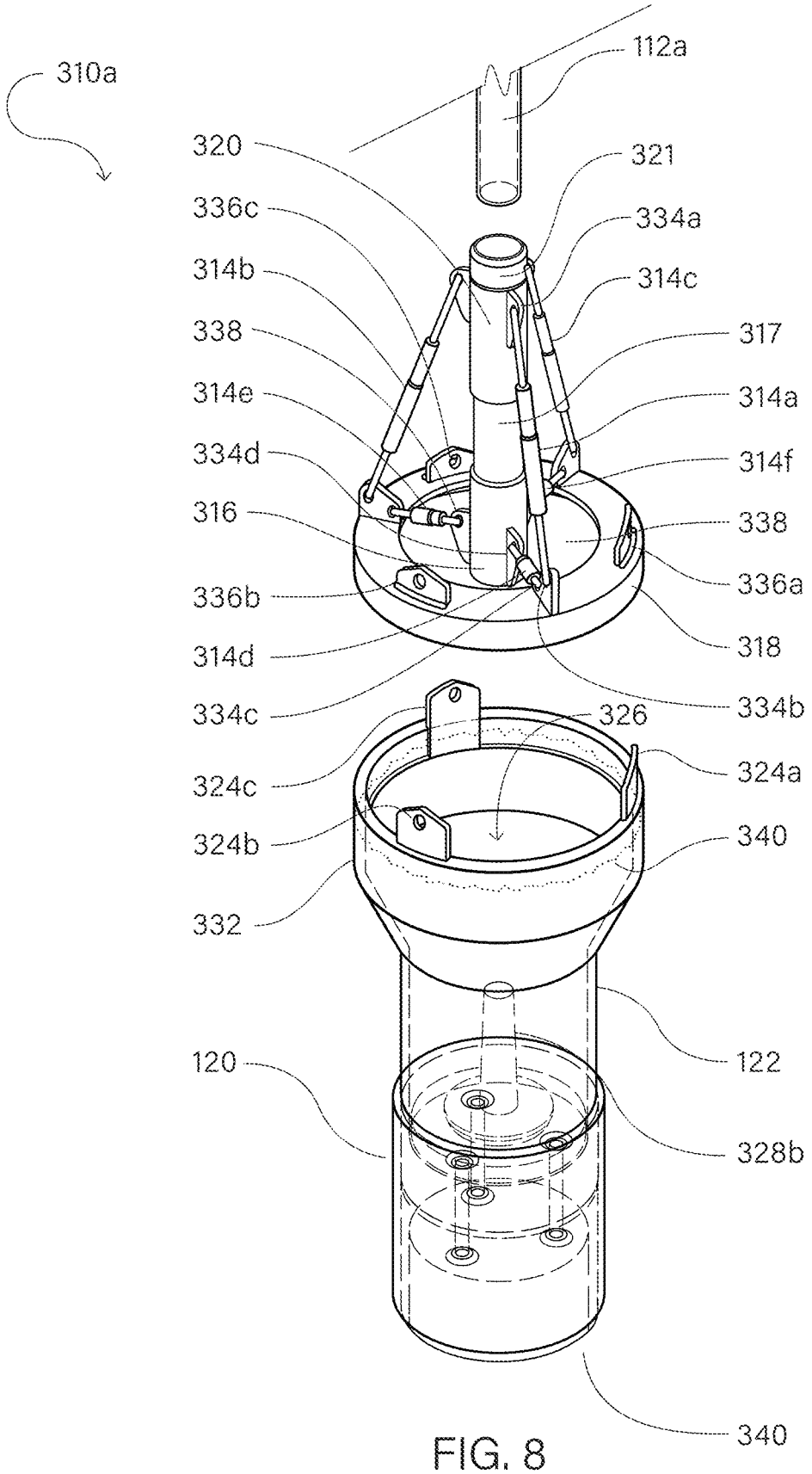
FIG. 8 is a perspective view illustrating aspects of the embodiment of a robotics-assisted foundation installation system of FIG. 3.

FIG. 8 is a perspective view illustrating aspects of the embodiment of the robotics-assisted foundation installation system 100 of FIG. 3. In FIG. 8, tool base ring 318 is shown to have tab slots 336 configured to admit tabs 324 from upper coupler 122. Between tool ring base 318 and column sleeve 316 an annular opening 338 provide for adding grout to receptacle 326 of upper coupler 122. An irregular line 340 indicates an approximate location of an upper grout fill line on upper coupler 122. Thus, the addition of grout to receptacle 326 of upper coupler 122 does not bind column positioning tool 310 to upper coupler 122 and tool 310 may be removed after the grout has set.

From FIG. 8 it can be further understood that column positioning tool 310 can precisely control the position of the X, Y, and Z points of both column top 118 and column bottom through a combination of tilting and translation by mechanical-robotic means employing upper actuator set

314*a* . . . 314*c* and lower actuator set 314*d* . . . 314*f*. With column 112 being gripped by column sleeve 320, upper actuators 314*a* . . . 314*c*, in controlling the position of column sleeve 320 in the X, Y, and Z directions, also control the height and tilt of column 112. Further translation of lower actuators 314*d* . . . 314*e* in the X and Y directions can work to change the angle of column 112 with respect to the vertical, either to bring column 112 closer to the vertical or to increase the lean.

Figure 9:
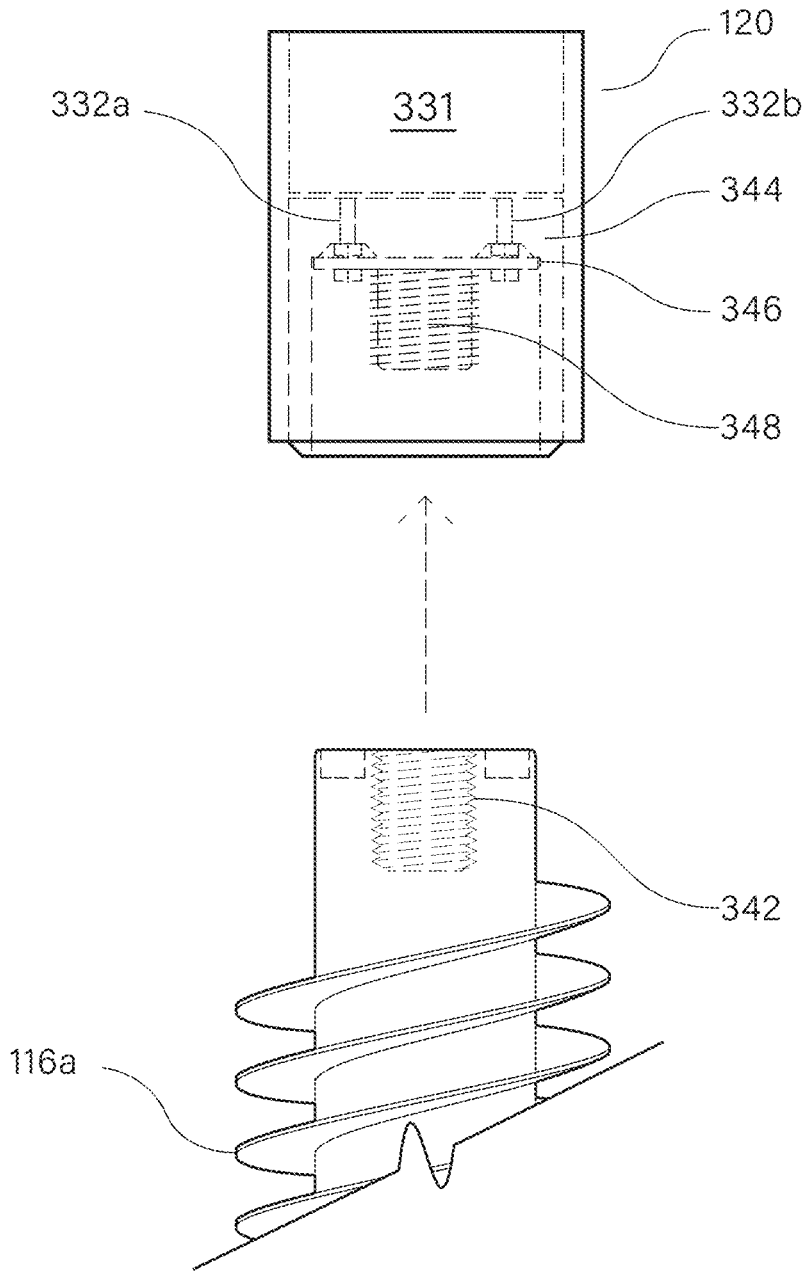
FIG. 9 is a diagram illustrating a cross-sectional view of aspects of the embodiment of a robotics-assisted foundation installation system of FIG. 3.

FIG. 9 is a diagram illustrating a cross-sectional view of aspects of the embodiment of a robotics-assisted foundation installation system 100 of FIG. 3. In FIG. 9, a receiving section 331 of coupling base 120 is configured to accept section 330 of upper coupler 122 and be fasted to upper couple 122 using fasteners 332. A pier cap 344 and a plate 346 including a threaded section 348 are fastened within coupling base. Pier cap 344 is configured to receive the top of in-ground foundation 116 and threaded section 348 is configured to mate with corresponding threads 342 in the top of in-ground foundation 116. Thus, for a different in-ground configuration, pier cap 344, plate 346, and threads 348 may be removed and replaced with elements adapted to connect coupling base 120 to the different in-ground configuration.

In embodiments, coupling base 120 is a purposed-designed element at the lower limit of coupler 114 that allows for upper coupler 122 to be attached to a variety of in-ground foundational elements such as, but not limited to: helical piers, pin foundations, drop-in precast foundations, concrete and/or composite piers, not to mention (but less frequently) stem wall, retaining wall and slab-on-grade connections. Each of these types of connections may be joined to the same version of upper coupler 122 with a version of coupling base 120 adapted to the specific type of connection.

Figure 10A:
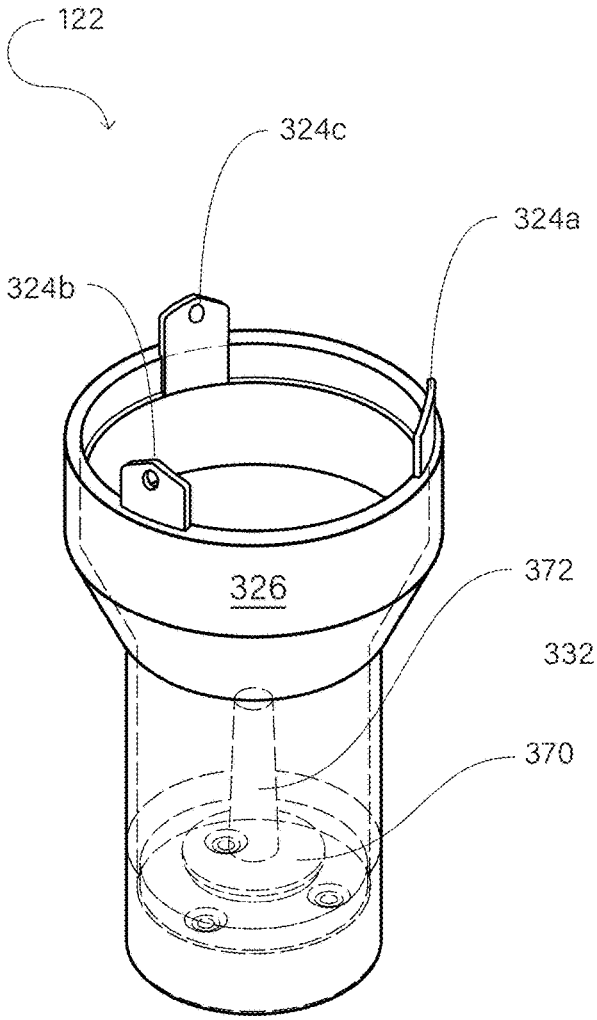
FIG. 10A is a perspective view illustrating aspects of the embodiment of a robotics-assisted foundation installation system of FIG. 3.

FIG. 10A is a perspective view illustrating aspects of the embodiment of a robotics-assisted foundation installation system of FIG. 3. In FIG. 10A, limiting range pin 328*a* is shown centered atop a range pin adjustment platter 350. The position of limiting range pin 328*a* at the base of receptacle 326 may be adjusted before the installation of upper column 112.

Figure 10B:
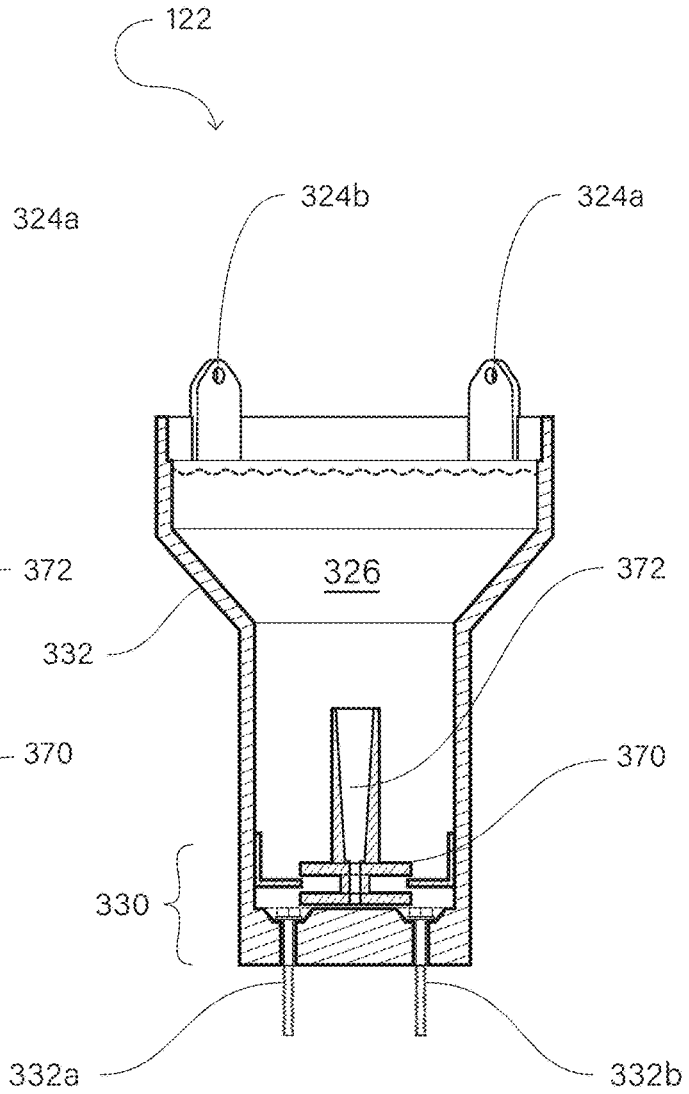
FIG. 10B is a diagram illustrating a cross-sectional view of aspects of the embodiment of a robotics-assisted foundation installation system of FIG. 3.

FIG. 10B is a diagram illustrating a cross-sectional view of aspects of upper coupler 122. In FIG. 10B, range pin adjustment platter 350 is shown to have an upper plate and a lower plate creating a groove there between. A circular bracket attached to the inner wall of coupler 122 includes a flange that extends into the groove, with the flange preventing the lower plate, and thus pin 328*a*, from being withdrawn from receptacle 326.

Regarding the use of system 200 and with regard to FIG. 2 and FIG. 5, generally, after preliminary site preparation and surveyed layout, a crew arrives on site 20 to install in-ground foundations 124 and bottom sleeves 126 of the telescoping column supports. This process is fairly conventional and may be executed swiftly as its obligation to deliver precision is reduced. This is because bottom telescoping column supports 126 are proportionately oversized relative to the upper supports 112.

Once lower portion pier foundations 124 have been installed and is properly cured and load tested, the next crew arrives with precision "total surveying" equipment, which is grid-solving system 300, including location determining system 290 and grid control system 295), robotics-assisted column positioning tools 310, and upper telescoping column supports 118. Column positioning tools 310 are installed atop each of lower column supports 126. Geolocation targets 204 (i.e., surveying reflectors when location determining system 290 is a total surveying station) are attached to mounting platforms on each of upper telescoping columns 112, and then these are sleeved into the receiving connection formed by the lower column 126 column positioning tools 310.

Each column positioning tool 310 is installed to make a temporary secure mechanical connection between upper telescoping column 112 and coupling base 126, and, therefore, in-ground foundation. Column positioning tools 310 may act in concert to position and hold structure-supporting columns 112 at their target X, Y, and Z locations through to completion of the grout cure period at which time each column positioning tool 310 may be removed for reuse elsewhere.

Through communication between location determining system 290 and grid control system 295 that results in updated location data being provided to grid control system 295, system 295 directs column positioning tools 310 to adjust the X, Y, and Z locations of each of upper columns 112, with location determining system 290 tracking the geolocation targets mounted to each receiving platform until system 200 solves for the intended column grid for plane 202*a*. In this instance, "solving for the grid" means physically positioning the column tips in the correct locations. Once grid is set, column positioning tools 310 are locked in position. This position will be held through the following steps with occasional position verification tests at key intervals.

The next crew will arrive onsite to pour structural grout into hollow column cavities of lower telescoping columns 126 to mechanically unify lower columns 126 and upper telescoping columns 112 into fixed and permanent positions. Once the structural grout has cured, column positioning tools 310 and the geolocation targets 204 may be removed. The lower completed structure is now ready to receive the pre-fabricated structure, frame or element intended for the site, e.g., structure 10.

Thus, the use of column positioning tools 310 and grid-solving system 300 allows column tips 118 to be positioned at machine-tolerance for joining structure 10, even though lower supports 126 and in-ground foundation 124 are executed at conventional onsite construction tolerance.

In an embodiment, grid-solving system 300 is able to perform simultaneous localization and mapping by combining the capabilities of location determining system 290, such as a total surveying system in an embodiment, with control system 295. The location determining system 290 is the source of data for grid-solving system 300 from which: 1) a grid pattern is established for all piers, e.g., foundation columns 110); 2) an initial fixed point of reckoning is positioned in relationship to a digital model; and 3) the actual location of all piers is determined. When system 290 is a total survey system, it uses a laser surveying system and reflectors to develop the data. Control system 295, with data from location determining system 290 performs the localization of the piers and columns to their proper locations by: 1) positioning of an initial fixed point of reckoning in relationship to the earth; 2) using the true data—the actual starting positionings of all pier tops in relation to the initial fixed earth-reference point, one another, and the actual site—derived by location system 290, determining the required movement of each upper column 112 in, e.g., X, Y, Z directions, necessary to precisely align column tips 118 with a target grid upon, e.g., plane 202*a*; and optionally 3) in an embodiment, control system 295 may allow the upper columns 112 of the entire fixed model to have the circular freedom (system tolerance) to find a best possible fit for the entire pier system. Having determined the required movement, grid control system 295 directs column positioning tools, such as column positioning tool 310, 402, or 502, one tool associated with each pier, to cause upper columns 112 to move in concert, each in the direction necessary for that specific pier, so that the resulting positions of column tips 118 precisely align with the desired pier model. In embodiments, column positioning tool may have different degrees of freedom. For example, column positioning tool 310 has five degrees of freedom (3 translational, 2 rotational), column positioning tool 402 has three degrees of freedom (1 translational, 2 rotational), and column positioning tool three degrees of freedom (3 translational). Upon attaining the precisely aligned orientations, the column positioning tool preferably has the ability to maintain the column in that position while the upper column is being fixed in place, which may take 96 hours for some types of grout. During the hardening time, the locations of column tips 118 may be periodically measured and adjusted if necessary.

Still regarding FIG. 2, in an embodiment, a column positioning tool, such as any of tools 310, 402, 502 may be attached to lower telescoping column 126, with adaptation made in case column 126 is, e.g., a square profile HSS section. Column 126, may be a vertically-oriented structural column that has been adapted to accept a column positioning tool by having an upper section simply cut off. In such a case, the mounting of the column positioning tool on column 126 will retain the tool both by gravity, with the tool resting on the cut wall of the column, and mechanically, through some manner of fastening, e.g., bolts that are placed into precision cut holes in column 126 and used to secure the tool at a base ring, such as base ring 318, 406, or 516. In embodiments, a standoff, such as standoff 532 (FIG. 18B), may be configured to connect to the column (of any configuration) at one end, and the tool (of any configuration) at the other. Even then, the manner of fastening may not result in a level base for the column positioning tool, therefore neither its calibration nor its operation should depend on level mounting, and moreover, the column positioning tools 310, 402, and 502, in some embodiments, are able to read a deviation from level and correct for it in its manipulation of the upper telescoping column.

Similarly, upper telescoping column 112 may be a smaller overall dimension square profile HHS section relative to the bottom. The sole connection to this element will be by mechanical fastening into precision cut holes at precise and predetermined locations. In order to gain the most control over the manipulation of upper column 112 relative to coupler 114, mechanical connection may be required at two positions of offset height, e.g., upper actuator set 314*a* . . . 314*c* and lower actuator set 314*d* . . . 314*f*, as a function of estimated rotational forces possible as a function of overall height and weight of the upper element of the telescoping assembly.

In an embodiment, column positioning tool 310 is preferably of a weight and scale appropriate to its desired functionality and is preferably able to be manipulated, installed and uninstalled by optimally one, but a maximum of two, skilled laborers.

Still regarding FIG. 2, an embodiment of a method for installing a foundation may include the following steps. Step 1) a digital model is constructed that provides a determined target grid matrix. Step 2) a digital site mapping is performed of the topography of the build site, whether altered or unaltered to receive construction. Step 3) traditional pier foundations are placed by means of either concrete/aggregate/rebar or by driven helical pier installation (e.g., in-ground foundations 116, 124). Step 4) once foundation bases are set, using geolocation reflectors 204 on the top of each column base, a market available surveying total station 295 (robotic laser surveying system) will be used to identify the location and any tolerance variance between bases relative to the target grid matrix identified in Step 1. This process relies on software whose performance is characterized as a Simultaneous localization and mapping (SLAM) coordination of sensor stack, whose definition is: the computational problem of constructing or updating a map of an unknown environment while simultaneously keeping track of an agent's location within it. Step 5) the locations of the as-build lower foundations are examined. If the outcome is that the as-built lower foundations conform to tolerance requirements of target grid matrix identified in Step 1, then the foundation placement process will proceed. If not, faulty foundations will be identified for replacement. Step 6) the positioning of an initial fixed point of reckoning will be determined (this will be the reference point creating the initial direct relationship to the digital construction model). Step 7) Computer system 295 will direct column positioning tools 310 to the positioning of the entire foundation target grid matrix providing the entire system for best fit ("solving for grid matrix") within a predetermined level of system tolerance. Step 8) Upper columns 112 topped with surveying reflectors 204 will be placed within tops of the established lower columns 124—each upper column 112 supported by a column positioning tool 310. Step 9) location determining system 290 will be used to identify the definition of the actual locations of all upper columns 112 determined by the siting of reflectors 204 on the top of each column 112 (which is where structure 10 will be later attached). Step 9 provides the data critical to understanding the current location of all columns 112 in relation to one another and in relation to the anticipated optimized target grid matrix. Step 10) grid control system 295 directs column positioning tools 310 to mobilize upper columns 112 to reposition them in X, Y, Z locations that align column tips 118 with one another to precisely align with the desired pier grid matrix model. Step 11) column positioning tools 310 lock upper columns 112 in position for, e.g., 72+ hours after structural grout has been applied. Step 12) column positioning tools 310 may be decoupled, removed, and packaged for return to storage between deployments.

Figure 11A:
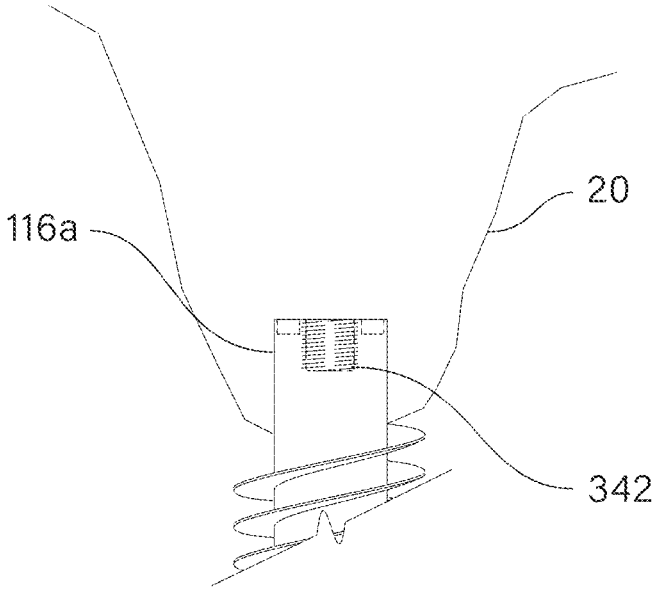
FIG. 11A-FIG. K are diagrams illustrating cross-sectional views of aspects of the embodiment of a robotics-assisted foundation installation system of FIG. 3 during different steps in a method of using the system.
Figure 11B:
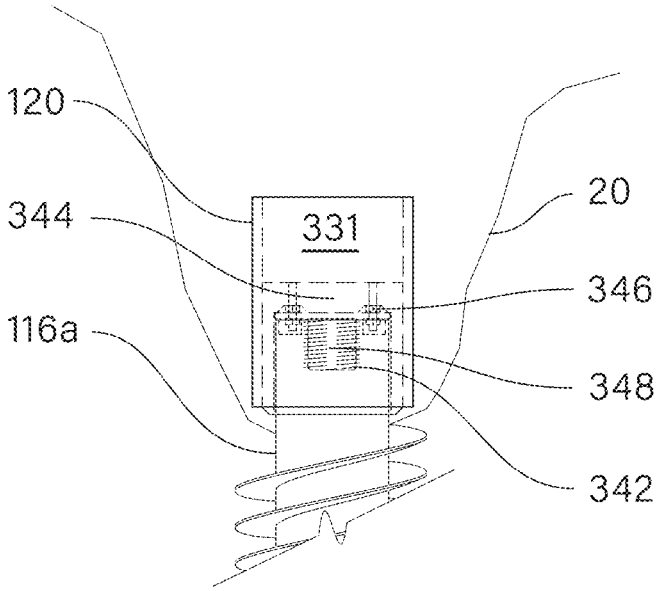
Figure 11C:
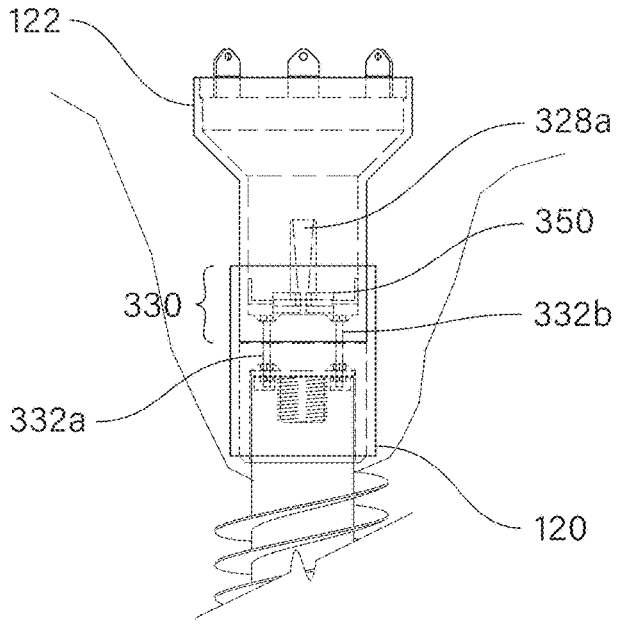
Figure 11D:
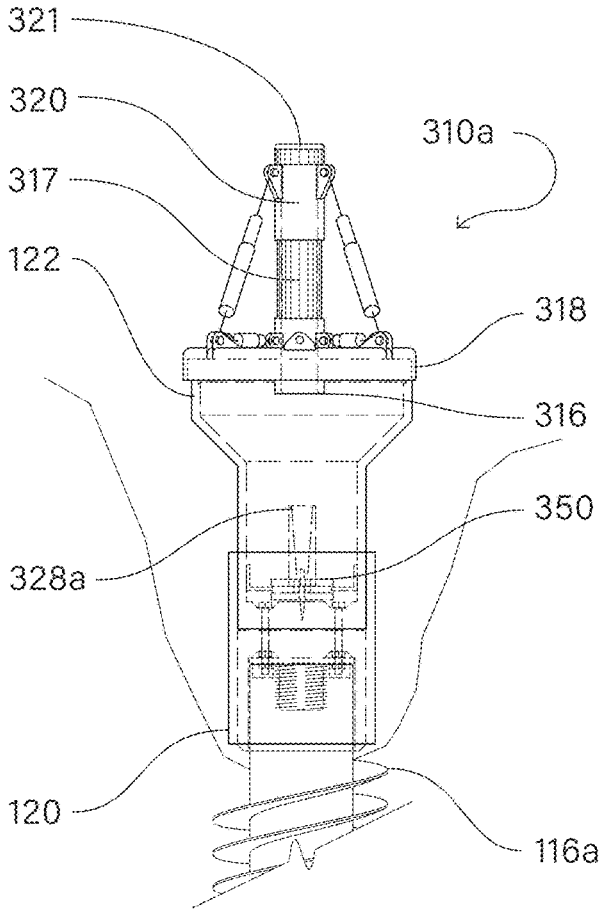
Figure 11E:
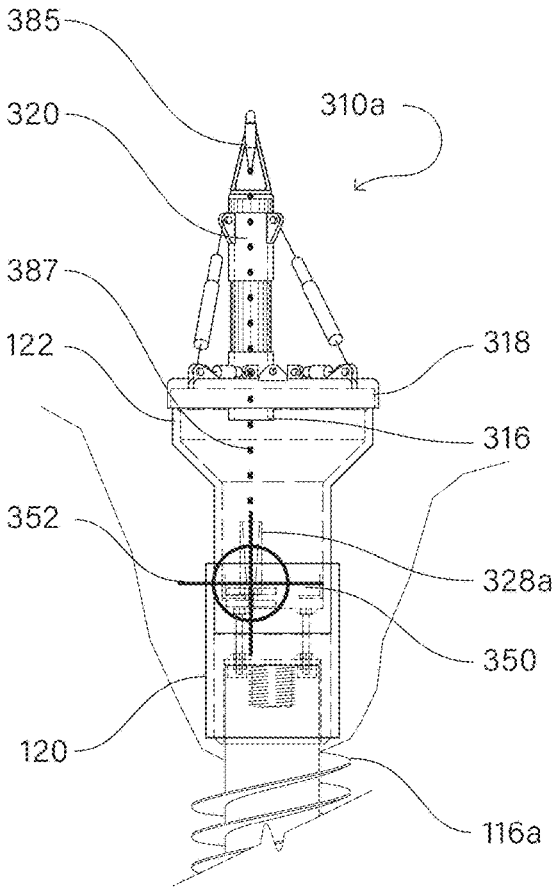

FIG. 11A-FIG. 11K are diagrams illustrating cross-sectional views of aspects of the embodiment of a robotics-assisted foundation installation system of FIG. 3 during different steps in a method of using system 100. In particular, FIG. 11A-FIG. 11K illustrate steps involved in the use and re-use of a column positioning tool, with column positioning tool 310 being used in this example. In FIG. 11A, site 20 has been prepared by installing in ground foundations. In ground foundation 116*a* is used as an example in this discussion and should be understood to represent a plurality of in ground foundations distributed within site 20. In FIG. 11B, coupling base 120 is attached to foundation 116*a* screwing threaded section 348 into tapped hole 342. In FIG. 11C, upper coupler 122 is inserted into section 331 of coupling base 120 and fixed in place using fasteners 332. In FIG. 11D, column positioning tool 310 is lowered onto upper coupler 122, with tool ring base 318 fitting over upper diameter 322. Tool 310 is secured to coupler 122 by bolting together tabs 324 (FIG. 11C) and 325. In FIG. 11E, column positioning tool 310 is directed by grid-solving system 300 to position column sleeve 320 in a location directly beneath, or as close to directly beneath, an estimated target location on a plane (e.g., plane 202*a*). In FIG. 11E, a laser sight 385 is placed atop column sleeve 320 and, using beam 387, pin adjustment platter 350 is moved so that limiting range pin 328 attains a target pin location 354. In FIG. 11E, sleeve 320 is oriented toward the bottom upper coupler 122 as though it were sighting were the bottom of column 122 needs to be. That is how laser pointer 385 correctly marks the target position of column at bottom for limiting pin 328*a*. Note that this all looks neat and vertically aligned in FIG. 11E, but if upper coupler 122 were crooked relative to a target column axis because the top of in-ground foundation was crooked then sleeve 320 (all of the movable portion of 310*a* in fact) would reorganize to make sleeve 320 plumb. A fastener 373 (FIG. 12) may at this time be used to fix platter 350 in place with respect to the bottom of upper coupler 122. The fastener may be a "nail" such as that produced by a Hilti gun.

Figure 11F:
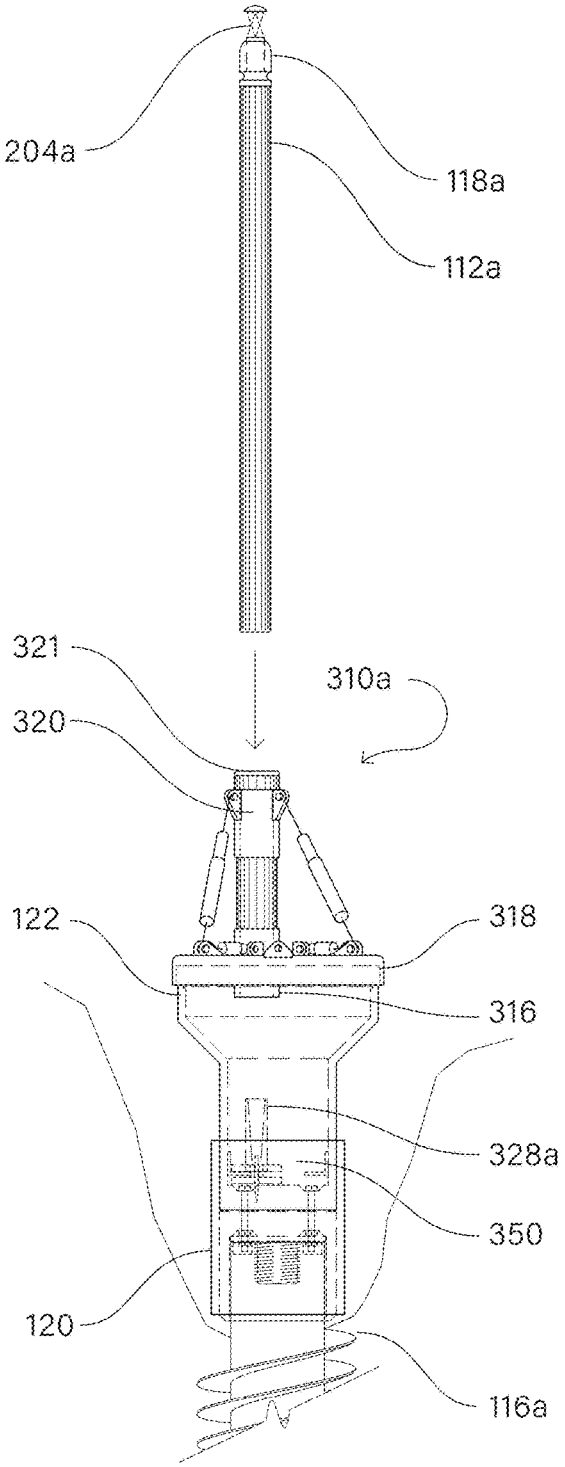
Figure 11G:
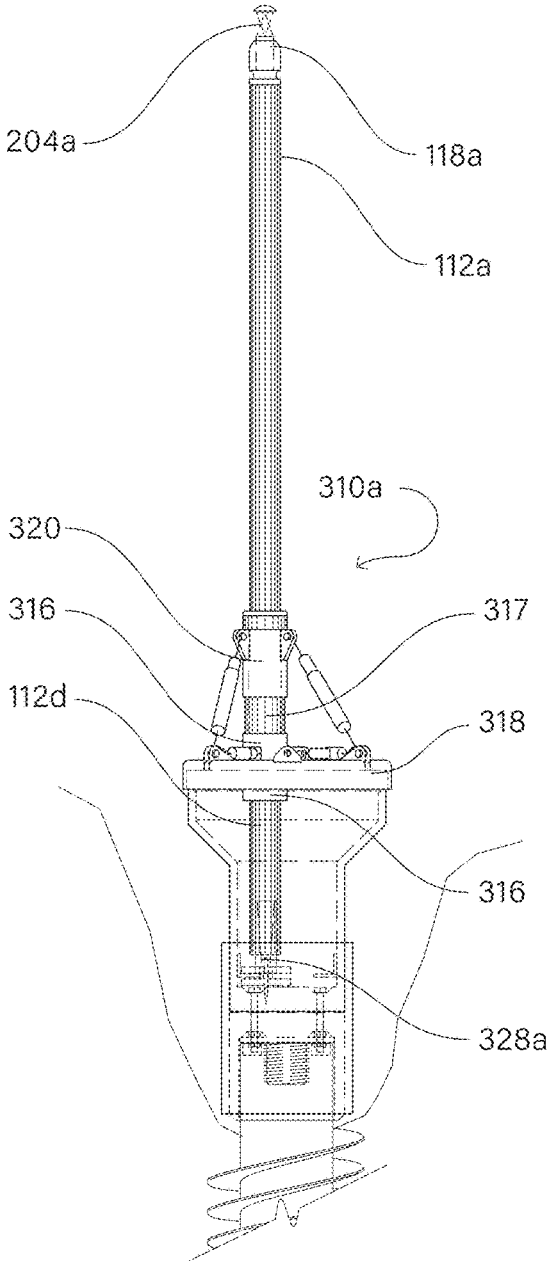
Figure 11H:
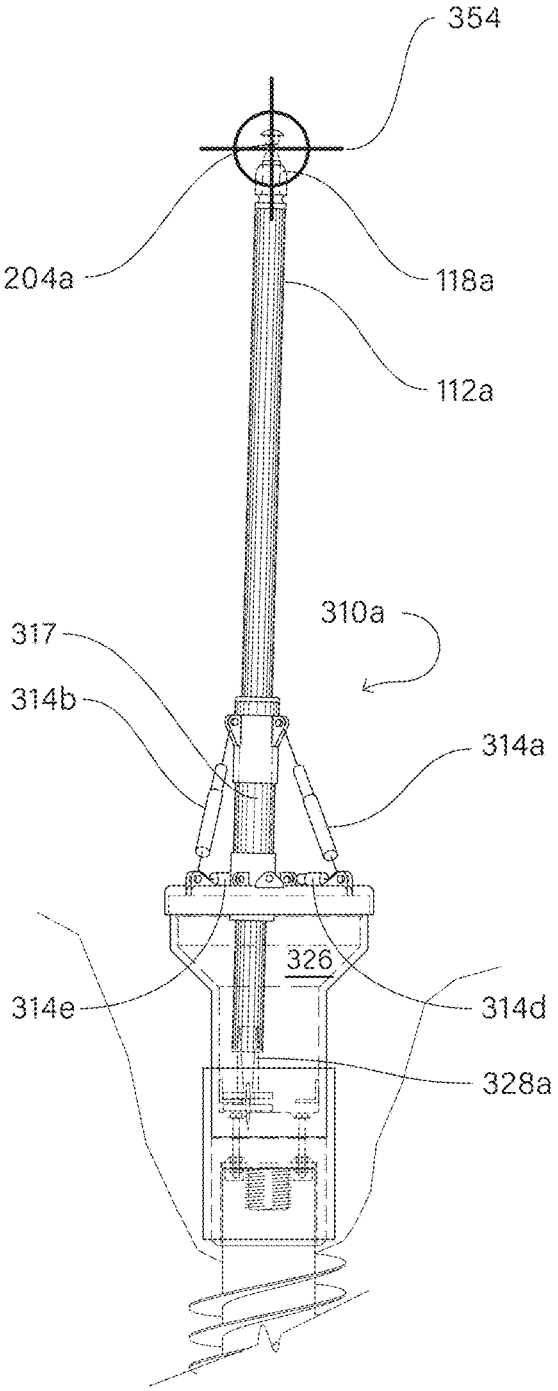
Figure 11I:
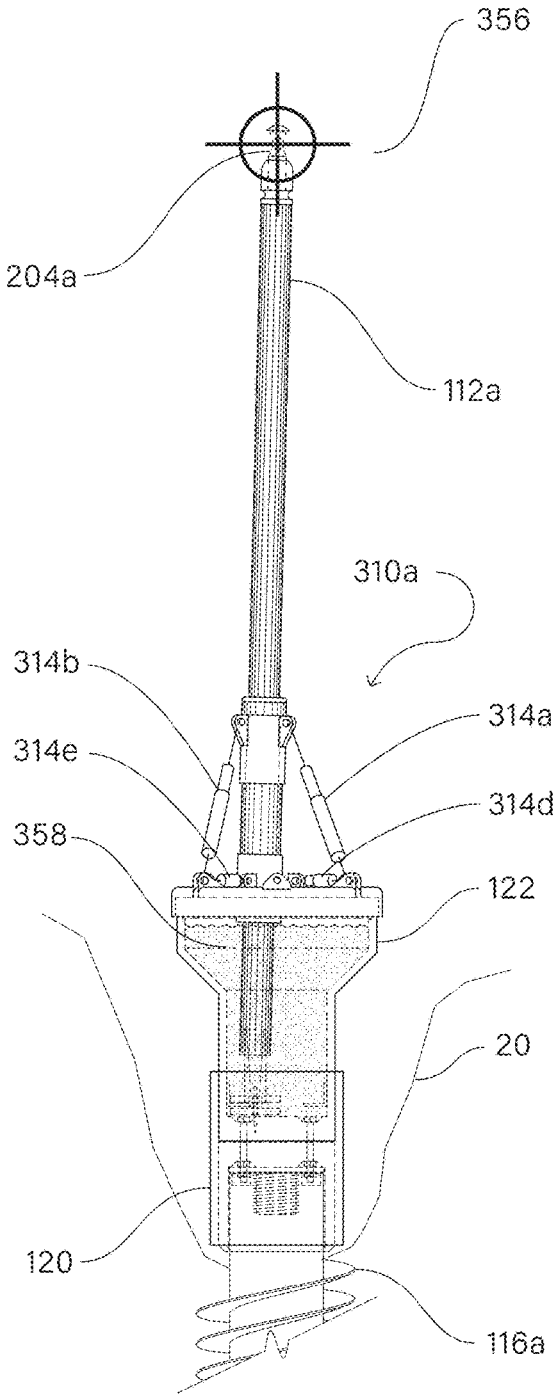
Figure 11J:
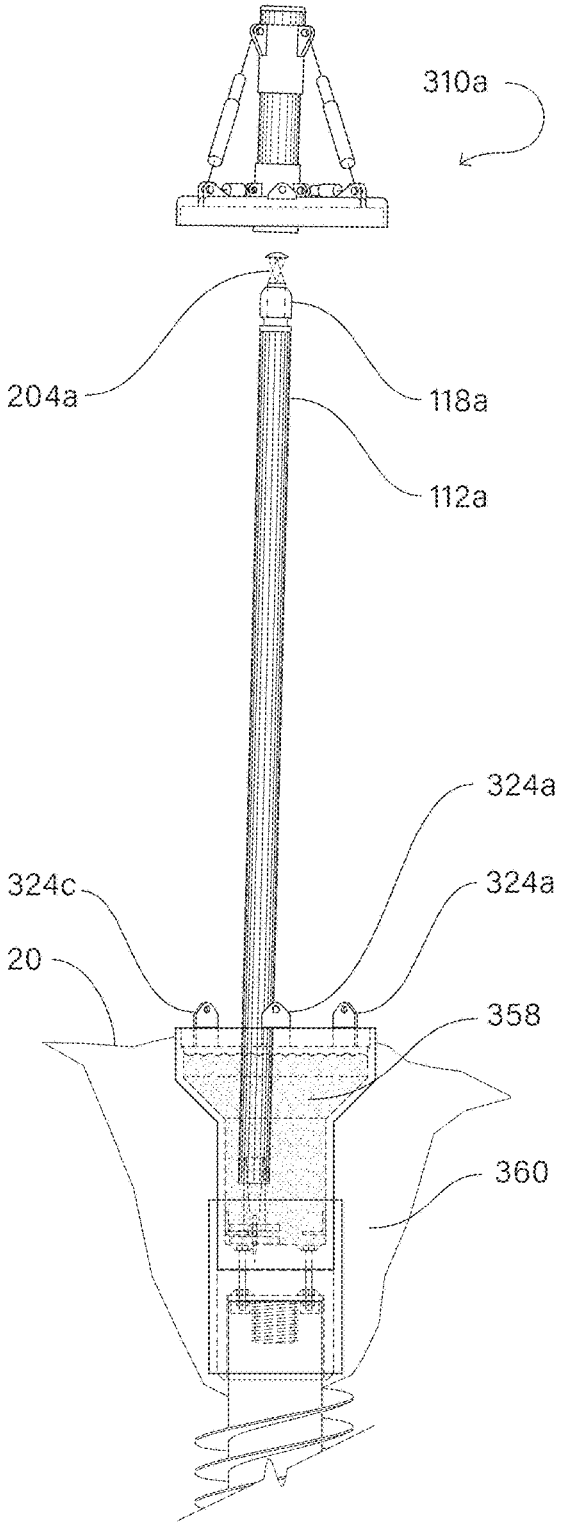
Figure 11K:
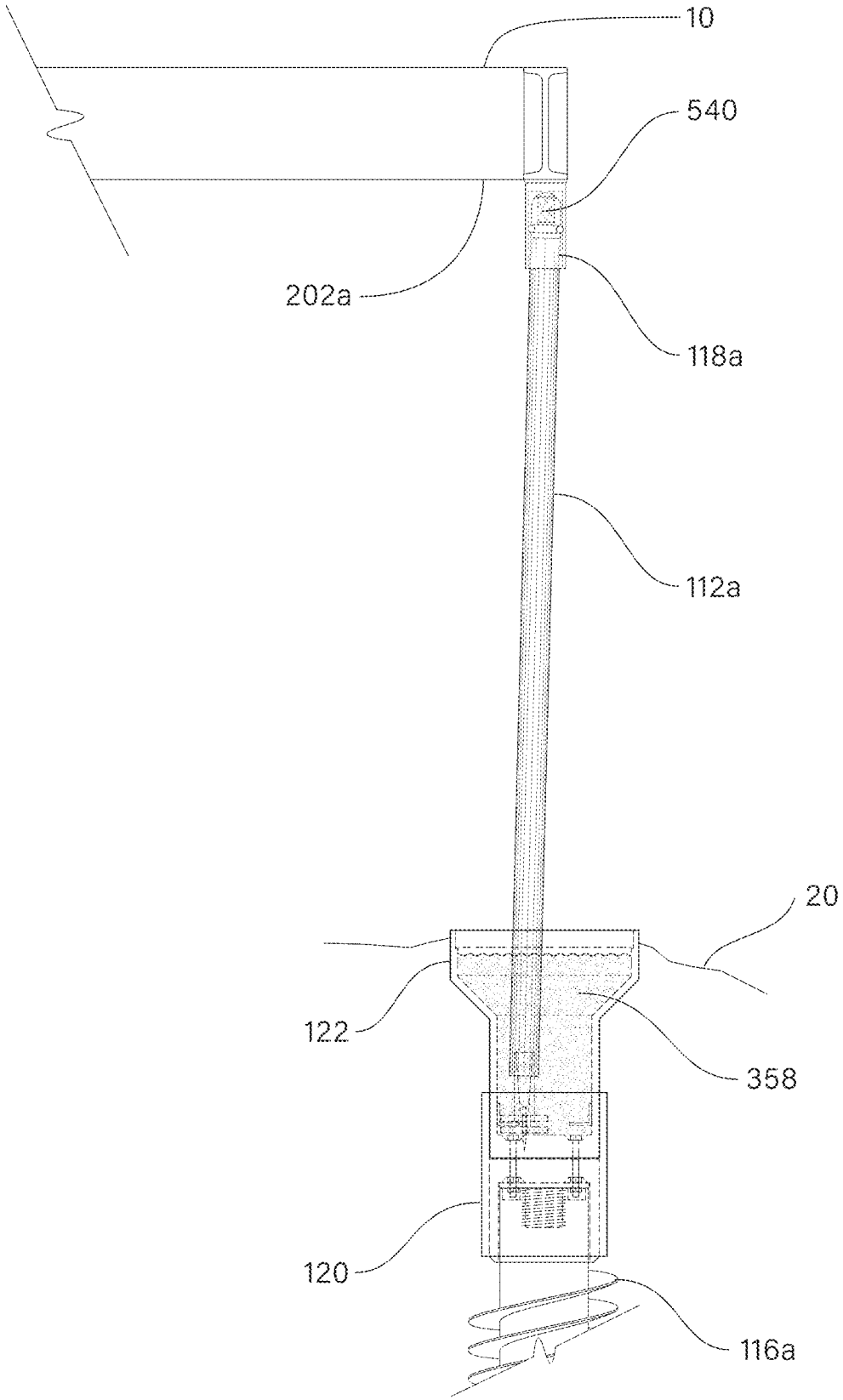

In FIG. 11F, upper telescoping column 112 is lowered into column grip sleeve 321. In FIG. 11G, telescoping column 112 is lowered until limiting range pin 328 is received within the lower end of telescoping column 112 and column tip 118 is at height that is estimated to be near the target location. Column sleeve 320 is tightened at this time. A clamping apparatus is not shown, but may include known clamping apparatuses, e.g., one or more bolts being threaded through sleeve 320 and against column 112 within. After all columns 112 for the plurality have been installed, for each column, grid-solving system 300 determines the position of each column tip. In this example, location determining system 290 is a total surveying station that uses reflectors 204 to determine column positions. With the position determined for each column tip 118, grid control system 295 receives the position data and, given a grid pattern needed by structure 10, solves for the grid by computing a plane and, for each column tip of the plurality, a target X, Y, Z location on that plane that is both: 1) in a precise position on the given grid; and within range of the column tip, given the range of motion of the associated column positioning tool. Grid control system 295 then directs each column position tool 310, in this case actuators 314*a* . . . 314*f*, to move the associated column tip to the target X, Y, Z position. This may not require that all column tips 118 be moved, since some column tips may be properly located. In FIG. 11H, computer system 295 directs location determining system 290 to re-measure the positions of column tips 118, or the subset of column tips 118 that had been moved. A target 354 indicates for purposes of this discussion (target 354 does not appear in actual use) that column tip 118*a* is at the target X, Y, Z location. Note that column 112*a*, in being moved from the position of FIG. 11G to that of FIG. 11H, has been raised (as shown by the addition section of retaining pin 328*a* that is visible) and has been tilted, to the right from this point of view and possibly also into or out of the plane of the page, which would be possible given the three degrees of freedom of motion provided by column positioning tool 310. The process of: 1) measure column tip locations, 2) determine column tip position errors, 3) direct column tip repositioning, and 4) re-measuring, is repeated until all column tips are within a given, predetermined tolerance of the target X, Y, Z location. In FIG. 11I, grout 358 has been poured through column positioning tool 310 into upper coupler 122. While grout 358 is hardening, the process of 1) measure column tip locations, 2) determine column tip position errors, 3) direct column tip repositioning, and 4) re-measuring may be continued. In some embodiments, the frequency of the performance of this process after grout or other hardening material has been performed may be decreased in comparison to that as described with reference to FIG. 11H. In FIG. 11I, a target 356 indicates for purposes of this discussion (target 356 does not appear in actual use) that column tip 118*a* is at the target X, Y, Z location after the grout has hardened. In FIG. 11J, positioning tool 310 is removed from upper coupler 122 and telescoping column 122, leaving upper coupler 122 in place. Site 20 is improved with the addition of fill 360. In FIG. 11K, structure 10 is situated atop columns 112. As a result of using system 100, each column tip 118 is at the height of plane 202*a* and located on that plane within a Z tolerance and at an X, Y position that is within an X, Y tolerance required for the positioning of structure 10. In an embodiment, a column cap 540 (FIG. 19A) may be placed over column tip 118 causing geolocation device 204 to recede into a recess within column cap 540. Column cap 540 may be an integral part of structure 10 or may be an element to which structure 10 is later attached.

FIG. 11F-FIG. 11K illustrate the use of a column cap 540 (FIG. 19A, FIG. 19B) with a prism 546 as reflector 204, which, because it collapses into the column cap 540, may be left in place when structure 10 is added atop column 112. In other embodiments, reflectors 204 would be removed before the addition of structure 10.

Figure 12:
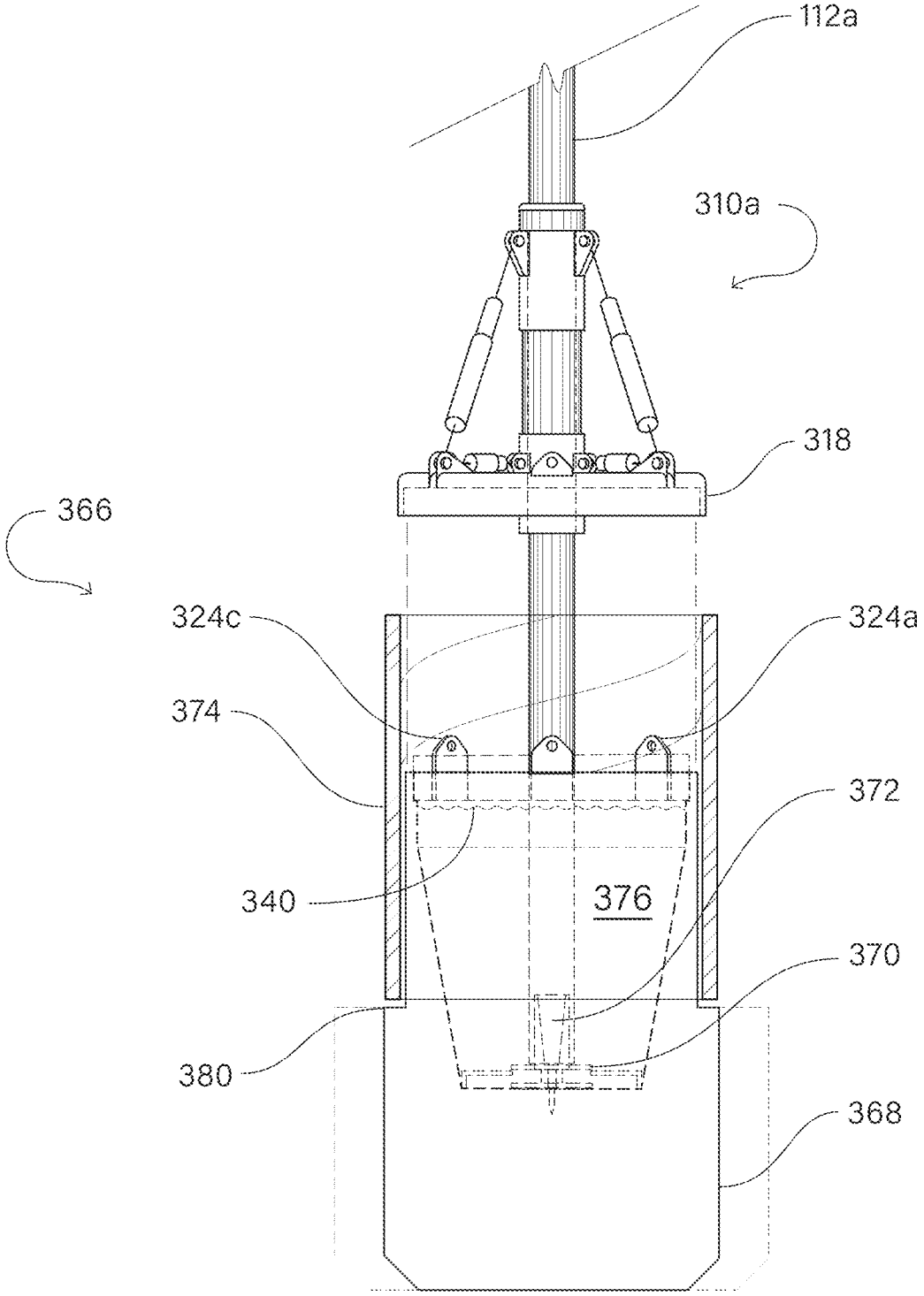
FIG. 12 is a diagram illustrating a cross-sectional view of aspects of an embodiment of a robotics-assisted foundation installation system.

FIG. 12 is a diagram illustrating a cross-sectional view of aspects of an embodiment of a robotics-assisted foundation installation system. In FIG. 12 an in-ground foundation 366 may be suitable for instances in which a total build does not require deep in-ground foundations. In-ground foundation 366 is a variant of coupler 114. With in-ground foundation 366, a pre-cast element 368 creates a receptable 376. Foundation 366 includes alignment tabs 324. When column positioning tool 310 is lowered down and receives foundation 366 into base ring 318, tabs 324 may be joined with tabs 325 of tool 31, as may be done with coupler 114. Foundation 366 further includes a limiting range pin 372 and a pin adjustment platter 370, which are analogous to limiting range pin 328 and pin adjustment platter 350 of upper coupler 122. An optional cylindrical form 374 may be placed about foundation 366 and supported by a ledge 380. When column positioning tool 310 is connected to foundation 366, cylindrical form 374 extends a distance above base ring 318, which helps prevent loose soil or rocks from falling into grout receptacle 376. Any material other than structural grout in receptacle 376 would diminish the strength of the connection. The discussion of the placement and use of column positioning tool 310 atop upper coupler 122 of FIG. 11D-FIG. 11K applies equally to the placement and use of column positioning tool 310 atop in-ground foundation 366.

Figure 13:
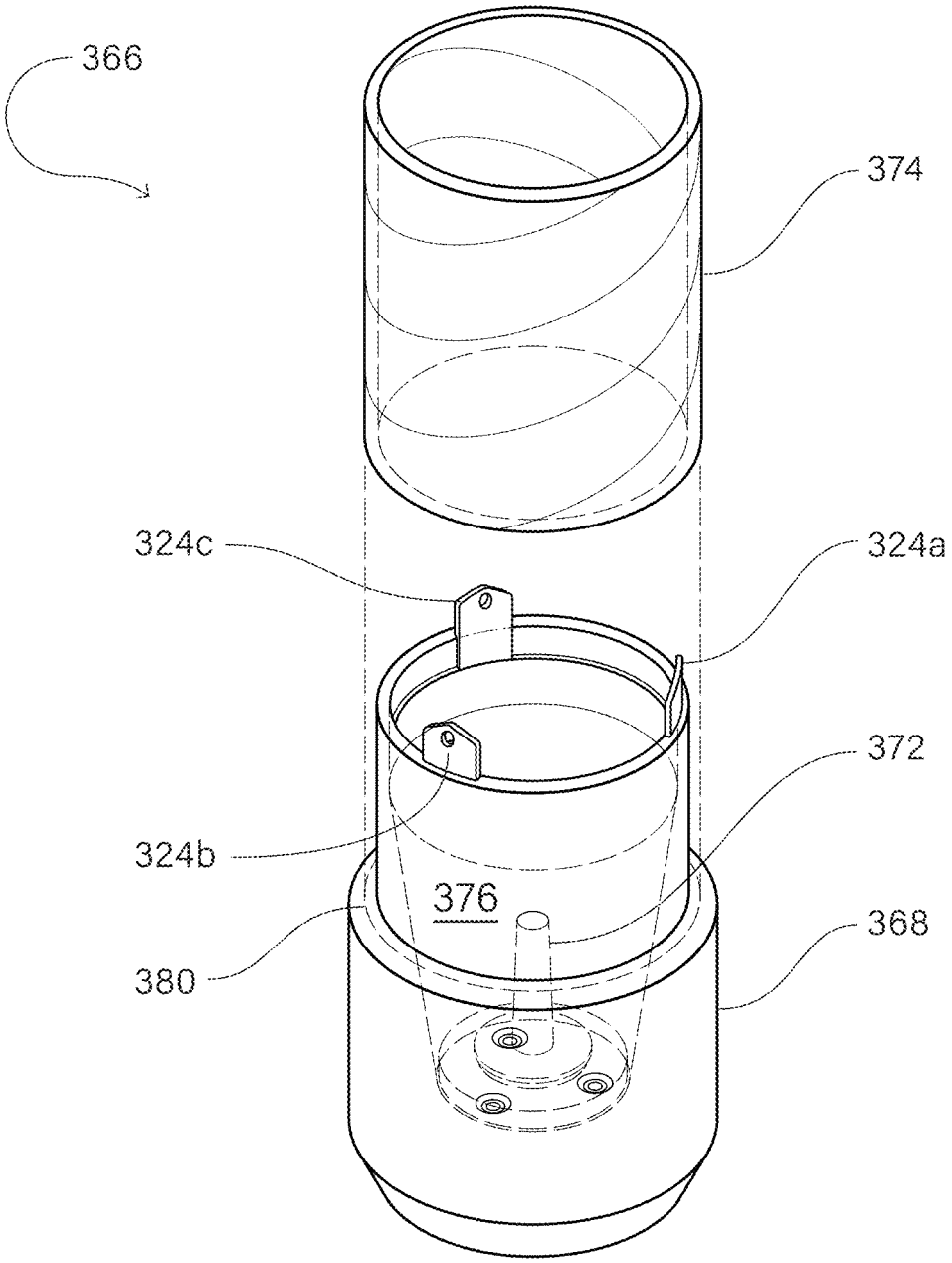
FIG. 13 is a perspective view illustrating aspects of the embodiment of the robotics-assisted foundation installation system of FIG. 12.
Figure 14:
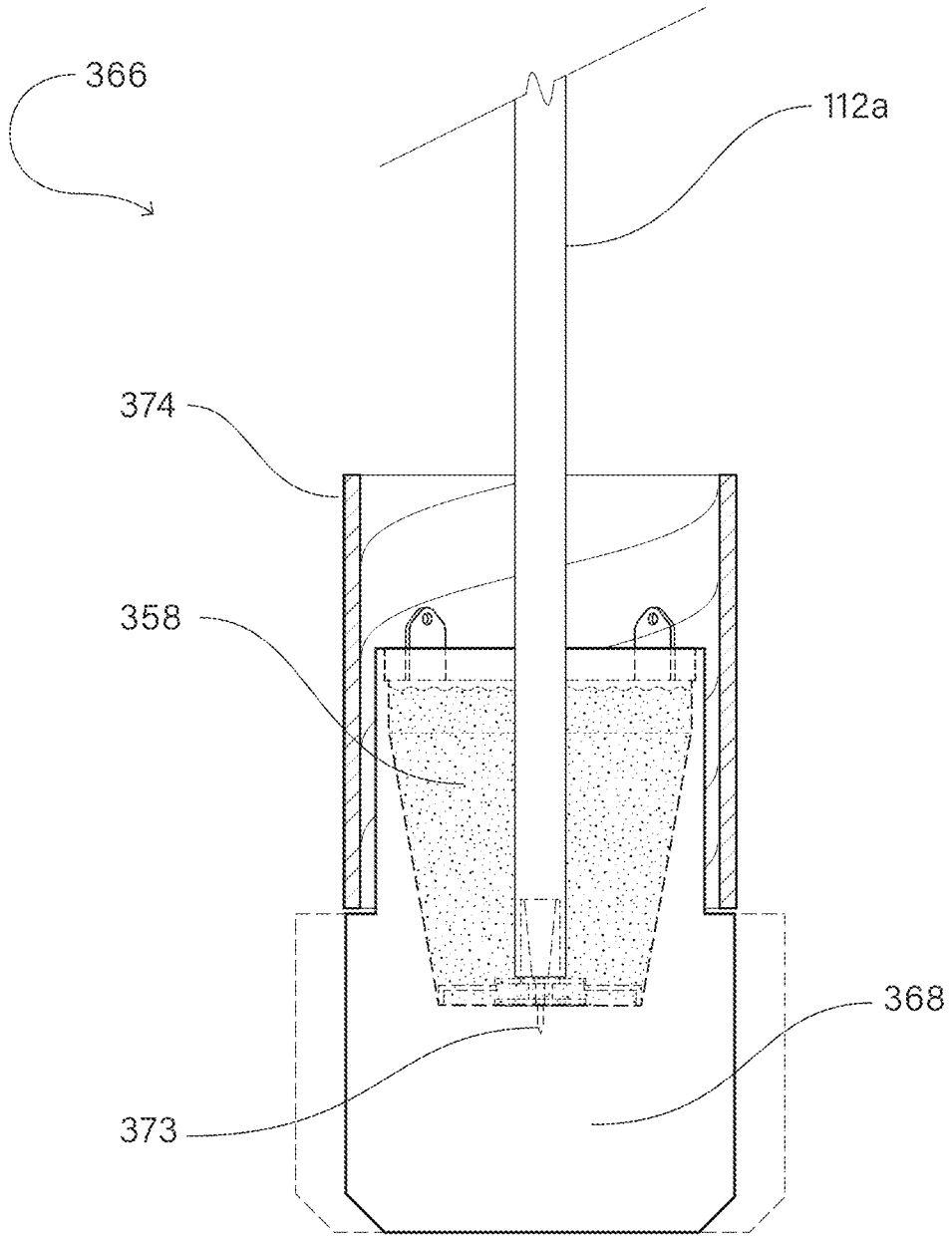
FIG. 14 is a diagram illustrating a cross-sectional view of aspects of the embodiment of the robotics-assisted foundation installation system of FIG. 12.

FIG. 13 is a perspective view illustrating aspects of the embodiment of the robotics-assisted foundation installation system of FIG. 12. In FIG. 13, cylindrical form 374 is shown to be removable from foundation 366. FIG. 14 is a diagram illustrating a cross-sectional view of aspects of the embodiment of the robotics-assisted foundation installation system of FIG. 12. In FIG. 14, receptacle 376 is shown filled with grout 358, which is analogous to the state of upper coupler 122 in FIG. 11J. A fastener 373 is shown to protrude into foundation 368. Fastener 373 holds platter 370 in place and may be a "nail" such as that produced by a Hilti gun.

Figure 15:
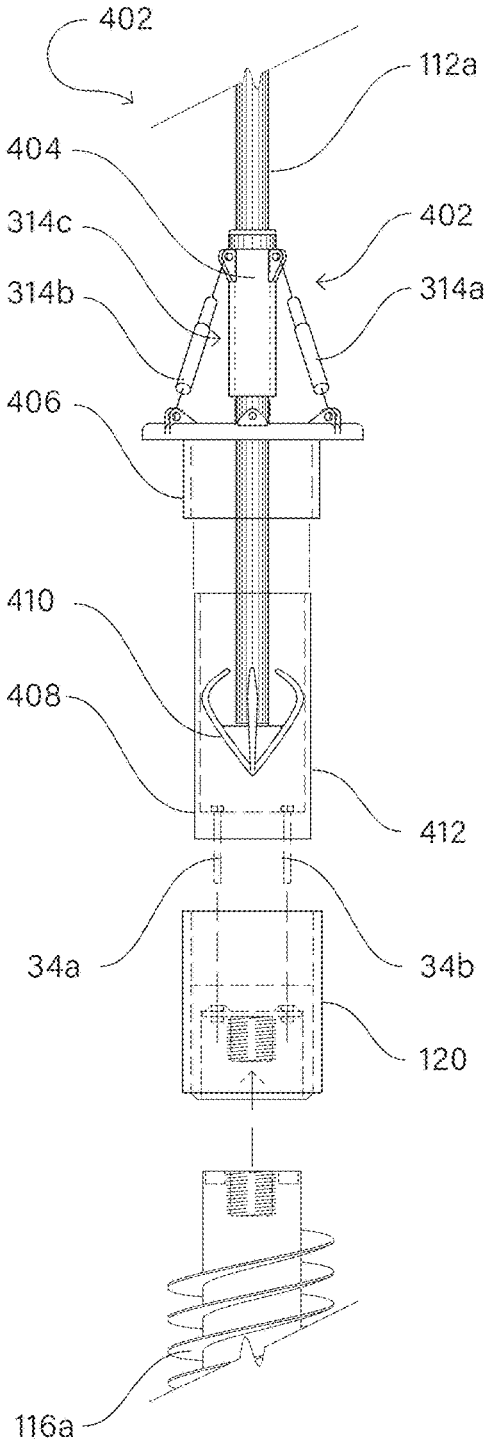
FIG. 15 is a diagram illustrating a cross-sectional view of aspects of an embodiment of a robotics-assisted foundation installation system.

FIG. 15 is a diagram illustrating a cross-sectional view of aspects of an embodiment of a robotics-assisted foundation installation system 400. Not all instances of a build require the full repertoire of tilting and translational control. Some instances may require tilting but not complete translational positioning. System 400 includes a column positioning tool 402 providing the ability to tilt column 112 about the X and Y axes, and includes grid-solving system 300 to solve for the grid. Tool 402 includes a column sleeve 404 connected to a ring base 406 by actuators 314*a* . . . 314*c*. Ring base 406 fits over an upper coupler 408 and retains a portion of upper coupler 408 within, which provides stability and makes analogs of alignment tabs 324 unnecessary. Within a grout receptacle 412, upper coupler 418 includes a centering web 410 that constrains the lower end of column 112 in X, Y directions to the approximate center of coupler 408. Upper coupler 418 is attached to coupling base 120 in the same manner as described with reference to upper coupler 122 in FIG. 11C. With coupling base 120, upper coupler 408, and column positioning tool 402 connected, tool 402 receives column 112 into column sleeve 404. Column 112 then slides within sleeve 404 through receptacle 412 and bottoms out in centering web 410. Generally, the discussion of the placement and use of column positioning tool 310 atop upper coupler 122 of FIG. 11C-FIG. 11K applies equally to the placement and use of column positioning tool 402 atop coupler 408, except: upper coupler 408 does not provide for the re-positioning of range limiting pin 328*a* of FIG. 11E and the fact that this embodiment of column positioning tool 402 does not provide for motion of column 112 in the Z axis because sleeve 404 does not grip column 112 but, instead, allows column 112 to slide freely within.

In an embodiment, sleeve 404 may be provided with a clamping apparatus that grips column 112 and, using actuators 314*a* . . . 314*c*, column positioning tool 402 may raise column 112 along the Z axis, from centering web 410. In this embodiment, the discussion of the placement and use of column positioning tool 310 atop upper coupler 122 of FIG. 11C-FIG. 11K generally applies equally to the placement and use of column positioning tool 402 atop coupler 408, except: upper coupler 408 does not provide for the re-positioning of range limiting pin 328*a* of FIG. 11E.

Figure 16:
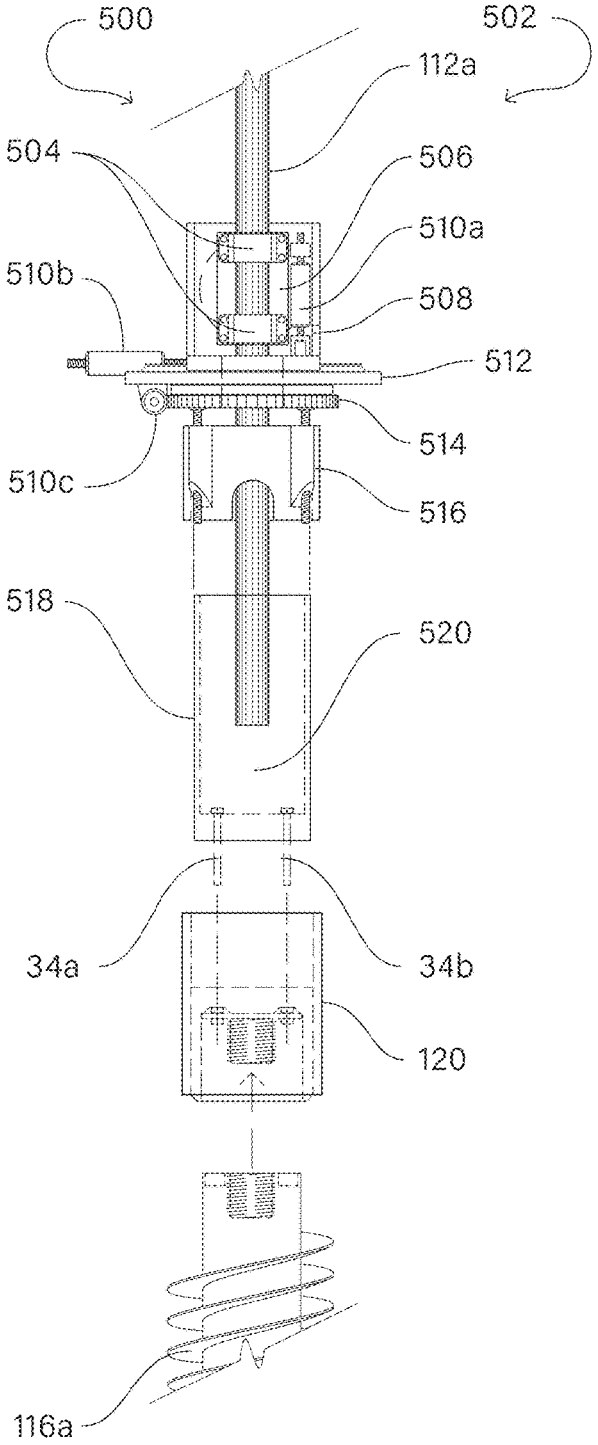
FIG. 16 is a diagram illustrating a cross-sectional view of aspects of an embodiment of a robotics-assisted foundation installation system.
Figure 17B:
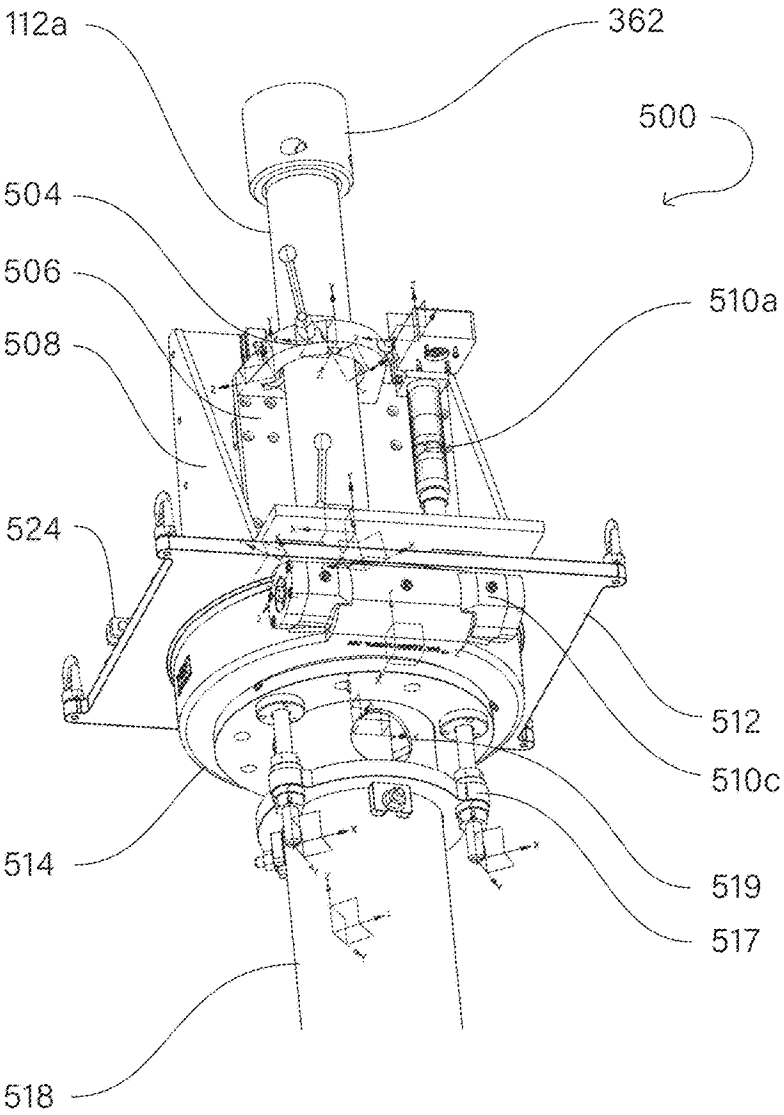
FIG. 17A-17.B are perspective views illustrating aspects of an embodiment of a robotics-assisted foundation installation system.
Figure 17A:
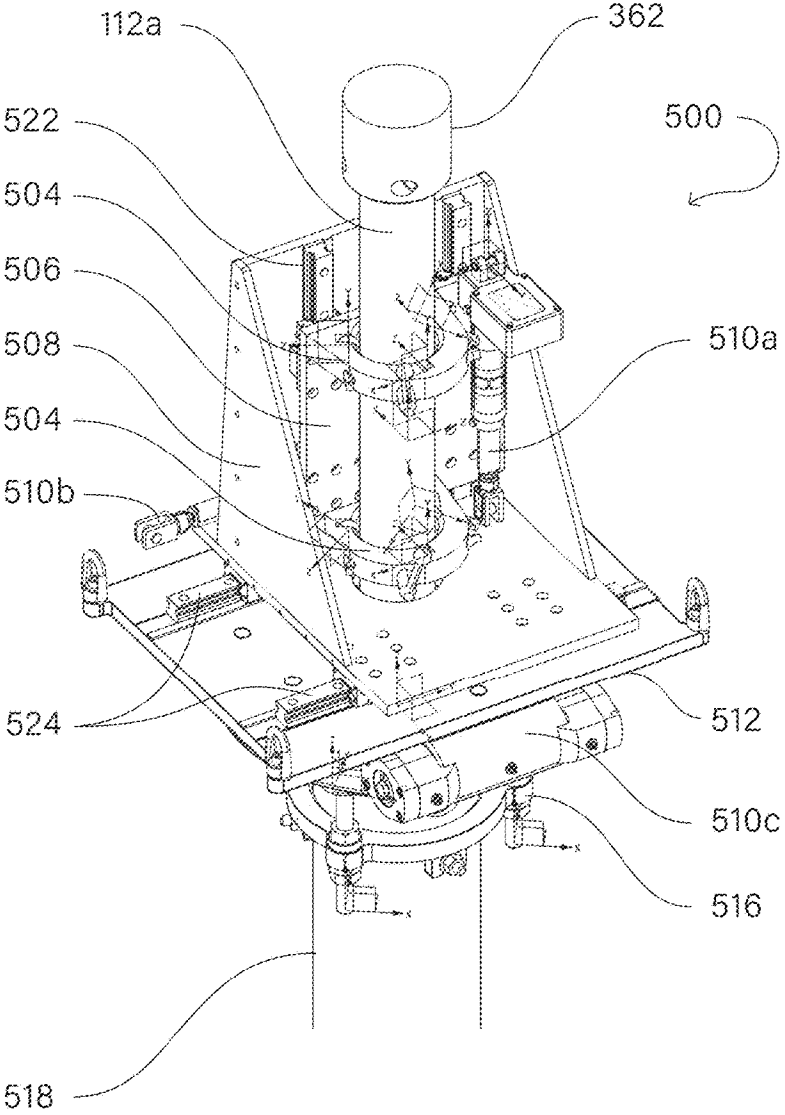

FIG. 16 is a diagram illustrating a cross-sectional view of aspects of an embodiment of a robotics-assisted foundation installation system 500, which is a solution for an instance of a build that requires translational control. System 500 includes a column positioning tool 502 that provides the ability to translate column 112 along the X, Y, and Z axes and includes grid-solving system 300 to solve for the grid. Tool 502 includes a grip 504 connected to a grip base 506. Grip 504 clamps to column 112. Grip base 506 is translatable along the Z-axis (or the axis of column 112) by an actuator 510*a* connected between grip base 506 and an upper bracket 508. Actuator 510*a* is configured to move grip base 506 with respect to upper bracket 508 along rails 522 (FIG. 17A). Upper bracket 508 is translatable with respect to a mid-bracket 512 by an actuator 510*b* configured to move upper bracket 508 along rails 24 (FIG. 17A). Mid-bracket 512 is rotatable about the Z-axis by an actuator 510*c* configured to rotate mid-bracket 512 with respect to a lower bracket 514. Thus, Z-axis translation may be achieved by having grid control system 295 direct actuator 510*a* appropriately. X, Y translation may be achieved by, e.g., having grid control system 295 direct actuator 501*c* to rotate mid-bracket 512 until a potential line of movement of column 112 intersects with the desired X, Y location, then having grid control system 295 direct actuator 510*b* to move upper bracket 508 along rails 524 until column 122 reactions the target X, Y location.

In FIG. 16, a ring base 516 fits over an upper coupler 518 and retains a portion of upper coupler 518 within, which provides stability and makes analogs of alignment tabs 324 unnecessary. Upper coupler 518 includes a grout receptacle 520, but does not include a limiting pin or centering web. Upper coupler 518 is attached to coupling base 120 in the same manner as described with reference to upper coupler 122 in FIG. 11C. With coupling base 120, upper coupler 518, and column positioning tool 502 connected, tool 502 receives column 112 into grip 504. Column 112 is then positioned and clamped by grip 504 in a position where column tip 118 is within a range that is within the reach of tool 502. Generally, the discussion of the use of column positioning tool 310 atop upper coupler 122 of FIG. 11G-FIG. 11K applies equally to the use of column positioning tool 502 atop coupler 408, except: upper coupler 518 does not include a range limiting pin 328*a* of FIG. 11E and the fact that tool 502 does not provide for tilt, and instead translates column 112 Z axis and translates column 112 the X, Y axis with an associated rotation about the Z axis. Also, a slight difference exists in that a port for grout entry must be provided in coupler 518 (see FIG. 18A-FIG. 18D).

FIG. 17A is a perspective view illustrating aspects of an embodiment of robotics-assisted foundation installation system 500, with column positioning tool 502, and a tool ring base 517 that is slightly different from tool ring base 516 of FIG. 16. FIG. 17A illustrates rails 522 along which grip base 506 may be translated by actuator 510*a* along the Z axis with respect to upper bracket 508. Upper bracket 508 slides along rails 524 when translated by actuator 510*b* with respect to mid-bracket 512. In FIG. 17B, a grout port 519 indicates where grout may be added to receptacle 520.

FIG. 18A-FIG. 18D are diagrams illustrating cross-sectional views of aspects of the embodiment of the robotics-assisted foundation installation system 500 during different steps in a method of using system 500. In these method, upper coupler 518 has been replaced with lower telescoping column 126 of column 216*d* (FIG. 2). Thus, FIG. 18A-FIG. 18D illustrate the adaptable nature of column positioning tools such as column positioning tool 502. Also, FIG. 18A-FIG. 18D illustrate steps involved in the use and re-use of a column positioning tool that are similar to steps illustrated with respect to FIG. 11A-FIG. 11K.

Figure 18A:
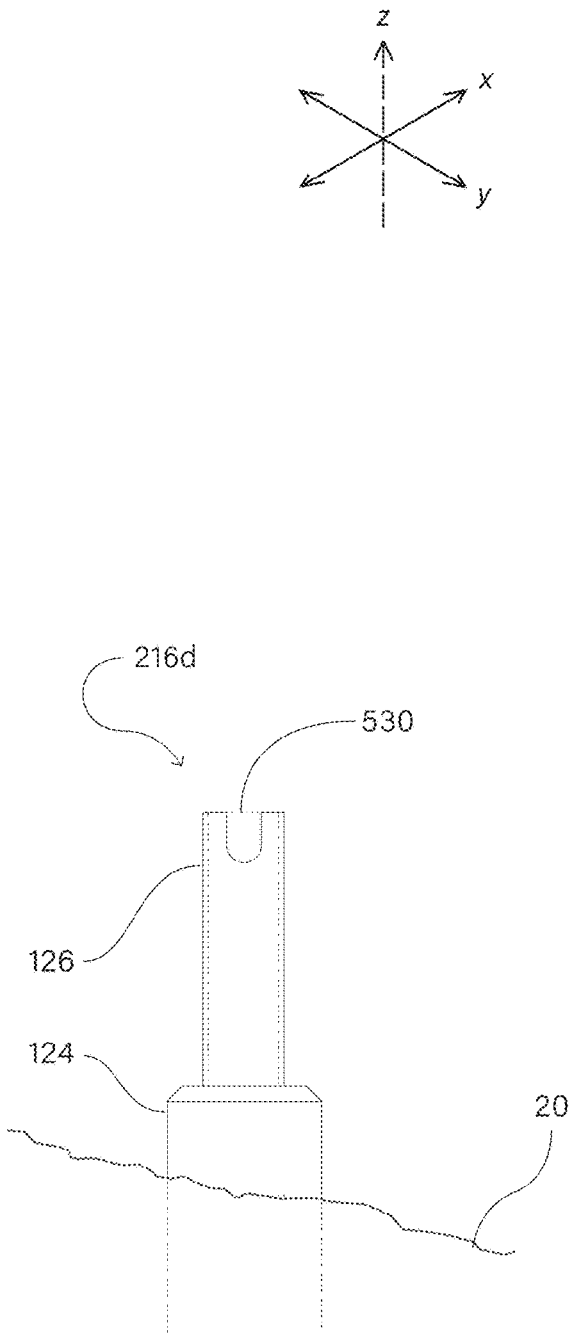
FIG. 18A-FIG. 18D are diagrams illustrating cross-sectional views of aspects of the embodiment of a robotics-assisted foundation installation system of FIG. 16 during different steps in a method of using the system.

In FIG. 18A, site 20 has been prepared by installing in ground foundations. In ground foundation 124 is used as an example in this discussion and should be understood to represent a plurality of in ground foundations distributed within site 20. Within lower in-ground foundation 124, lower telescoping column 126 has been fixed using typical construction methods with typical construction precision. A grout pour port 530 has been provided in lower telescoping column 126.

Figure 18B:
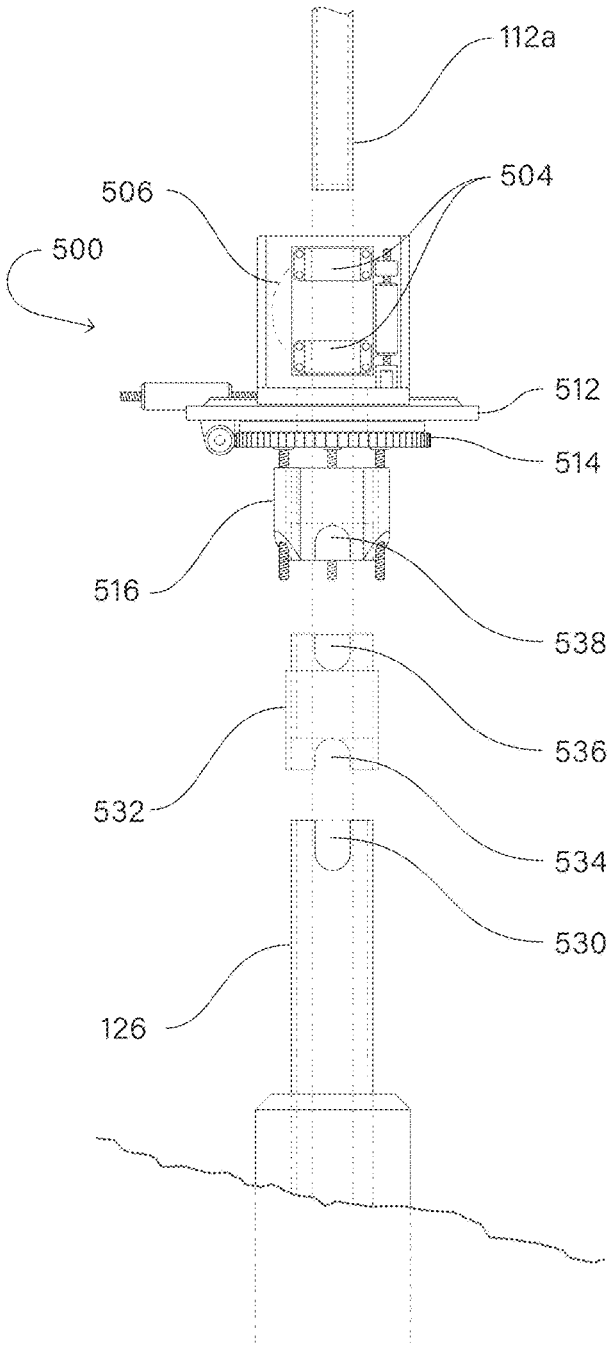

In FIG. 18B, a collar standoff 532 is placed atop column 126, with column 126 being received within standoff 532 and with a grout pour port 534 aligned with grout pour port 530. Similarly, column positioning tool 502 is placed atop standoff 532, with standoff 532 being received within tool ring base 516 and a grout pour port 538 aligned with a grout pour port 536. In embodiments, collar standoff 532 may be modified so that it may be used atop columns of different size or configuration. Thus, tool 502 may be used to position columns 112 atop foundations of different configurations by modifying only standoff 532. Column 112 is then lowered into grip 504 and positioned so that the target location for column tip 118 is within the range of motion of column positioning tool 502. Column 112 is then clamped by grip 504.

Figure 18C:
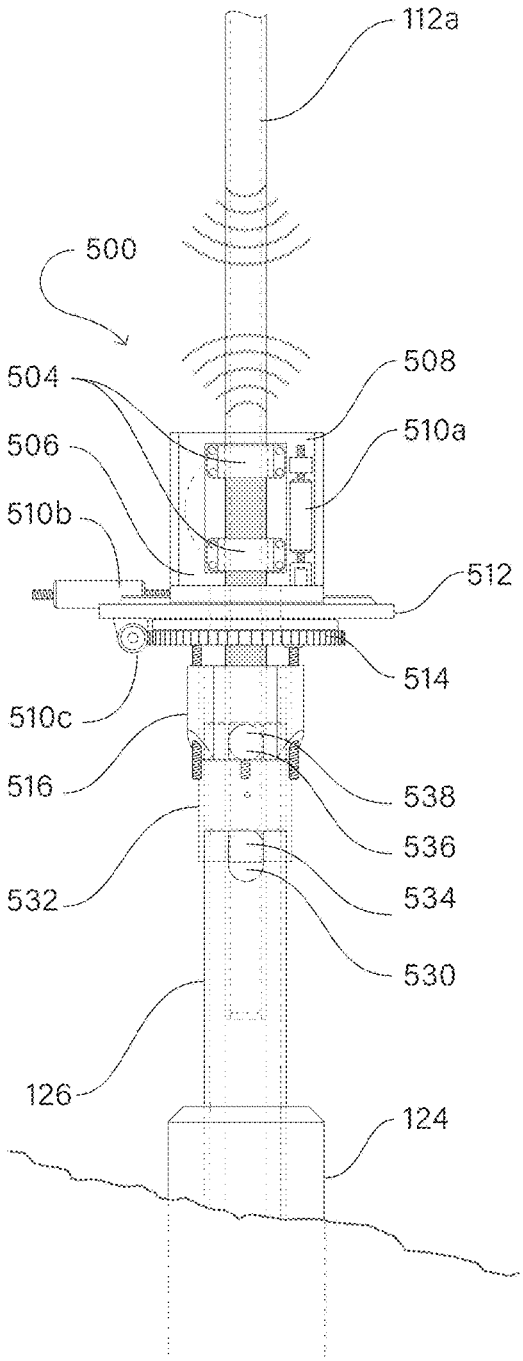

FIG. 18C shows the alignment of grout pour ports 536 and 538, and of ports 530 and 534. The lower grout port of 530, 534 provides for grout to be introduced with a hose. The upper grout port of 536, 538 allows for overflow evacuation of structural grout so that column positioning tool 502 is not damaged. After all columns 112 for the plurality are in this configuration, grid-solving system 300 determines the position of each column tip and system 500 solves for the grid as discussed with regard to FIG. 11G-FIG. 11K, with grid control system 295 directing tools 502, with actuators 510*a* . . . 510*c* to translate column tips 118 to the target X, Y, Z positions and maintain that position until the grout hardens.

Figure 18D:
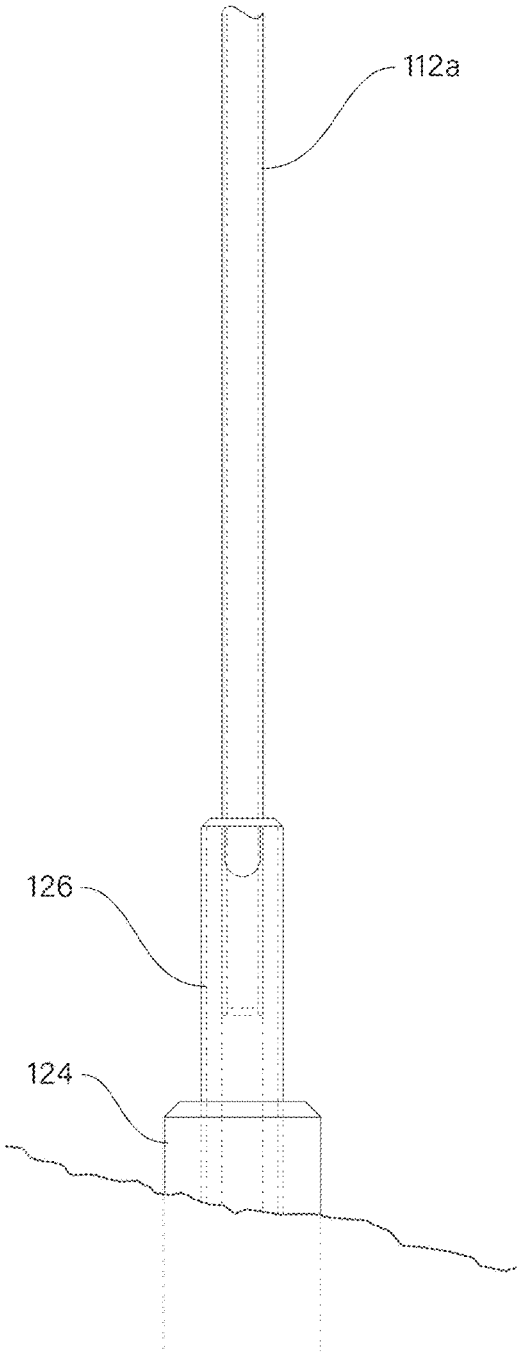

FIG. 18D illustrates the position of upper column 112 after the grout has hardened within lower column 126 and column positioning tool 502 has been removed and column 112 is ready to support structure 10.

Figure 19A:
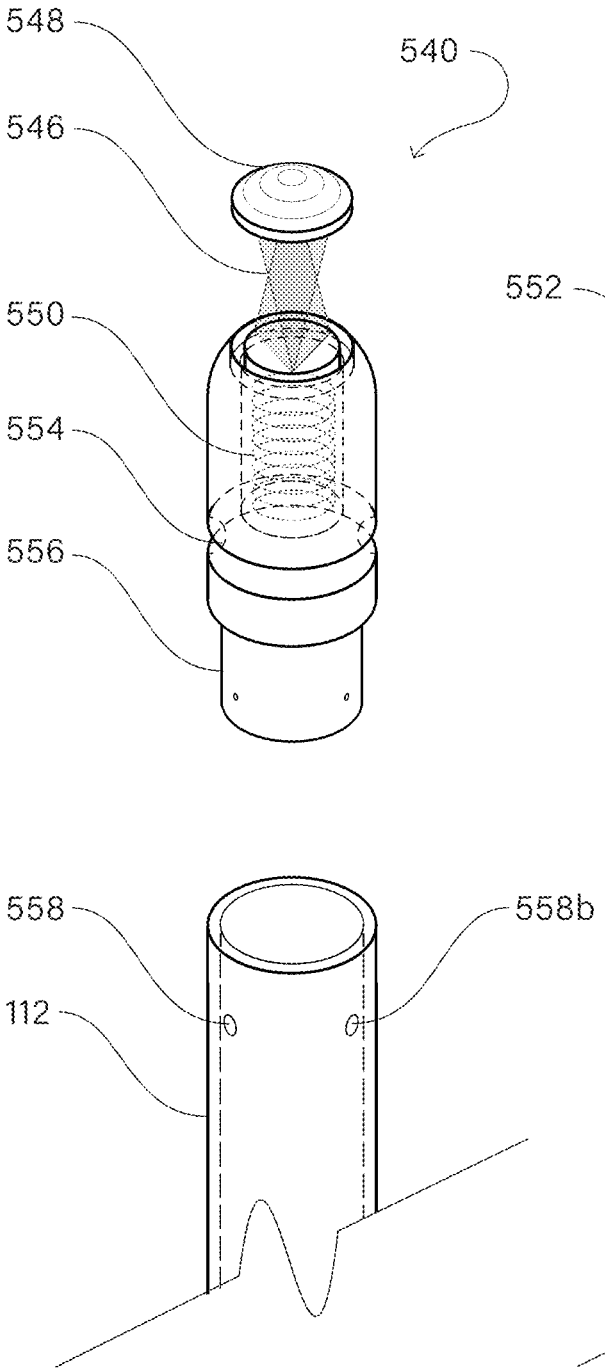
FIG. 19A is a perspective view illustrating aspects of an embodiment of a robotics-assisted foundation installation system.
Figure 19B:
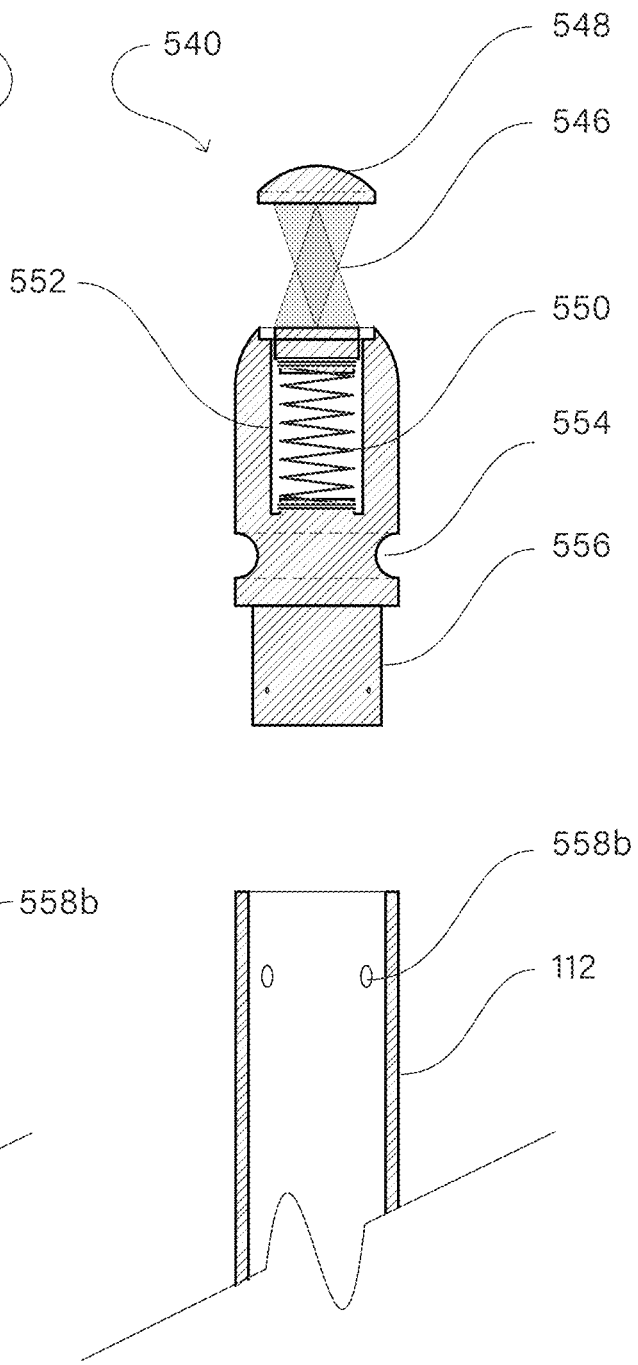
FIG. 19B is a diagram illustrating a cross-sectional view of aspects of the embodiment of a robotics-assisted foundation installation system of FIG. 19A.

FIG. 19A is a perspective view illustrating aspects of an embodiment of a robotics-assisted foundation installation system. FIG. 19A illustrates a column cap 540, such as cap 362, that has been provided with a prism 546 that collapses within the column cap. FIG. 19B is a cross-sectional view of column cap 540. Because prisms 546 collapse into column cap 540, cap 540 eliminates the need for a construction team to remove reflectors 204 from column tips 118 after columns 112 have been fixed in place by, e.g., hardened grout. Column cap 540 includes a cylindrical opening 552 and a spring 550 beneath prism 546. When there is insufficient force on a lid 548, spring 550 causes prism 546 to emerge from opening 552 to the extent of spring travel. When a force is applied that overcomes spring 550, such as when structure 10 is placed atop lid 548, the force causes prism 546 to retract into opening 552 (as shown in, e.g., FIG. 11K). In the embodiment, cap 540 includes a cylindrical base 556 than may be inserted into the top of column 112 and held there with fasteners through ports 558. In other embodiments, cap 540 may be configured to receive column 112 within, as with column cap 362 (FIG. 17A). Cap 540 is also shown with an annular groove 554. As shown in FIG. 11K, a bolt may be passed through a structure and into groove 554, which creates an interference between the bolt and column cap 540 that prevents the structure from being separated from the column. In embodiments, spring 544 may be replaced with other suitable mechanisms, such as a leaf spring, or resilient material.

Figure 20:
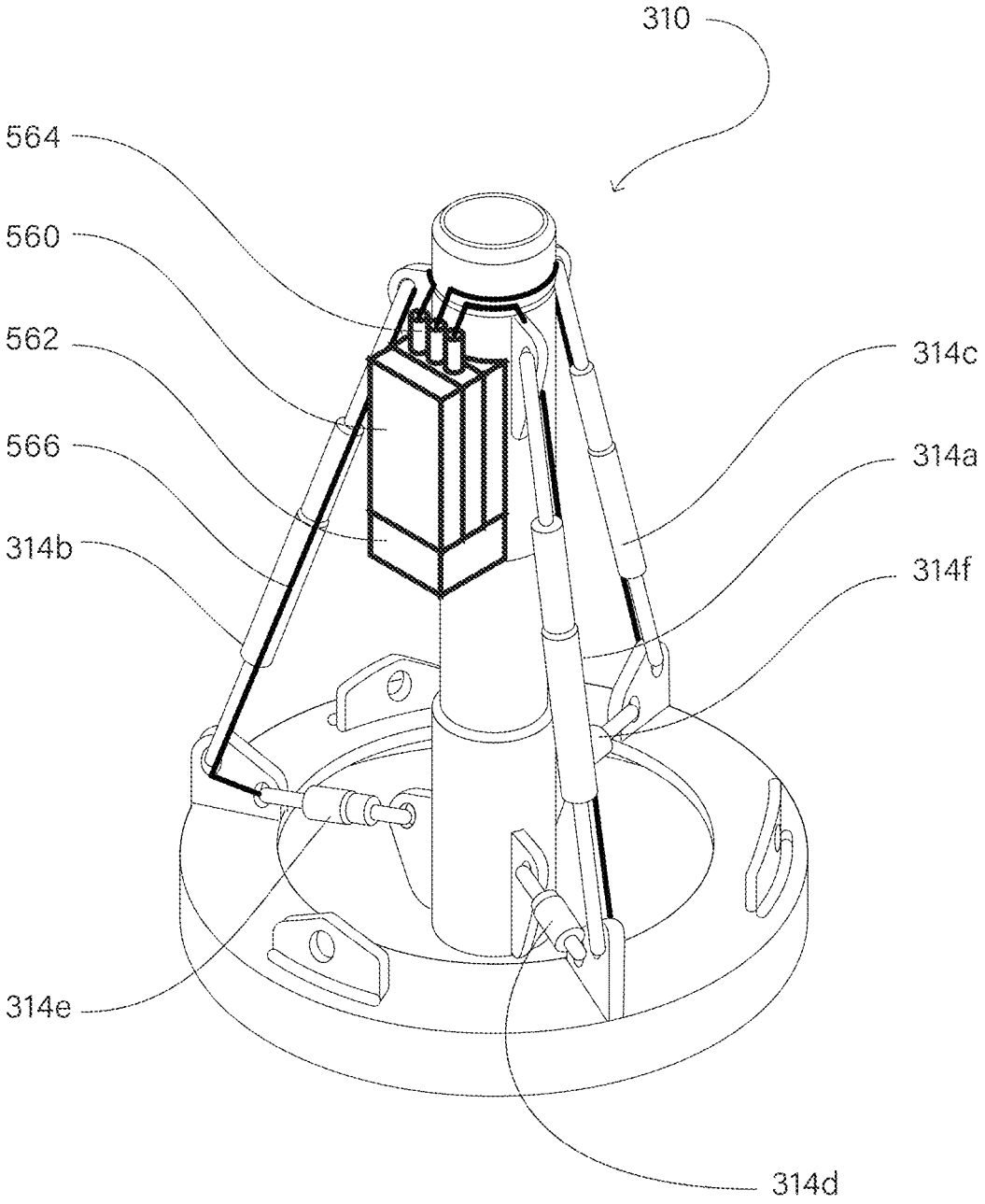
FIG. 20 is a perspective view illustrating aspects of an embodiment of a robotics-assisted foundation installation system.

FIG. 20 is a perspective view illustrating aspects of an embodiment of a robotics-assisted foundation installation system. In FIG. 20, column positioning tool 310 is shown to include a tool control system 560. Tool control system 560 is connected to and controls the position of each actuator 314*a* . . . 314*f* Exemplary sets of exemplary control lines 564 are shown. One control line set 566 includes the control lines for both actuator 314*b* and 314*e*. Tool control system 560 includes a power supply 562 that provides power to actuators 314*a* . . . 314*f* and to internal components including signal electronics or other communication equipment for communications between tool control system 560 and control system 295. While tool control system 560 is illustrated with respect to column positioning tool 310, column positioning tools 402, 502 also include a tool control system 450 configured to control the actuators of those tool control systems and communicate with grid control system 295.

FIG. 20 is a perspective view illustrating aspects of an embodiment of a robotics-assisted foundation installation system. In FIG. 20, column positioning tool 310 is shown to include a tool control system 560. Tool control system 560 is connected to and controls the position of each actuator 314*a* . . . 314*f*. Exemplary sets of actuator driving ports 564 are shown. One control line set 566 includes the control lines for both actuator 314*b* and 314*e*. Tool control system 560 includes a power supply 562 that provides power to actuators 314*a* . . . 314*f* via actuator driving ports 564 and to internal components including signal electronics or other communication equipment for communications between tool control system 560 and grid control system 295 as discussed with reference to FIG. 23 and FIG. 24.

Figure 21:
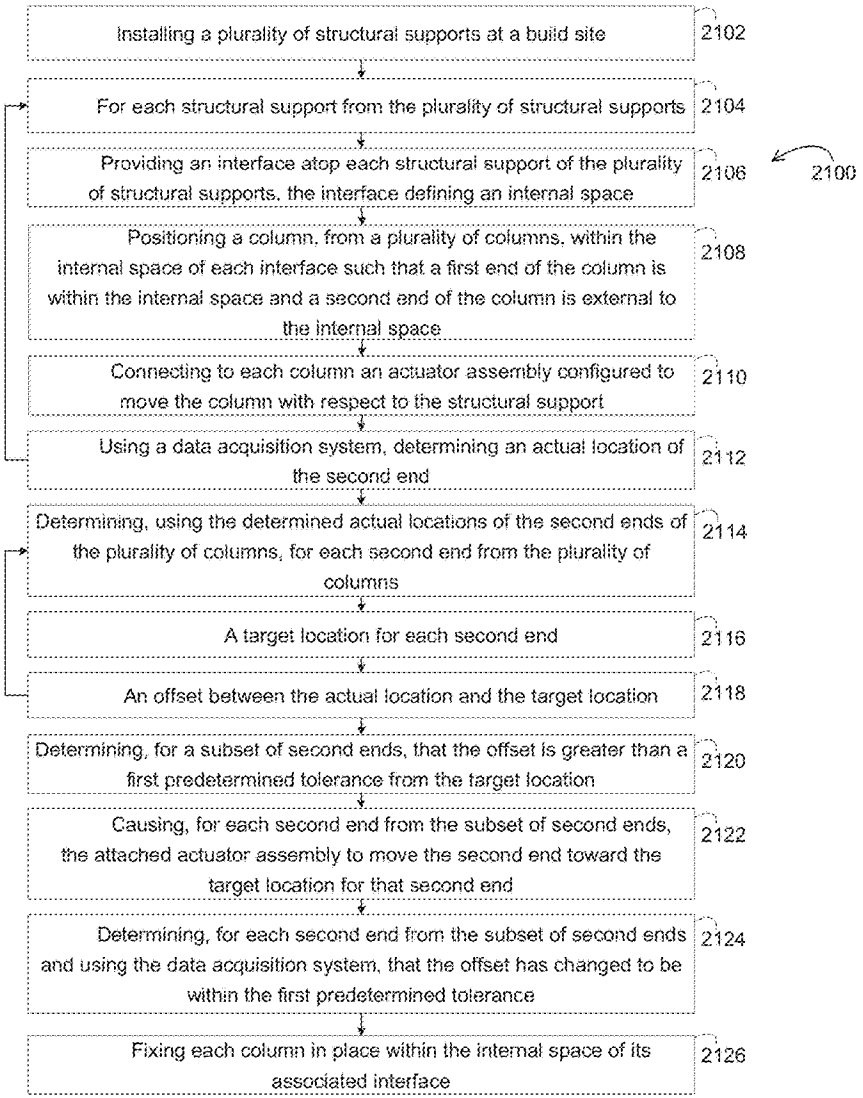
FIG. 21 is a flowchart illustrating steps in a method of using an embodiment of a robotics-assisted foundation installation system.

FIG. 21 is a flowchart illustrating steps in a method 2100 of using an embodiment of a robotics-assisted foundation installation system. In step 2102 of method 2100 a plurality of structural supports are installed at a build site. In step 2104, for each structural support from the plurality of structural supports: step 2106) an interface defining an internal space is provided atop each structural support of the plurality of structural supports; step 2108) a column from a plurality of columns is positioned within the internal space of each interface such that a first end of the column is within the internal space and a second end of the column is external to the internal space; step 2110) each column is connected to a dedicated actuator assembly configured to move that column with respect to the structural support; and step 2112) using a data acquisition system, an actual location of the second end is determined. In step 2114, using the determined actual locations of the second ends of the plurality of columns, for each second end from the plurality of columns: step 2116) a target location for each second end is determined, and step 2118) an offset between the actual location and the target location is determined. In step 2120, the offset for a subset of second ends is determined to be greater than a first predetermined tolerance from the target location. In step 2122) for each second end from the subset of second ends, the attached actuator assembly causes the second end to move toward the target location for that second end. In step 2124) for each second end from the subset of second ends and using the data acquisition system, the offset is determined to be within the first predetermined tolerance. And, in step 2126, each column is fixed in place within the internal space of its associated interface. In some embodiments, an additional step after step 2122 includes determining that for some of the subset of second ends, the offset remains greater than the first predetermined tolerance, in which case steps 2122 and 2123 are repeated until step 2124 is achieved. In other words, the location of each second end is determined and caused to move toward its target location until it is determined to be within the predetermined tolerance of its target location.

Figure 22:
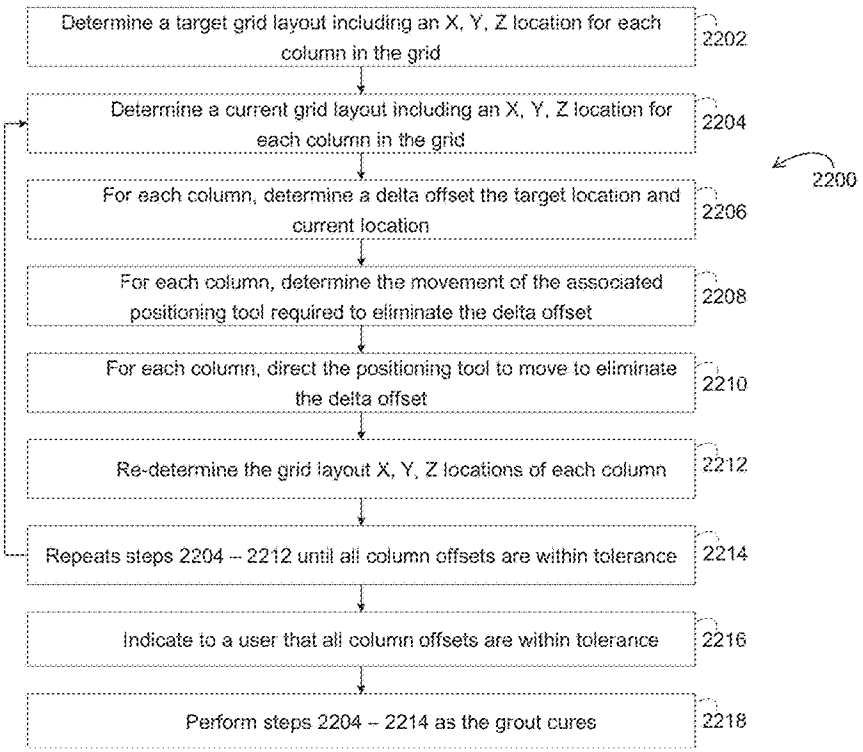
FIG. 22 is a flowchart illustrating steps in methods of using an embodiment of a robotics-assisted foundation installation system.

FIG. 22 is a flowchart illustrating steps in a method 2200 of using an embodiment of a robotics-assisted foundation installation system. In method 2200, a grid-solving system: Step 2202) determines a target grid layout including an X, Y, Z location for each column in the grid; step 2204) determines a current grid layout including an X, Y, Z location for each column in the grid; step 2206) for each column, determines a delta offset the target location and current location; step 2208) for each column, determines the movement of the associated positioning tool required to eliminate the delta offset; step 2210) for each column, directs the positioning tool to move to eliminate the delta offset; step 2212) re-determines the grid layout X, Y, Z locations of each column; step 2214) repeats steps 2204-2212 until all column offsets are within tolerance; and step 2216) indicate to a user that all column offsets are within tolerance. After grout is added to fix the columns in place, in step 2218) the grid solving system may perform steps 2204-2214 as the grout cures.

In an embodiment, the grid solving system may perform steps 2204-2216 as adapted to a model of the evaporative cure time of the structural grout. As a result of the adaptation, the testing for position and the resulting corrections may happen once a minute at the outset with a repeating frequency that decays until the grout has substantially set, which is predictable based on mixture, and a model of ambient temperature and humidity fluctuation on an hourly basis through the projected cure period.

In some embodiments, grid control system 295 may be driven by software following an algorithm prepared according to a singular coordination mode of controlling column positioning tools, which is iterative and does not require extensive computing power. In such an algorithm, the system goes through a trial and error process for each column, e.g., move the actuator some distance a first direction, test for offset, if the offset is not within the tolerance adjust the direction of actuator control according to the change in the offset and move the actuator again, retest, and repeat until the offset is within tolerance. Such an algorithm uses this guess-and-check system to test for less or more offset in a feedback loop that attempts to reconcile the current position of a column top to the target position to the target position and does so by computing the offset and instructing the column positioning tool to make incremental movements at an appropriate scale until the target position is reached. Iterations in the feedback loop can occur at the timescale of seconds rather than milliseconds (common to robotic implementation) to reduce the computing power and actuator resolution demands without diminishing outcome accuracy. For a given column array, this control mode may result in hundreds of correction adjustments being performed per minute.

In some embodiments, grid control system 295 may be driven by software following an algorithm prepared according to a forward coordination mode of controlling column positioning tools. With this control mode, after determining column offsets and for each column positioning tool, system 295 builds a digital twin model of the tool flex state (i.e., the actuator movement) needed to position the column at the target location. In this control mode, system 295 moves the tools into what it has modeled to be the best tool states and then starts an iterative test/move/test loop until the target column positions are reached. An advantage of this forward coordination control is that it is less "hunting" than the singular coordination mode. This control mode requires more computing power and more carefully structured target inputs (e.g., to render the digital twin model), but can reduce the time of active adjustment to the extent that the entire system would be substantially aligned to target in a single step (with the need for only fine adjustments thereafter).

In some embodiments, grid control system 295 may be driven by software following an algorithm prepared according to a differential coordination mode of controlling column positioning tools. This control mode is based on the logic that, if the control system orders that the actual positions of the column positions match target positions in a digital twin model, then the desired actuator flex to achieve those positions is an outcome. With this control mode, after determining column offsets and for each column positioning tool, grid control system 295 builds a digital twin model of the target column positions. The advantage of this is that it dramatically limits the scope of hunting and promises to achieve perfection in the first attempt. This approach to the control of column positioning tools may result in achieving positioning accuracy for one, or multiple, columns in only one step of adjustment.

From singular coordination, to forward coordination, to differential coordination, the coding complication escalates dramatically, as does the computing power need to achieve the outcome. It is a good-better-best escalation of system performance relative to speed to finish.

EXAMPLE

An exemplary system for the robotics-assisted installation of a foundation includes a grid-solving system 300 to solve for the grid in which location determining system 290 is a total surveying system to acquire location data by using a laser to reflect from geolocation devices 204, in this case prisms 546. Grid-solving system 300: determines the position of an initial fixed point of reckoning in relationship to an idealized model of the pier configuration needed for the planned structure (i.e., the system decides which column of the planned structure will be the parent (the fixed point to be tested and verified) and which (the others) will be the subordinate children); determines the actual location of all piers using system 290 and devices 204 placed on top of each pier; and determines the position of an initial fixed point of reckoning in relationship to the site (i.e., the fixed point of reckoning relative to the site is always the column chosen to be the parent). Grid control system 295: uses the "true" data (the actual starting positioning of all pier tops in relation to the initial fixed point of reckoning in relationship to the idealized model, one another, and the initial fixed point of reckoning in relationship to the site) derived by the laser surveying system; determines the required movement of each pier in, e.g., X, Y, Z coordinates, necessary to precisely align the actual pier tip location with the idealized model. In computing the required movement of each pier, system 295 may allow for the entire fixed model to have a circular freedom (system tolerance) to find a best possible fit for the entire pier system. The column positioning tool in this example may be tool, such as any of tools 310, 402, or 502, which is configured to move columns 112 in X, Y, Z, directions to precisely align with the desired pier model. One of skill will understand to specify actuators that are rated for the loads of columns 112, including when surrounded by grout. The column positioning tool is configured to hold the positioning of each pier precisely in place for approximately 96 hours, which is based on the cure time for the grout. During that curing time, the tool is anticipated to be actively manipulating the column for 1 hour. In another example, the grout cure time is 72 hours. A tool control system provided on the column positioning tool includes actuator controller and a self-contained power supply sized for the chosen actuators (which may include 10 amp actuators), and size for the communication and actuator power requirements through the grout curing time and considering the anticipated time of active manipulation. Battery power is the preferred solution, but if it is not possible or feasible, site eclectic generator power is acceptable. The column positioning tool is preferably serviceable in the field and able to accommodate both round and square columns 112. For example, any of tools 310, 402, 502 could accept a round or square column 112 so long as the associated range limiting pin is sized to fit within the column, e.g., column 112 may be a 4 inch square hollow structural steel (HSS) with a variable length of 4-16 ft. With such a column 112, the payload capacity of the column positioning tool is expected to be 200-300 lbs. In this example, the column positioning tool has X, Y, and Z translation capability, such as tools 310 and 502, and is sized to adjust position in the X and Y directions by at least 3" from center and with a range of 14" in the Z direction.

Figure 25A:
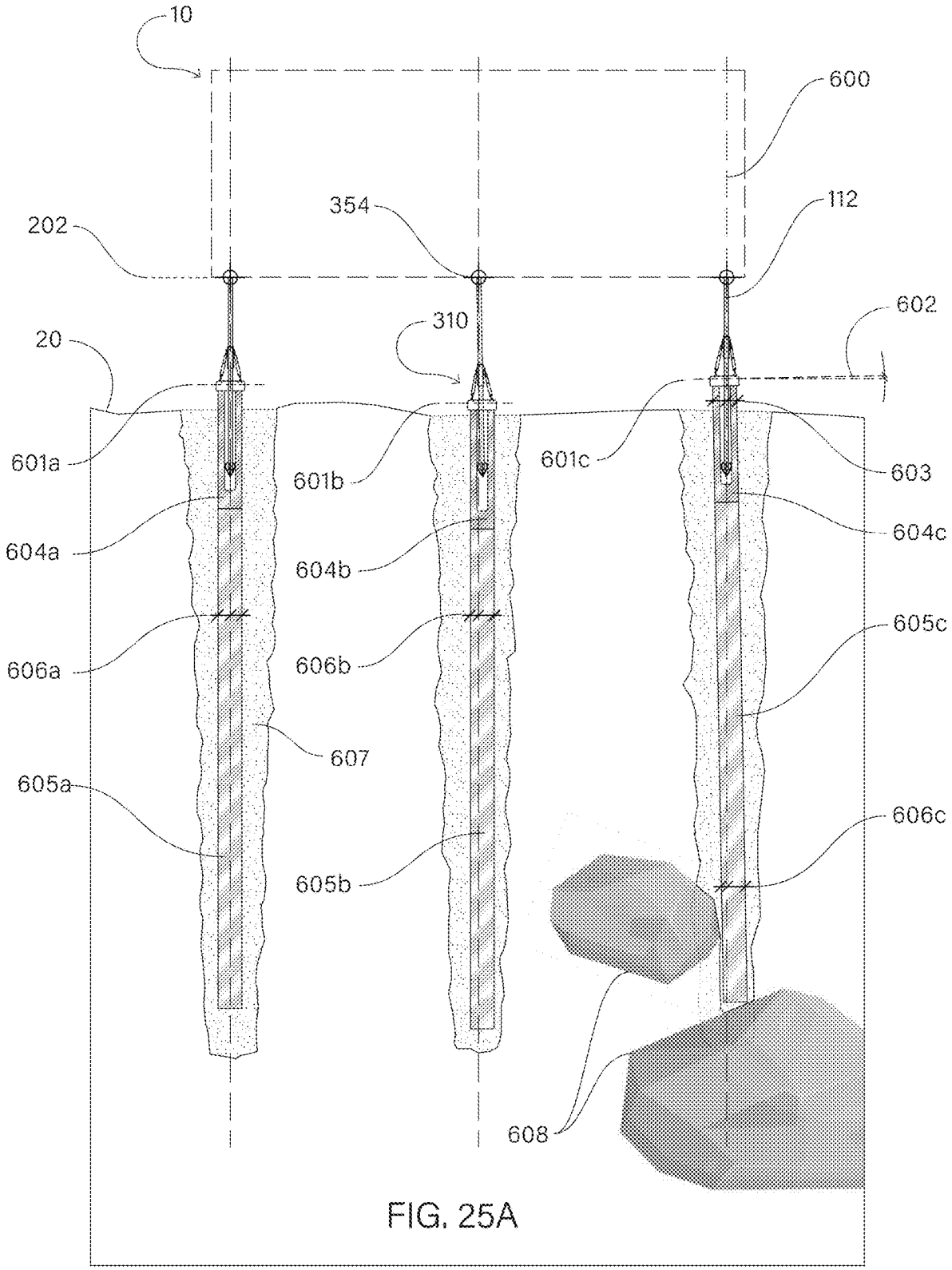
FIG. 25A is a diagram illustrating a cross-sectional view of aspects of an embodiment of a robotics-assisted foundation installation system.
Figure 25B:
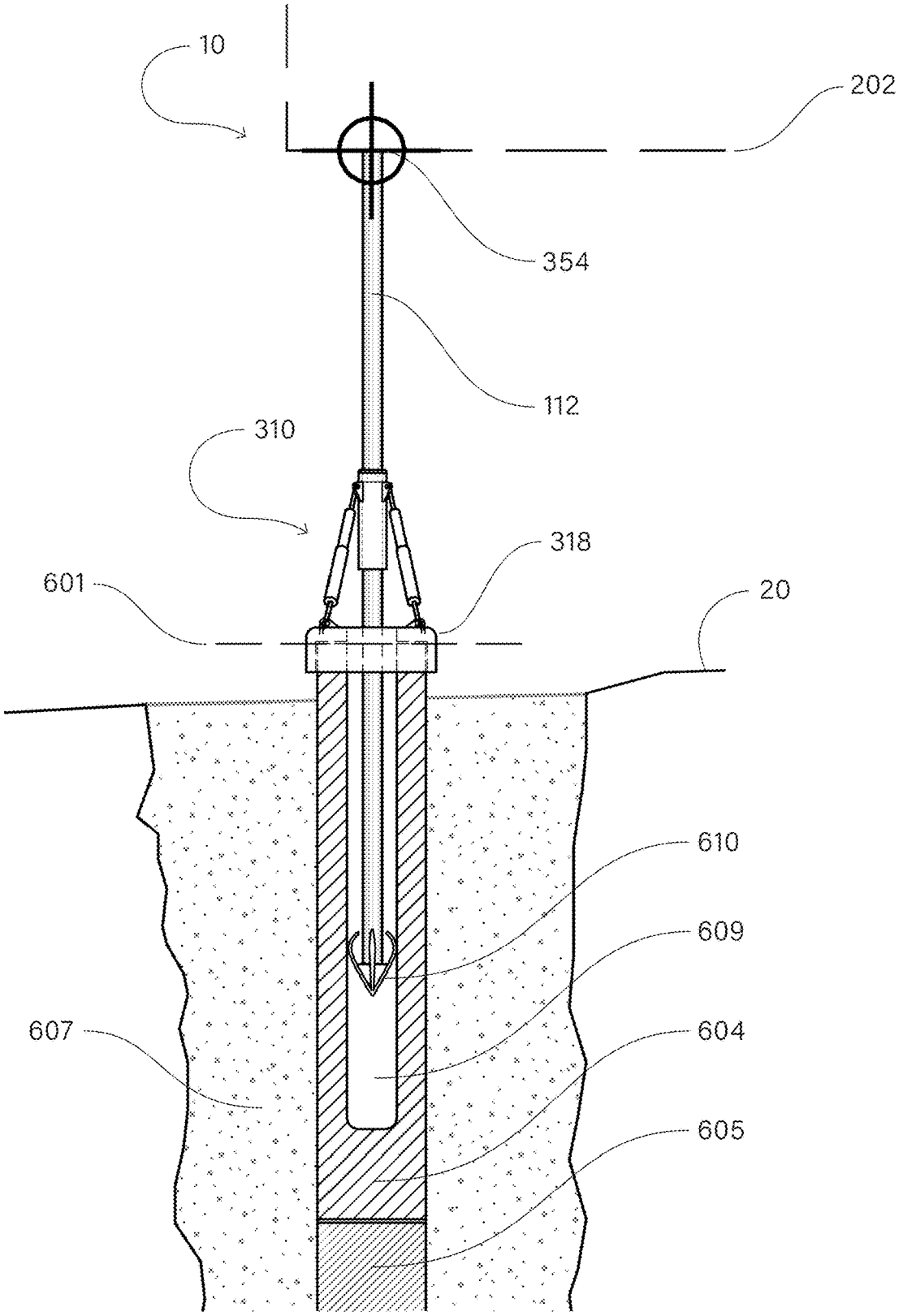
FIG. 25B is a cross-sectional view further illustrating aspects of the embodiment of a robotics-assisted foundation installation system of FIG. 25A.

FIG. 25A-FIG. 25B pertaining to instances where a grout receptacle is integrated into an existing foundation system typology and related connection methods and installation processes.

FIG. 25A is a diagram illustrating a cross-sectional view of aspects of an embodiment of a robotics-assisted foundation installation system. FIG. 25A shows pile caps 604*a* . . . 604*c* fixed to and atop foundation piles 605*a* . . . 605*c*, respectively. Pile caps 604*a* . . . 604*c* each receive a column 112 and, after column is positioned using column positioning tool 310 (as described elsewhere in this application, may be filled with grout to fix column 112 at a desired height and orientation. A column alignment target grid 600 illustrates a desired alignment of columns 112, i.e., a desired registration of columns 112 that provides optimum conditions for a subsequent, trouble-free installation of a building (perhaps pre-fabricated) atop columns 112.

Pile caps 604*a* . . . 604*c* are pile caps that have been fabricated to support the application embodiments of a robotics-assisted foundation installation system. Each pile cap 604 is mounted to the top-most portion of the associated foundation pile 605, either at the time pile 605 is installed, or subsequently. Pile cap 604 is structurally connected to foundation pile 605 using a structural connection that satisfies a structural performance specification, e.g., using a separate, or integrated, base coupler as described in this specification, or being integrally formed within pile 605 during the creation of pile 605. Without a pile cap 604, a typical foundation pile 605 is known in the art and may be construction of varying materials and to varying structural performance specifications. The inclusion of a pile cap 604 atop foundation pile 605 is an aspect of embodiments that transform a conventional and imprecise method of foundation setting into one that is able to achieve a machine tolerance precise, top of column three-dimensional location through the use of embodiments of the robotics-assisted foundation installation system. Backfill 607 may include, e.g., soil, a slurry mix, or concrete, that stabilizes the position of a conventionally placed foundation pile 605*a* . . . 605*c*. A conventional pile placement may use an oversized boring method, which can result in a differential settlement of the pile. Such differential settlement may change the location of the top of the pile, e.g., as shown by the variation in lines 601*a* . . . 601*c*. Such variation may frustrate the subsequent installation structures that require precision location of their sub-structures, or may burden the installation with additional costs in labor or adjustment hardware to achieve a desired system fit. Such differential settlement is most commonly caused by soil expansion or compaction as a result of changing groundwater levels or saturation, or by the heave and thaw of water-based slurries that are designed to freeze to achieve a functional structural connection with a permafrost layer.

FIG. 25A illustrates aspects of complications that may arise during an installation of a foundation pile that may be addressed by embodiments to conform columns 112 to target grid 600. For example, actual column elevations 601*a* . . . 601*c* reflect an imperfect installation of piles 605*a* . . . 605*c* for the following reasons. With elevation 601*a* reflecting a target elevation and orientation, elevation 601*b* illustrates an installation of a pile 605 that is too deep, and elevation 601*c* illustrates an orientation of pile 605*c* that is not in alignment with target grid 600, i.e., pile 605*c* and pile cap 604*c* deviate from a desired alignment with grid 600 by a tilt 602. Imperfections like those illustrated by piles 605*b* and 605*c* are the typically the result of the use of conventional blocking and framing methods to install piles into borings that are subsequently backfilled with soil or slurry mixtures, a process that is further complicated by unpredictable settlement characteristics. A dimension range 603 illustrates a possible range of deviance from centerline foundation and structure-supporting column alignment. Such a deviation may result from a conventionally driven or dropped-in pile encountering a subsurface obstacle, such as rocks 608, which may cause the pile to be axially angled (tilted) off of the intended/optimally desired grid 600. A dimension range 606 illustrates a possible range of deviance from centerline foundation and structure-supporting column alignment. Such a deviation may result from a conventionally driven or dropped-in pile encountering a subsurface obstacle, such as rocks 608, which may cause the pile to be axially angled (tilted) from the intended/optimally desired grid 600. Lines 606*a* . . . 606*c* indicate that the deviation of the associated pile 605*a* . . . 605*c* from the desired axis 600 may vary with the depth of the pile.

FIG. 25B is a cross-sectional view further illustrating aspects of the embodiment of a robotics-assisted foundation installation system of FIG. 25A. In FIG. 25B, pile cap 604 is shown to include a cavity 609 for receiving grout, such as grout 358 (FIG. 11K, FIG. 14). Cavity 609 is configured to be of a depth, width, and strength that are sufficient to allow the precise three-dimensional location and retention of columns 112 by embodiment of the robotics-assisted foundation installation system. A centering device 610 provided within cavity 609 may be attached to the bottom of column 112. Centering device 610 is configured to fit within the inner diameter of cavity 609 and maintain the bottom of column 112 centered within cavity 609 regardless of the depth that the combination of column 112 and device 610 are inserted. Centering device 610 includes a floor connected to tines (e.g., four tines as shown in the embodiment) upon which column 112 rests. In an embodiment, centering device may be bolted to column 112 before column 112 is inserted into cavity 609 so that centering device 610 does not come off when column 610 is raised within the grout receptacle. In an embodiment, the bolts may pass through the floor and into column 112. In an embodiment, the floor may be provided with a cap that fits about column 112 and through which bolts may be passed and into column 112. With column 112 thus centered within cavity 609, embodiments of the robotics-assisted foundation installation system may position the top of column 112 precisely relative to the fixed x, y position of the bottom of column 112 while maintaining the flexibility of positioning in the z axis. Thus, a particular column being manipulated can subsequently be positioned to meet a target z plane in common with any other columns 112, as described above. Centering device 610 remains after the installation of grout.

Figure 26A:
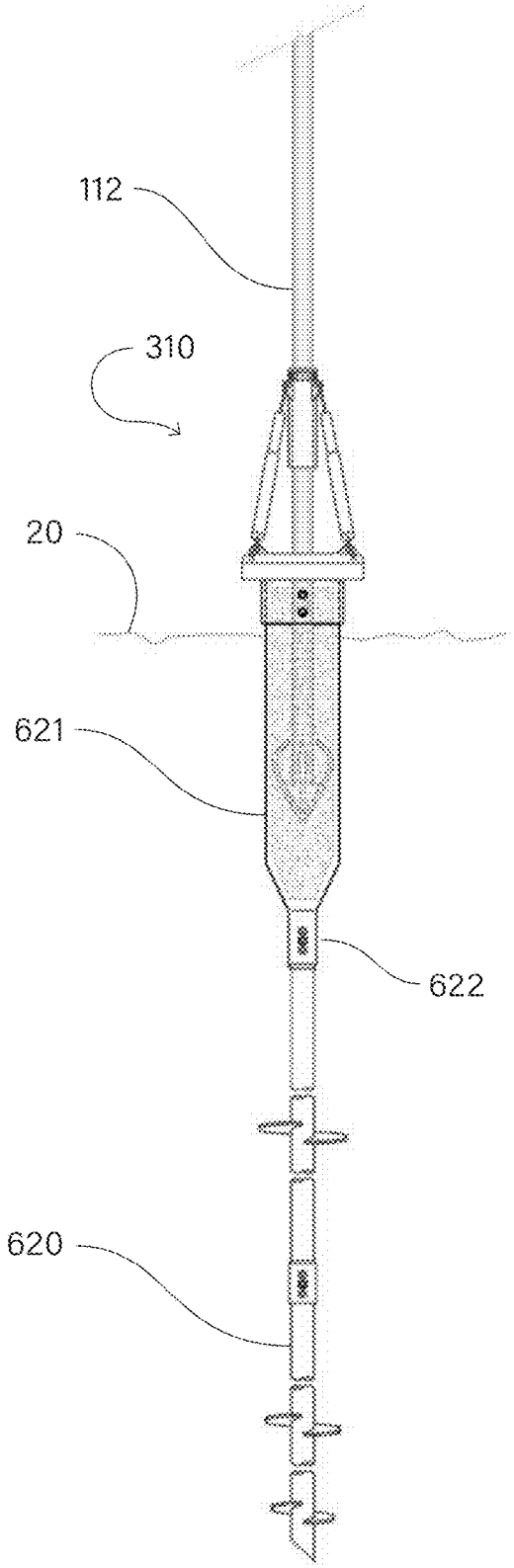
FIG. 26A is a diagram illustrating a cross-sectional view of aspects of an embodiment of a robotics-assisted foundation installation system.

FIG. 26A is a diagram illustrating a cross-sectional view of aspects of an embodiment of a robotics-assisted foundation installation system. In FIG. 26A, a pier cap 621 is shown coupled to a helical pier assembly 620 using a pier cap coupler 622 configured to receive the top of pier assembly 620 and be fastened to it. Pier assembly 620 below coupler 622 is known in the art. Thus fastened together, pier cap 621 and pier assembly 620 may be rotatably driven as one during the installation of pier assembly 620, with pier cap 621 being the topmost helical pier segment.

Pier cap 621 is fabricated to support the application embodiments of a robotics-assisted foundation installation system. Pier cap 621 is coupled to the top-most portion of the associated pier assembly 620, either at the time pier assembly 620 is installed, or subsequently. Pier cap 621 is structurally connected to pier assembly 620 using a pier cap coupler section 622 that satisfies a structural performance specification, or being integrally formed with pier assembly 620 during the creation of pile 605. Without a pier cap 621, a typical pier assembly 620 is known in the art and may be construction of varying materials and to varying structural performance specifications. Helical pier segments 620 (which can vary in length, diameter and material) are generally installed through a process of being rotationally driven into the ground by site equipment (or by hand, in some cases) to a point that is convenient for attaching each subsequent segment of a quantity sufficient to reach the desired or optimally performing structural depth for the composite structure. Pier cap 621 of an embodiment is configured with an attachment at the base that conforms to the helical pier coupling junction (either using a separate or integrated coupler section 622. The inclusion of pier cap 621 atop pier assembly 620 is an aspect of embodiments that transform a conventional and imprecise method of foundation setting into one that is able to achieve a machine tolerance precise, top of column three-dimensional location through the use of embodiments of the robotics-assisted foundation installation system. Grout may then be added to cavity 624 to fix column 112 in position.

Figure 26B:
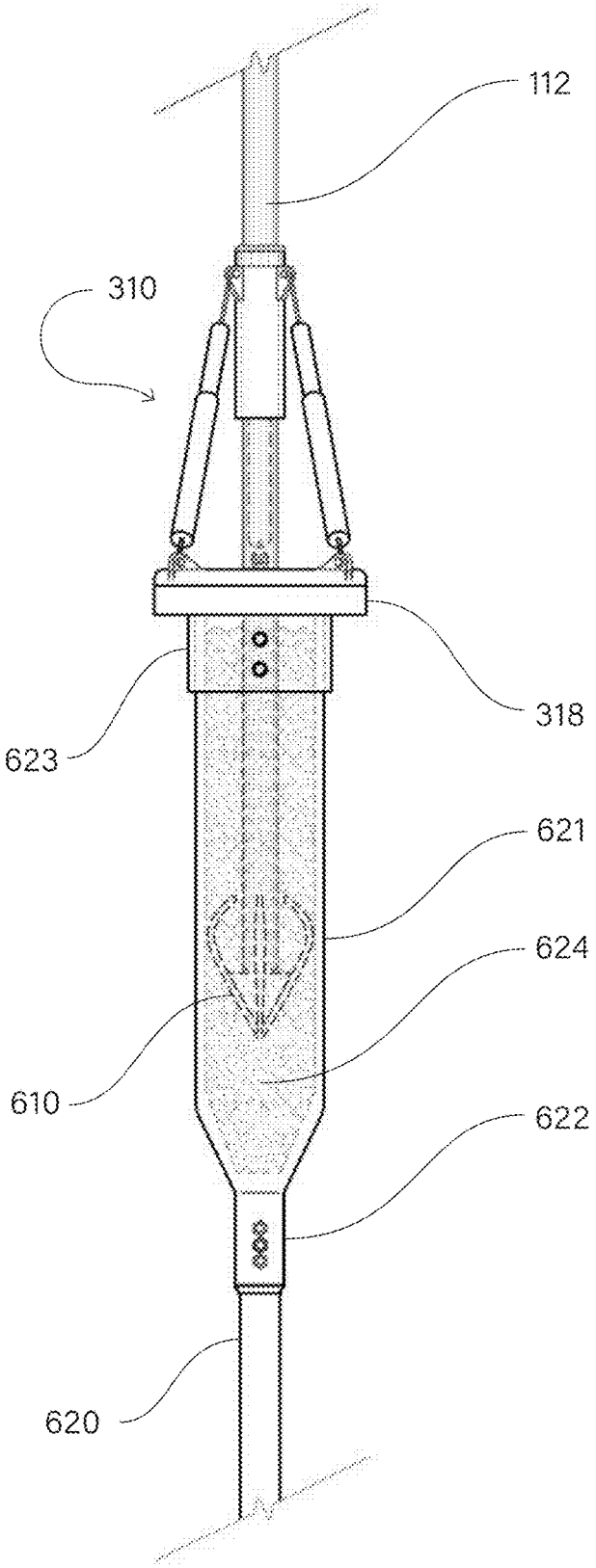
FIG. 26B is a cross-sectional view further illustrating aspects of the embodiment of a robotics-assisted foundation installation system of FIG. 26A.

FIG. 26B is a cross-sectional view further illustrating aspects of the embodiment of a robotics-assisted foundation installation system of FIG. 26A. In FIG. 26B, a pier cap top 623 is shown to receive pier cap 621 and to be connected to tool ring base 318. Pier cap top 623 is configured to interface with the equipment (if any) being used to rotationally drive pier assembly 620 to target depth so that no change of equipment is required to incorporate pier cap 621 into the build. Pier cap top 623 is further configured to connect to tool ring base 318 so that column positioning tool 310 may be mounted and used to position column 112 as described above.

Figure 23:
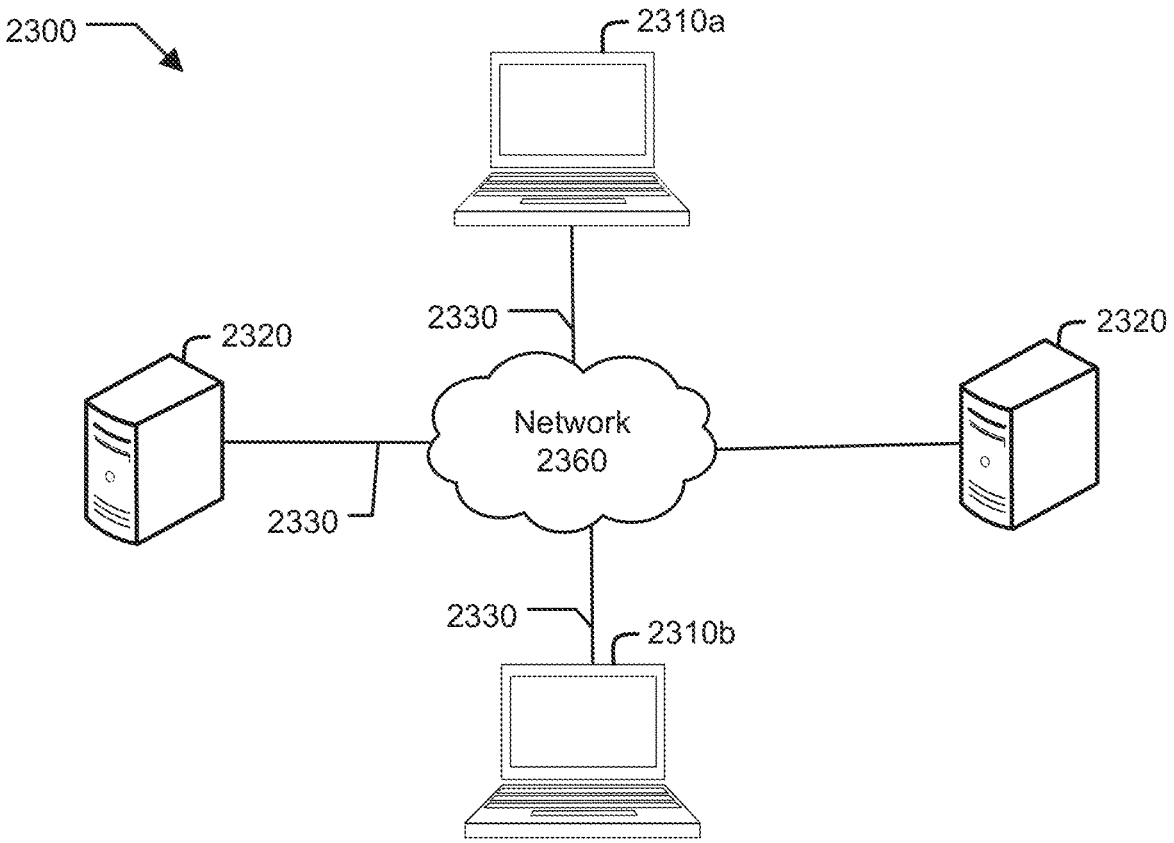
FIG. 23 is an exemplary block diagram depicting an embodiment of a system for implementing embodiments of methods of the disclosure.

FIG. 23 is an exemplary block diagram depicting an embodiment of system for implement embodiments of methods of the disclosure, e.g., as described with reference to the previous figures, and particularly location determining system 290, grid control system 295, and tool control system 560.

In FIG. 23, computer network 2300 includes a number of computing devices 2310*a*-2310*b* (each of which may implement location determining system 290, grid control system 295, and tool control system 560), and one or more server systems 2320 coupled to a communication network 2360 via a plurality of communication links 2330. Communication network 2360 provides a mechanism for allowing the various components of distributed network 2300 to communicate and exchange information with each other. Thus, FIG. 23 describes systems for implementing location determining system 290, grid control system 295, and tool control system 560, and for communications between them.

Communication network 2360 itself is comprised of one or more interconnected computer systems and communication links. Communication links 2330 may include hardwire links, optical links, satellite or other wireless communications links, wave propagation links, or any other mechanisms for communication of information. Various communication protocols may be used to facilitate communication between the various systems shown in FIG. 23. These communication protocols may include TCP/IP, UDP, HTTP protocols, wireless application protocol (WAP), BLUETOOTH, Zigbee, 802.11, 802.15, 6LoWPAN, LiFi, Google Weave, NFC, GSM, CDMA, other cellular data communication protocols, wireless telephony protocols, Internet telephony, IP telephony, digital voice, voice over broadband (VoBB), broadband telephony, Voice over IP (VoIP), vendor-specific protocols, customized protocols, and others. While in one embodiment, communication network 2360 is the Internet, in other embodiments, communication network 2360 may be any suitable communication network including a local area network (LAN), a wide area network (WAN), a wireless network, a cellular network, a personal area network, an intranet, a private network, a near field communications (NFC) network, a public network, a switched network, a peer-to-peer network, and combinations of these, and the like.

In an embodiment, the server 2320 is not located near a user of a computing device, and is communicated with over a network. In a different embodiment, the server 2320 is a device that a user can carry upon his person, or can keep nearby. In an embodiment, the server 2320 has a large battery to power long distance communications networks such as a cell network (LTE, 5G), or Wi-Fi. The server 2320 communicates with the other components of the system via wired links or via low powered short-range wireless communications such as Bluetooth®. In an embodiment, one of the other components of the system plays the role of the server, e.g., the PC 2310*b*.

Distributed computer network 2300 in FIG. 23 is merely illustrative of an embodiment incorporating the embodiments and does not limit the scope of the invention as recited in the claims. One of ordinary skill in the art would recognize other variations, modifications, and alternatives. For example, more than one server system 2320 may be connected to communication network 2360. As another example, a number of computing devices 2310*a*-2310*b* may be coupled to communication network 2360 via an access provider (not shown) or via some other server system.

Computing devices 2310*a*-2310*b* typically request information from a server system that provides the information. Server systems by definition typically have more computing and storage capacity than these computing devices, which are often such things as portable devices, mobile communications devices, or other computing devices that play the role of a client in a client-server operation. However, a particular computing device may act as both a client and a server depending on whether the computing device is requesting or providing information. Aspects of the embodiments may be embodied using a client-server environment or a cloud-cloud computing environment.

Server 2320 is responsible for receiving information requests from computing devices 2310*a*-2310*b*, for performing processing required to satisfy the requests, and for forwarding the results corresponding to the requests back to the requesting computing device. The processing required to satisfy the request may be performed by server system 2320 or may alternatively be delegated to other servers connected to communication network 2360 or to other communications networks. A server 2320 may be located near the computing devices 2310 or may be remote from the computing devices 2310. A server 2320 may be a hub controlling a local enclave of things in an internet of things scenario.

Computing devices 2310*a*-2310*b* enable users to access and query information or applications stored by server system 2320. Some example computing devices include portable electronic devices (e.g., mobile communications devices) such as the Apple iPhone®, the Apple iPad®, the Palm Pre™, or any computing device running the Apple iOS™, Android™ OS, Google Chrome OS, Symbian OS®, Windows 10, Windows Mobile® OS, Palm OS® or Palm Web OS™, or any of various operating systems used for Internet of Things (IoT) devices or automotive or other vehicles or Real Time Operating Systems (RTOS), such as the RIOT OS, Windows 10 for IoT, WindRiver VxWorks, Google Brillo, ARM Mbed OS, Embedded Apple iOS and OS X, the Nucleus RTOS, Green Hills Integrity, or Contiki, or any of various Programmable Logic Controller (PLC) or Programmable Automation Controller (PAC) operating systems such as Microware OS-9, VxWorks, QNX Neutrino, FreeRTOS, Micrium μC/OS-II, Micrium μC/OS-III, Windows CE, TI-RTOS, RTEMS. Other operating systems may be used. In a specific embodiment, a "web browser" application executing on a computing device enables users to select, access, retrieve, or query information and/or applications stored by server system 2320. Examples of web browsers include the Android browser provided by Google, the Safari® browser provided by Apple, the Opera Web browser provided by Opera Software, the BlackBerry® browser provided by Research In Motion, the Internet Explorer® and Internet Explorer Mobile browsers provided by Microsoft Corporation, the Firefox® and Firefox for Mobile browsers provided by Mozilla®, and others.

Figure 24:
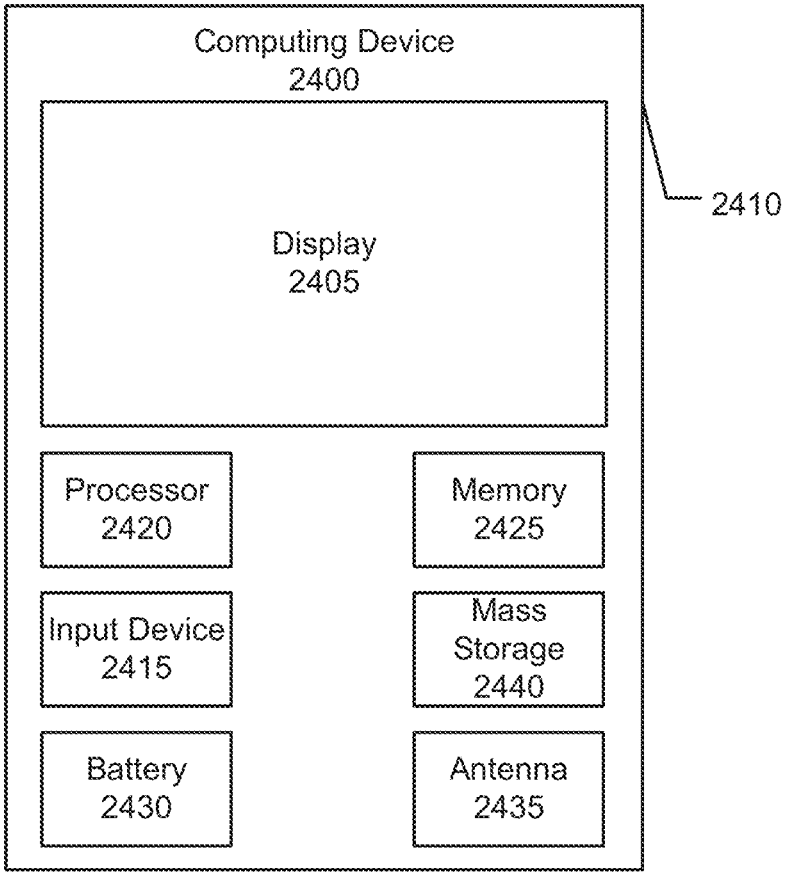
FIG. 24 is an exemplary block diagram depicting a computing device.

FIG. 24 is an exemplary block diagram depicting a computing device 2400 of an embodiment. Computing device 2400 may be any of the computing devices 2310 from FIG. 23. Computing device 2400 may include a display, screen, or monitor 2405, housing 2410, and input device 2415. Housing 2410 houses familiar computer components, some of which are not shown, such as a processor 2420, memory 2425, battery 2430, speaker, transceiver, antenna 2435, microphone, ports, jacks, connectors, camera, input/output (I/O) controller, display adapter, network interface, mass storage devices 2440, various sensors, and the like.

Input device 2415 may also include a touchscreen (e.g., resistive, surface acoustic wave, capacitive sensing, infrared, optical imaging, dispersive signal, or acoustic pulse recognition), keyboard (e.g., electronic keyboard or physical keyboard), buttons, switches, stylus, or combinations of these.

Mass storage devices 2440 may include flash and other nonvolatile solid-state storage or solid-state drive (SSD), such as a flash drive, flash memory, or USB flash drive. Other examples of mass storage include mass disk drives, floppy disks, magnetic disks, optical disks, magneto-optical disks, fixed disks, hard disks, SD cards, CD-ROMs, recordable CDs, DVDs, recordable DVDs (e.g., DVD-R, DVD+R, DVD-RW, DVD+RW, HD-DVD, or Blu-ray Disc), battery-backed-up volatile memory, tape storage, reader, and other similar media, and combinations of these.

Embodiments may also be used with computer systems having different configurations, e.g., with additional or fewer subsystems, and may include systems provided by Arduino, or Raspberry Pi. For example, a computer system could include more than one processor (i.e., a multiprocessor system, which may permit parallel processing of information) or a system may include a cache memory. The computer system shown in FIG. 24 is but an example of a computer system suitable for use with the embodiments. Other configurations of subsystems suitable for use with the embodiments will be readily apparent to one of ordinary skill in the art. For example, in a specific implementation, the computing device is a mobile communications device such as a smartphone or tablet computer. Some specific examples of smartphones include the Droid Incredible and Google Nexus One, provided by HTC Corporation, the iPhone or iPad, both provided by Apple, and many others. The computing device may be a laptop or a netbook. In another specific implementation, the computing device is a non-portable computing device such as a desktop computer or workstation.

A computer-implemented or computer-executable version of the program instructions useful to practice the embodiments may be embodied using, stored on, or associated with computer-readable medium. A computer-readable medium may include any medium that participates in providing instructions to one or more processors for execution, such as memory 2425 or mass storage 2440. Such a medium may take many forms including, but not limited to, nonvolatile, volatile, transmission, non-printed, and printed media. Nonvolatile media includes, for example, flash memory, or optical or magnetic disks. Volatile media includes static or dynamic memory, such as cache memory or RAM. Transmission media includes coaxial cables, copper wire, fiber optic lines, and wires arranged in a bus. Transmission media can also take the form of electromagnetic, radio frequency, acoustic, or light waves, such as those generated during radio wave and infrared data communications.

For example, a binary, machine-executable version, of the software useful to practice the embodiments may be stored or reside in RAM or cache memory, or on mass storage device 2440. The source code of this software may also be stored or reside on mass storage device 2440 (e.g., flash drive, hard disk, magnetic disk, tape, or CD-ROM). As a further example, code useful for practicing the embodiments may be transmitted via wires, radio waves, or through a network such as the Internet. In another specific embodiment, a computer program product including a variety of software program code to implement features of the embodiment is provided.

Computer software products may be written in any of various suitable programming languages, such as C, C++, C #, Pascal, Fortran, Perl, Matlab (from MathWorks, www.mathworks.com), SAS, SPSS, JavaScript, CoffeeScript, Objective-C, Swift, Objective-J, Ruby, Rust, Python, Erlang, Lisp, Scala, Clojure, and Java. The computer software product may be an independent application with data input and data display modules. Alternatively, the computer software products may be classes that may be instantiated as distributed objects. The computer software products may also be component software such as Java Beans (from Oracle) or Enterprise Java Beans (EJB from Oracle).

An operating system for the system may be the Android operating system, iPhone OS (i.e., iOS), Symbian, BlackBerry OS, Palm web OS, Bada, MeeGo, Maemo, Limo, or Brew OS. Other examples of operating systems include one of the Microsoft Windows family of operating systems (e.g., Windows 95, 98, Me, Windows NT, Windows 2000, Windows XP, Windows XP x64 Edition, Windows Vista, Windows 10 or other Windows versions, Windows CE, Windows Mobile, Windows Phone, Windows 10 Mobile), Linux, HP-UX, UNIX, Sun OS, Solaris, Mac OS X, Alpha OS, AIX, IRIX32, or IRIX64, or any of various operating systems used for Internet of Things (IoT) devices or automotive or other vehicles or Real Time Operating Systems (RTOS), such as the RIOT OS, Windows 10 for IoT, WindRiver VxWorks, Google Brillo, ARM Mbed OS, Embedded Apple iOS and OS X, the Nucleus RTOS, Green Hills Integrity, or Contiki, or any of various Programmable Logic Controller (PLC) or Programmable Automation Controller (PAC) operating systems such as Microware OS-9, VxWorks, QNX Neutrino, FreeRTOS, Micrium Micrium Windows CE, TI-RTOS, RTEMS. Other operating systems may be used.

Furthermore, the computer may be connected to a network and may interface to other computers using this network. The network may be an intranet, internet, or the Internet, among others. The network may be a wired network (e.g., using copper, and connections such as RS232 connectors), telephone network, packet network, an optical network (e.g., using optical fiber), or a wireless network, or any combination of these. For example, data and other information may be passed between the computer and components (or steps) of a system useful in practicing the embodiments using a wireless network employing a protocol such as Wi-Fi (IEEE standards 802.11, 802.11a, 802.11b, 802.11e, 802.11g, 802.11i, and 802.11n, just to name a few examples), or other protocols, such as BLUETOOTH or NFC or 802.15 or cellular, or communication protocols may include TCP/IP, UDP, HTTP protocols, wireless application protocol (WAP), BLUETOOTH, Zigbee, 802.11, 802.15, 6LoWPAN, LiFi, Google Weave, NFC, GSM, CDMA, other cellular data communication protocols, wireless telephony protocols or the like. For example, signals from a computer may be transferred, at least in part, wirelessly to components or other computers.

The following paragraphs set forth enumerated embodiments.

1. A method comprising:
   installing a plurality of structural supports at a build site;
   for each structural support from the plurality of structural supports:
      providing an interface atop each structural support of the plurality of structural supports, the interface defining an internal space,
      positioning a column, from a plurality of columns, within the internal space of each interface such that a first end of the column is within the internal space and a second end of the column is external to the internal space,
      connecting to each column an actuator assembly configured to move the column with respect to the structural support, and
      using a data acquisition system, determining an actual location of the second end;
   determining, using the determined actual locations of the second ends of the plurality of columns, for each second end from the plurality of columns:
      a target location for each second end, and
      an offset between the actual location and the target location;
   determining, for a subset of second ends, that the offset is greater than a first predetermined tolerance from the target location;
   causing, for each second end from the subset of second ends, the attached actuator assembly to move the second end toward the target location for that second end;
   determining, for each second end from the subset of second ends and using the data acquisition system, that the offset has changed to be within the first predetermined tolerance; and
   fixing each column in place within the internal space of its associated interface.

2. The method of embodiment 1, wherein:
   the data acquisition system includes a total surveying station; and
   the step of using a data acquisition system, determining an actual location of the second end includes using the total surveying station and a reflector attached to the second end to determine the actual location of the second end.

3. The method of embodiment 1, wherein:
   the target locations for the second ends of the plurality of columns define a plane;
   the first predetermined tolerance includes a distance of the second end from the plane; and
   and the actuator assembly is configured to tilt the column to move the second end toward the target location.

4. The method of embodiment 1, wherein:
   the target locations for the second ends of the plurality of columns define a plane;
   the first predetermined tolerance includes a distance of the second end from the plane; and
   and the actuator assembly is configured to translate the column to move the second end toward the target location.

5. The method of embodiment 1, wherein:
   the target locations for the second ends of the plurality of columns define a plane;
   the first predetermined tolerance includes a distance of the second end from the plane; and
   and the actuator assembly is configured to tilt and translate the column to move the second end toward the target location.

6. The method of embodiment 5, further comprising:
   determining, for each structural support from the plurality of structural supports using the data acquisition system, an actual tilt of the column;
   determining, using the determined actual tilts of the plurality of columns, for each column from the plurality of columns, a misalignment between the actual tilt and a target tilt; and the target location;
   determining, for a subset of columns of the plurality of columns, that the actual tilt is greater than a second predetermined tolerance from the target tilt;
   causing, for each column from the subset of columns, the attached actuator assembly to tilt the column toward the target tilt; and
   determining, for each column from the subset of columns and using the data acquisition system, that the misalignment is within the second predetermined tolerance.

7. The method of embodiment 1, wherein:
   the step of connecting to each column an actuator assembly configured to move the column with respect to the structural support, includes connecting the actuator assembly to the column and to the interface in which the column is positioned.

8. The method of embodiment 1, wherein:
   the step of fixing each column in place within the internal space of its associated interface includes filling the internal space about the column with material that, when hardened, fixes the position of the column with respect to the interface.

9. A system comprising:
   an interface defining an internal space configured to receive a first end of a column and configured to couple to a structural support;
   an actuator assembly including:
      a first section configured to hold the column
      at least one actuator connected to the first section and configured to move the first section such that, when the first end of the column is received within the internal space and the column is held by the first section, a second end of the column is moved with respect to the interface.

10. The system of embodiment 9, wherein:
   the actuator assembly further includes a second section configured to couple to the interface;
   the at least one actuator includes a plurality of linear actuators, each connected between the first section and the second section and configured to move the first section with respect to the second section; and
   the plurality of linear actuators are configured to move the first section with respect to the second section such that, when the second section is coupled to the interface, the first end of the column is received within the internal space, and the column is held by the first section, the plurality of linear actuators are controllable to tilt the column with respect to the interface.

11. The system of embodiment 9, wherein:

the actuator assembly further includes a second section configured to couple to the interface;

the at least one actuator includes a plurality of linear actuators, each connected to the first section and the second section and configured to translate the first section with respect to the second section;

the first section includes a clamp configured to hold the column such that the column does not move relative to the first section; and the plurality of linear actuators are configured to move the first section with respect to the second section such that, when the second section is coupled to the interface, and the column is held by the first section, the plurality of linear actuators are controllable to translate the column with respect to the interface.

12. The system of embodiment 9, wherein:

the first section includes a clamp configured to hold the column such that the column does not move relative to the first section;

the actuator assembly further includes:

a second section configured to couple to the interface, and a third section configured to hold the column;

the at least one actuator includes:

a first plurality of linear actuators, each connected between the first section and the second section;

a second plurality of linear actuators, each connected between the third section and the second section;

the first plurality of linear actuators are configured to translate the second section in three dimensions;

the second plurality of linear actuators are configured to move the third section within a plane; and when the second section is coupled to the interface, the column is held by the first section such that the column does not move with respect to the first section, and the column is held by the second section, the first plurality and the second plurality of linear actuators are controllable to tilt and translate the column with respect to the interface.

13. The system of embodiment 9, wherein the internal space of the interface includes either:

a pin configured to be received within an opening in the first end of the column and limit a range of motion of the first end; or an adapter with elements slanted to direct the first end toward a center of the internal space.

14. A system for controlling the location of a plurality of columns with respect to a plurality of structural supports, the system comprising:

a plurality of interfaces, each interface defining an internal space configured to receive a first end of a column;

a plurality of actuator assemblies, each actuator assembly configured to move a column with respect to a structural support; and a computing system including instructions and a data acquisition system configured to determine, for each column of a plurality of columns, a location of a second end of the column, wherein, when:

the plurality of structural supports are installed at a build site, an interface is provided atop each structural support, a column is positioned within the internal space of each interface such that a first end of the column is within the internal space and a second end of the column is external to the internal space, and an actuator assembly is connected to each column;

the instructions, when executed by the computing system cause the system to perform operations including:

determining, for each structural support from the plurality of structural supports and using the data acquisition system, an actual location of the second end;

determining, using the determined actual locations of the second ends of the plurality of columns, for each second end from the plurality of columns:

a target location for each second end, and an offset between the actual location and the target location;

determining, for a subset of second ends, that the offset is greater than a first predetermined tolerance from the target location;

causing, for each second end from the subset of second ends, the attached actuator assembly to move the second end toward the target location for that second end;

determining, for each second end from the plurality of columns and using the data acquisition system, that the offset has changed to be within the first predetermined tolerance; and indicating to a user that the offset is within the first predetermined tolerance for each second end from the plurality of columns.

15. The system of embodiment 14, wherein:

the data acquisition system includes a total surveying station; and the operation of determining, for each structural support from the plurality of structural supports and using the data acquisition system, an actual location of the second end is performed when a reflector is attached to the second end and using the total surveying station to determine the actual location of the second end and.

16. The system of embodiment 14, wherein:

the target locations for the second ends of the plurality of columns define a plane;

the first predetermined tolerance includes a distance of the second end from the plane; and and the actuator assembly is configured to tilt the column to move the second end toward the target location.

17. The system of embodiment 14, wherein:

the target locations for the second ends of the plurality of columns define a plane;

the first predetermined tolerance includes a distance of the second end from the plane; and and the actuator assembly is configured to translate the column to move the second end toward the target location.

18. The system of embodiment 14, wherein:

the target locations for the second ends of the plurality of columns define a plane;

the first predetermined tolerance includes a distance of the second end from the plane; and and the actuator assembly is configured to tilt and translate the column to move the second end toward the target location.

19. The system of embodiment 18, the operations further including:

determining, for each structural support from the plurality of structural supports using the data acquisition system, an actual tilt of the column;

determining, using the determined actual tilts of the plurality of columns, for each column from the plurality of columns, a misalignment between the actual tilt and a target tilt; and the target location;

determining, for a subset of columns of the plurality of columns, that the actual tilt is greater than a second predetermined tolerance from the target tilt;

causing, for each column from the subset of columns, the attached actuator assembly to tilt the column toward the target tilt;

determining, for each column from the subset of columns and using the data acquisition system, that the misalignment is within the second predetermined tolerance; and indicating to a user that the misalignment is within the second predetermined tolerance for each second end from the subset of columns.

20. The system of embodiment 14, wherein:

an actuator assembly is connected to each column includes:

the actuator assembly is connected to the column and to the interface in which the column is positioned.

While the embodiments have been described with regards to particular embodiments, it is recognized that additional variations may be devised without departing from the inventive concept.

The terminology used herein is for the purpose of describing particular embodiments only and is not intended to be limiting of the claimed subject matter. As used herein, the term "and/or" includes any and all combinations of one or more of the associated listed items. As used herein, the singular forms "a," "an," and "the" are intended to include the plural forms as well as the singular forms, unless the context clearly indicates otherwise. It will further be understood that the terms "comprises" and/or "comprising," when used in this specification, specify the presence of states features, steps, operations, elements, and/or components, but do not preclude the present or addition of one or more other features, steps, operations, elements, components, and/or groups thereof.

Unless otherwise defined, all terms (including technical and scientific terms) used herein have the same meaning as commonly understood by one having ordinary skill in the art to which the embodiments belong. It will further be understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the embodiments, it will be understood that a number of elements, techniques, and steps are disclosed. Each of these has individual benefit and each can also be used in conjunction with one or more, or in some cases all, of the other disclosed elements, or techniques. The specification and claims should be read with the understanding that such combinations are entirely within the scope of the embodiments and the claimed subject matter.

In the description above and throughout, numerous specific details are set forth in order to provide a thorough understanding of an embodiment of this disclosure. It will be evident, however, to one of ordinary skill in the art, that an embodiment may be practiced without these specific details. In other instances, well-known structures and devices are shown in block diagram form to facilitate explanation. The description of the preferred embodiments is not intended to limit the scope of the claims appended hereto. Further, in the methods disclosed herein, various steps are disclosed illustrating some of the functions of an embodiment. These steps are merely examples and are not meant to be limiting in any way. Other steps and functions may be contemplated without departing from this disclosure or the scope of an embodiment.

What is claimed is:

1. A system comprising:

an interface defining an internal space configured to receive a first end of a first column and configured to couple to a structural support;

an actuator assembly including:

a first section configured to receive the first column; and at least one actuator connected to the first section and configured to move the first section such that, when the first end of the first column is received within the internal space and the first column is received by the first section, a second end of the first column is moved with respect to the interface; and a control system configured to:

receive first information regarding a location of the second end of the first column; and control the at least one actuator to cause the second end of the first column to move toward a target position.

2. The system of claim 1, wherein:

the actuator assembly further includes a second section configured to couple to the interface;

the at least one actuator includes a plurality of linear actuators, each connected between the first section and the second section; and the plurality of linear actuators are configured to move the first section with respect to the second section such that, when the second section is coupled to the interface, and the first end of the first column is received within the internal space, and the first column is received by the first section, the plurality of linear actuators are controllable to tilt the column with respect to the interface.

3. The system of claim 1, wherein the actuator assembly further includes a second section configured to couple to the interface;

the at least one actuator includes a plurality of linear actuators, each connected to the first section and the second section;

the first section is configured to hold the first column such that the first column does not move relative to the first section; and the plurality of linear actuators are configured to move the first section with respect to the second section such that, when the second section is coupled to the interface, and the first column is held by the first section, the plurality of linear actuators are controllable to either or both of tilt the first column or translate the first column with respect to the interface.

4. The system of claim 1, wherein:

the first section is configured to hold the first column such that the first column does not move relative to the first section;

the actuator assembly further includes:

a second section configured to couple to the interface, and a third section configured to receive the first column;

the at least one actuator includes:

a first plurality of linear actuators, each connected between the first section and the second section;

a second plurality of linear actuators, each connected between the third section and the second section;

the first plurality of linear actuators are configured to either or both of: tilt the second section or translate the second section in three dimensions;

the second plurality of linear actuators are configured to move the third section within a plane; and when the second section is coupled to the interface, and the first column is held by the first section such that the first column does not move with respect to the first section, and the first column is received by the second section, the first plurality and the second plurality of linear actuators are controllable to tilt and translate the first column with respect to the interface.

5. The system of claim 1, wherein the internal space of the interface includes either:

a pin configured to be received within an opening in the first end of the first column and limit a range of motion of the first end; or an adapter with elements slanted to direct the first end toward a center of the internal space.

6. The system of claim 1, further comprising:

a geolocation device configured to be connected to the second end of the first column; and a surveying station configured to:

determine the location of the second end of the first column using the geolocation device; and provide the first information regarding the location of the second end of the first column to the control system.

7. The system of claim 1, wherein the control system is configured to:

receive second information including a location of each second end from a plurality of columns;

determine from the first information and second information a target plane, wherein the target position is located on the target plane.

8. A method comprising:

coupling an interface to a structural support, the interface defining an internal space configured to receive a first end of a first column;

positioning an actuator assembly with respect to the interface, the actuator assembly including at least one actuator;

causing the first column to be received in a first section of the actuator assembly and the first end of the first column to be received within the internal space;

receiving, by a control system, first information regarding a location of a second end of the first column; and controlling, by the control system, the at least one actuator to move the first section such that the second end of the first column is moved with respect to the interface toward a target position.

9. The method of claim 8, further comprising coupling a second section of the actuator assembly to the interface, wherein:

the at least one actuator includes a plurality of linear actuators, each connected between the first section and the second section; and controlling the at least one actuator to move the first section such that the second end of the first column is moved with respect to the interface includes:

controlling the plurality of linear actuators to move the first section with respect to the second section to tilt the column with respect to the interface.

10. The method of claim 8, further comprising coupling a second section of the actuator assembly to the interface, wherein:

the at least one actuator includes a plurality of linear actuators, each connected between the first section and the second section;

the first section is configured to hold the first column such that the first column does not move relative to the first section; and controlling the at least one actuator to move the first section such that the second end of the first column is moved with respect to the interface includes:

controlling the plurality of linear actuators to move the first section with respect to the second section to either or both of tilt the first column or translate the first column with respect to the interface.

11. The method of claim 8, further comprising:

coupling a second section of the actuator assembly to the interface, causing the first column to be received by a third section of the actuator assembly; wherein:

the first section is configured to hold the first column such that the first column does not move relative to the first section;

the at least one actuator includes:

a first plurality of linear actuators, each connected between the first section and the second section and configured to either or both of: tilt the second section or translate the second section in three dimensions;

a second plurality of linear actuators configured to move the third section within a plane, each connected between the third section and the second section; and controlling the at least one actuator to move the first section such that the second end of the first column is moved with respect to the interface includes:

controlling the first plurality and the second plurality of linear actuators to tilt and translate the first column with respect to the interface.

12. The method of claim 8, wherein causing the first end to be received within the internal space includes either:

causing a pin within the internal space to be received within an opening in the first end of the first column, the pin limiting a range of motion of the first end; or causing the first end to be received by an adapter with elements slanted to direct the first end toward a center of the internal space.

13. The method of claim 8, further comprising attaching a geolocation device to the second end of the first column;

using, by a surveying station, the geolocation device to determine the location of the second end of the first column; and providing, by the surveying station, the first information regarding the location of the second end of the first column to the control system.

14. The method of claim 8, further comprising:

receiving, by the control system, second information including a location of each second end from a plurality of columns; and determining, by the control system from the first information and second information a target plane, wherein the target position is located on the target plane.

15. A non-transitory computer-readable medium including instructions, which when executed by a processor of a control system, cause the control system to perform steps comprising:

receiving first information regarding a location of a second end of the first column; and controlling at least one actuator of an actuator assembly to move a first section of the actuator assembly such that the second end of a first column is moved with respect to an interface coupled to a structural support toward a target position, when:

the actuator assembly is positioned with respect to the interface; and the first column is received in the first section of the actuator assembly and the first end of the first column is received within an internal space of the interface.

16. The non-transitory computer-readable medium of claim 15, wherein the first information regarding a location of the second end of the first column is received from a surveying station, the surveying station using a geolocation device attached to the second end of the first column to determine the location of the second end of the first column.

17. The non-transitory computer-readable medium of claim 15, the steps further comprising:

receiving second information including a location of each second end from a plurality of columns; and determining, from the first information and second information, a target plane, wherein the target position is located on the target plane.

* * * * *